United States Patent [19]

Kaneko et al.

[11] Patent Number: 4,863,842

[45] Date of Patent: Sep. 5, 1989

[54] SILVER HALIDE PHOTOGRAPHIC LIGHT SENSITIVE MATERIAL

[75] Inventors: Yutaka Kaneko, Sagamihara; Kenzi Kadokura, Hachioji; Toyoki Nishijima, Odawara; Kaoru Onodera, Sagamihara, all of Japan

[73] Assignee: Konica Technosearch Corporation, Japan

[21] Appl. No.: 230,716

[22] Filed: Aug. 9, 1988

Related U.S. Application Data

[63] Continuation of Ser. No. 53,394, Jul. 13, 1987, abandoned.

[30] Foreign Application Priority Data

Sep. 12, 1985 [JP] Japan ..... 60-202268
Feb. 3, 1986 [JP] Japan ..... 61-21497

[51] Int. Cl.[4] ..... G03C 7/26; G03C 7/38
[52] U.S. Cl. ..... 430/551; 430/558
[58] Field of Search ..... 430/551, 558, 372

[56] References Cited

U.S. PATENT DOCUMENTS

| | | | |
|---|---|---|---|
| 2,343,703 | 3/1944 | Porter et al. | 430/386 |
| 3,725,067 | 4/1973 | Bailey et al. | 430/476 |
| 3,770,447 | 11/1973 | Boie et al. | 430/558 |
| 4,243,747 | 1/1981 | Nakamura et al. | 430/551 |
| 4,489,155 | 12/1984 | Sakanoue et al. | 430/505 |
| 4,752,561 | 6/1988 | Nishijima et al. | 430/551 |
| 4,795,696 | 1/1989 | Sasaki et al. | 430/512 |

FOREIGN PATENT DOCUMENTS

| | | |
|---|---|---|
| 4056833 | 8/1979 | Japan . |
| WO87/01826 | 3/1987 | PCT Int'l Appl. . |
| 1047612 | 11/1966 | United Kingdom . |
| 1059994 | 2/1967 | United Kingdom . |
| 1252418 | 11/1971 | United Kingdom . |
| 1334515 | 10/1973 | United Kingdom . |
| 2135788A | 9/1984 | United Kingdom . |

*Primary Examiner*—Paul R. Michl
*Assistant Examiner*—Lee C. Wright
*Attorney, Agent, or Firm*—Finnegan, Henderson, Farabow, Garrett & Dunner

[57] ABSTRACT

A silver halide photographic light sensitive material, which contains at least one magenta dye image forming coupler expressed by the following general formula [I], at least one piperazine or homopiperazine compound expressed by the following general formula [XIIIa], at least one compound selected from a coumarane or a chroman compounds expressed by general formula [XIIIa] and hydroxyindane compounds expressed by [XIIIb], below, is described as being stable to light and moisture, and featuring an excellent color reproducibility.

General formula [I]

General formula [XII]

General formula [XIIIa]

General formula [XIIIb]

The effect of the invention is further improved by additionally employing a metallic compound wherein an optical quenching rate of singlet oxygen is more than $3\times10^{7}\ M^{-1}\cdot sec^{-1}$.

14 Claims, No Drawings

SILVER HALIDE PHOTOGRAPHIC LIGHT SENSITIVE MATERIAL

This application is a continuation, of application Ser. No. 07/053,394, filed July 13, 1987 now abandoned.

FIELD OF THE INVENTION

The present invention relates to a silver halide light sensitive material, which features a dye image stable to light and heat, and, in which generation of a stain is prevented.

BACKGROUND OF THE INVENTION

It is conventionally well known in the art that an oxidant derived from a color-forming developing agent and containing an aromatic primary amine couples with a color coupler when a silver halide color light sensitive material is treated in an image-wise exposure as well as color development, forming dyes, such as an indophenol, indoaniline, indamine, azomethine, phenoxyazine, phenazine and dyes similar to them, thus forming a dye image.

What is required for the dye image obtained in such a manner is that it does not show discoloration or color fading even if it is stored under high temperature and/or high humidity. Additionally, what is required for the non-colored portion in a silver halide light sensitive material (hereinafter referred to as color photographic material) is that it does not show yellow-stain (hereinafter referred to as Y-stain) due to light, heat or moisture.

However, in the case of a magenta coupler, the Y-stain in the non-colored portion due to light, heat or moisture as well as the color fading of the dye image portion due to light are extremely great, when compared to a yellow coupler or a cyan coupler, often causing troubles.

5-pyrazolones are widely used as couplers to form magenta dyes. It is a great disadvantage that dyes formed from 5-pyrazolo-5-ones have a secondary absorption in the range around 430 nm in addition to a primary absorption around 550 nm. Various researches were conducted in order to solve this disadvantage. A magenta coupler having anilino group in the third position of a 5-pyrazolone has a limited secondary absorption, mentioned above, and is advantageous in obtaining a printed color image. Such a method was disclosed, for example in U.S. Pat. No. 2343703 and UK Patent No. 1059994.

However, with the magenta coupler, mentioned above, a shelf stability is limited, and especially, a light resistance of a dye image was significantly poor, resulting in a disadvantageously great Y-stain in a non-colored portion.

In order to reduce the secondary absorption around 430 nm of the above-mentioned magenta couplers, the magenta colors shown in the following were proposed so as to provide a new measure: pyrazobenzimidazoles mentioned in U.K. Patent No. 1047612; indazolones mentioned in U.S. Pat. No. 3,770,447; 1H-pyrazolo[5,1-c]-1,2,4-triazole couplers disclosed in U.S. Pat. No. 3,725,067, UK Patent Nos. 1252418 and 1334515; 1H-pyrazol[5,1-c]-1,2,4-triazole couplers disclosed in U.S. Pat. No. 3,725,067, UK Patent Nos. 1252418 and 1334515: 1H-pyrazolo]1,5,-b]-1,2,4-triazole couplers disclosed in Japanese Patent Publication Open to Public Inspection (hereinafter referred to as Japanese Patent O.P.I. Publication) No. 171956/1974 and Research Disclosure No. 24531; 1H-pyrazolo[1, 5,-c]-1,2,3-triazole couplers disclosed in Research Disclosure No. 24626; 1-H-imidazo[1,2,b-] pyrazole couplers disclosed in Japanese Patent O.P.I. Publication No. 162548/1984 and Research Disclosure No. 24531; 1H-imidazo[1,5,-b] pyrazole couplers disclosed in Japanese Patent O.P.I. Publication No. 43659/1985 and Research Disclosure No. 24230; 1H-pyrazolo[1,5,-d] tetrazole couplers disclosed in Japanese Patent O.P.I. Publication No. 33552/1985 and Research Disclosure No. 24220.

Among these examples, dyes formed from 1H-pyrazolo[5,1,-c]-1, 2,4-triazole couplers, 1H-pyrazolo[1,5,-b]-1,2,4-triazole couplers, 1H-pyrazolo[1,5,-c]-1,2,3-triazole couplers, 1H-imidazo[1,2,-b] pyrazole couplers, 1H-pyrazolo[1,5,-b]pyrazole couplers of 1H-pyrazolo[1,5,-d]tetrasole couplers have a significantly smaller secondary absorption around 430 nm of wavelength, when compared to the previously mentioned dyes formed from 5-1,2-pyrazolo-ones having an anilino group in the 3-position. This feature is very advantageous in regard to the color reproduction. Additionally, it is an advantage of such dyes that they show the significantly decreased Y-stain in the non-colored portion due to light, heat or moisture. However, azomethine dyes formed from the couplers, above, are extremely vulnerable to light. And worse, the above-mentioned dyes are easily discolored by light, significantly jeopardizing the performance of color photographic materials, especially color photographic materials for print. Consequently, such dyes have not been employed for a practical use.

In order to improve the light-resistance of magenta dye images formed from 1H-pyrazolo[5,2,-c]-1,2,4-triazole magenta couplers, a method was proposed in Japanese Patent O.P.I. Publication No. 125732/1974, where phenol compounds or phenyl ether compounds were added to 1H-pyrazolo[5,1,-c]-1,2,4-triazole magenta couplers.

However, it was revealed that such an art is not fully effective in preventing the magenta dye image, mentioned above, from fading, and that the prevention of the discoloration due to light was near-impossible.

In view of the disadvantages, above, the present invention has been developed. Therefore it is the first object of the invention to provide a color photographic material which features an excellent color reproducibility as well as a significantly improved light-resistance of a magenta dye image.

It is the second object of the invention to provide a color photographic material which features a magenta dye image where the discoloration due to light is minimized.

It is the third object of the invention to provide a color photographic material in which the generation of a Y-stain in a non-colored portion due to light, heat or moisture is prevented.

DISCLOSURE OF THE INVENTION

The objects of the present invention are attained with a silver halide photographic light sensitive material comprising at least one magenta dye image-forming coupler expressed by the following general formula [1], at least one compound expressed by the following general formula [XII] and at least one compound selected from those expressed by the following general formulas [XIIIa]and [XIIIb]:

General formula [1]

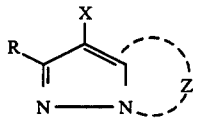

[In the formula, above, Z represents a plurality of nonmetal atoms necessary to complete a heterocyclic ring containing a nitrogen atom; X represents a hydrogen atom or a substituent capable of being split off upon reaction with an oxidation product of a color developing agent, and, R represents a hydrogen atom or a substituent.], and;

General formula [XII]

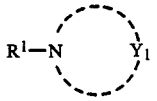

[In the formula, R' represents an aliphatic group, a cycloalkyl group, an aryl group or a heterocyclic group. $Y_1$ represents a group of nonmetal atoms, necessary to complete a piperazine ring or a homopiperazine ring together with a nitrogen atom], and;

General formula [XIIIa]

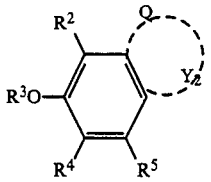

[In the formula, $R^2$ and $R^5$ independently represent a hydrogen atom, a halogen atom, an alkyl group, an alkenyl group, an alkoxy group, an alkenyloxy group, a hydroxy group, an aryl group, an aryloxy group, an acyl group, an acylamino group, an acyloxy group, a sulfonamide group, a cycloalkyl group or an alkoxycarbonyl group; $R^5$ represents a hydrogen atom, an alkyl group, an alkenyl group, an aryl group, an acyl group, a cycloalkyl group or a heterocyclic group; $R^4$ represents a hydrogen atom, a halogen atom, an alkyl group, an alkenyl group, an aryl group, an aryloxy group, an acyl group, an acylamine group, an acyloxy group, a sulfonamide group, a cycloalkyl group or an alkoxycarbonyl group; provided that $R^3$ and $R^4$ may be combined with each other to form a 5- or 6-membered ring, and that $R^3$ and $R^4$ may form a methylenedioxy ring; $Y_2$ represents a group of atoms necessary to complete a chroman ring or a coumarane ring.], and;

General formula [XIIIb]

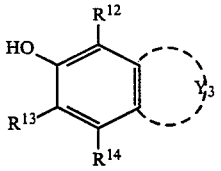

[In the formula, $R^{12}$ and $R^{14}$ independently represent a hydrogen atom, a halogen atom, an alkyl group, an alkenyl group, an alkoxy group, a hydroxy group, an aryl group, an aryloxy group, an acyl group, an acylamino group, an acyloxy group, a sulfonamide group, a cycloalkyl group or an alkoxycarbonyl group; $R^{13}$ represents a hydrogen atom, a halogen atom, an alkyl group, an alkenyl group, a hydroxy group, an aryl group, an acyl group, an acylamino group, an acyloxy group, a sulfonamie group, a cycloalkyl group or an alkoxycarbonyl group provided that $R^{13}$ and $R^{14}$ may be combined with each other to form a 5- or a 6-membered hydrocarbon ring; and $Y_3$ represents a group of atoms necessary to complete an indane ring.].

The present invention is specifically described, below.

In a magenta coupler expressed by the before-mentioned general formula [1], according to the present invention, Z represents a group of nonmental atoms necessary complete a heterocyclic ring containing a nitrogen atom, and, the ring formed from the Z may have a substituent.

Additionally, R represents a hydrogen atom or a substituent other than a hydrogen atom.

The substituents expressed by R, mentioned above, other than a hydrogen atom, include a halogen atom, alkyl group, cycloalkyl group, alkenyl group, cycloalkenyl group, alkinyl group, aryl group, heterocyclic group, acyl group, sulfonyl group, sulfinyl group, phosphonyl group, carbamoyl group, sulfamoyl group, cyano group, spiro compound residue, bridged hydrocarbon compound residue, alkoxy group, aryloxy group, heterocyclic oxy group, siloxy group, acyloxy group, carbamoyloxy group, amino group, acylamino group, sulfonamide group imide group, ureide group, sulfamoylamino group, alkoxycarbonylamino group, aryloxylcarbonylamino group, alkoxycarbonyl group, aryloxycarbonyl group, alkylthio group, arylthio group and heterocyclicthio group.

As the halogen atom, a chlorine atom or a bromine atom is available, however, a chlorine atom is preferred.

As the alkyl group expressed by R, one having 1~32 carbon atoms is preferred. Also, as the alkenyl group or alkinyl group expressed by R, one having 1~32 carbon atoms is preferred. Additionally, as the cycloalkyl group or cycloalkenyl group, expressed likewise, one having 2~32 carbon atoms, and, more specifically, 5~7 carbon atoms is preferred, and, the alkyl group, alkenyl group and alkinyl group may be whichever straight-chained or branched.

At the same time, the alkyl group, alkenyl group, alkinyl group, cycloalkyl group and cycloalkenyl group, mentioned above, may possess the following substituents: an aryl group, cyano group, halogen atom, heterocycle, cycloalkyl, cycloalkenyl, spiro compound residue, bridged hydrocarbon compound residue, and; substituents so combined via a carbonyl group, such as an acyl group, carboxy group, carbamoyl group, alkoxycarbonyl group or aryloxycarbonyl group. Additionally, as the substituents so combined via a hetero atom, the following are available: ones so combined via an oxygen atom, such as a hydroxy group, alkoxy group, aryloxy group, heterocyclicoxy group, siloxy group, acyloxy group, carbamoyloxy group, and; ones so combined via a nitrogen atom, such as a nitro group, amino groups including dialkylamino and others, a sulfamoylamino group, alkoxycarbonylamino group, aryloxycarbonylamino group, acylamino group, sulfonamide group, imide group or ureide group, and; ones so combined via a sulfur atom, such as an alkylthio group, arylthio group, heterocyclicthio group, sulfonyl group, sulfinyl group, sulfamoyl group, and; ones so combined via a phosphor atom, such as a phosphonyl group and others.

More specifically, there are the examples such as the following: a methyl group, ethyl group, isopropyl group, t-butyl group, pentadecyl group, heptadecyl group, 1-hexylnonyl group, 1,1'-dipentylnonyl group, 2-chlor-t-butyl group, trifluoromethyl group, 1-ethoxytridecyl group, 1-methoxyisopropyl group, methanesulfonylethyl group, 2,4-di-t-amylphenoxymethyl group, anilino group, 1-phenylisopropyl group, 3-m-butanesulfonaminophenoxypropyl group, 3-4'-{α-[4''(p-hydroxybenzenesulfonyl)phenoxy]dodecaneuroamino}phenylpropyl group, 3-{4'-[α-(2'',4''-di-t-amylphenoxy)butaneamide]phenyl}propyl group, 4-[α-(o-chlorphenoxy)tetradecanaminophenoxy]propyl group, allyl group, cyclopentyl group and cyclohexyl group.

As the aryl group expressed by R, a phenyl group is preferable and may have a substituent, such as an alkyl group, alkoxy group, acylamino group and others.

More specifically, as the aryl group, a phenyl group, 4-t-butylphenol group, 2,4-di-t-amylphenyl group, 4-tetradecanamidophenyl group, hexadecyroxyphenyl group, 4'-[α-(4''-t-butylphenoxy)tetradecanamide]phenyl group and others should be noted.

As the heterocyclic group expressed by R, a 5~7-membered group is preferable, and, it may have a substituent or it may have been condensed. More specifically, a 2-furyl group, 2-thienyl group, 2-pyrimidinyl group, 2-benzothiazolyl group and others should be noted. As the acyl group expressed by R, the examples including the following are available: an alkylcarbonyl group such as an acetyl group, phenylacetyl group, dodecanoil group, α-2,4-di-t-amylphenoxybutanoil group and others, and; an arylcarbonyl group such as a benzoyl group, 3-pentadecyloxybenzoyl group, p-chlorobenzoyl and others.

As the sulfonyl group expressed by R, the examples inlcuding the following are available: an alkyl sulfonyl group such as a methylsulfonyl group and dodecylsulfonyl group; an arylsulfonyl group such as a benzenesulfonyl group and p-toluenesulfonyl group.

As the sulfonyl group expressed by R, the examples including the following are available: an alkylsulfonyl group such as an ethylsulfinyl group, octylsulfinyl group and 3-phenoxybutylsulfinyl group; an arylsulfinyl group such as a phenylsulfinyl group and m-pentadecylphenylsulfinyl group.

As the phosphonyl group expressed by R, the examples including the following are available: an alkylphosphonyl group such as a butyloctylphosphonyl group; an alkoxyphosphonyl group such as an octyloxyphosphonyl group; an aryloxyphosphonyl group such as a phenoxyphosphonyl group; an arylphosphonyl group such as a phenylphosphonyl group.

The carbamoyl group expressed by R may possess a substituent such as an alkyl group, aryl group (preferably, a phenyl group) and others. As the carbamoyl group, the examples including the following are available: an N-methylcarbamoyl group, N,N-dibutylcarbaboyl group, N-(2-pentadecyloctylethyl) carbamoyl group, N-ethyl-N-dodecylcarbamoyl group, N-[3-(2,4-di-t-amylphenoxy)propyl]carbamoy l group.

The sulfamoyl group expressed by R may possess a substituent such as an alkyl group, aryl group (preferably, a phenyl group). As the sulfamoyl group, the examples including the following are available: an N-propylsulfamoyl group, N,N-diethylsulfamoyl group, N-(2-pentadecyloxyethyl)sulfamoyl group, N-ethyl-N-dodecylsulfamoyl group and N-phenylsulfamoyl group.

As the examples for the spiro compound residue expressed by R, a spiro [3,3]heptane-1-yl and others are available.

As the bridged hydrocarbon compound residue expressed by R, the examples including the following are available: a bicyclo[2.2.1]heptane-1-yl, tricyclo[3.3.1.1 3'7] decane-1-yl, 7,7-dimethyl-bicyclo[2.2.1]heptane-1-yl and others.

The alkoxy group expressed by R may further possess one of the substituents exemplified for the alkyl group, mentioned before. For such an example the following are available: a methoxy group, propoxy group, 2-ethoxyethoxy group, pentadecyloxy group, 2-dodecyloxyethoxy group, phenethyloxyethoxy group and others.

As the aryloxy group expressed by R, a phenyloxy is preferred. The aryl nucleus may further possess one of the substituents or atoms exemplified for the aryl group, mentioned before. As the examples the following are included: a phenoxy group, p-t-butylphenoxy group and m-pentadecylphenoxy and others.

As the heterocyclicoxy group expressed by R, one having 5~7-membered heterocycle is preferred, and additionally, the heterocycle may have a substituent. The examples include a 3,4,5,6-tetrahydropyranyl group 1-phenyltetrazole-5-oxy group.

The siloxy group expressed by R may further posses a substituent such as an alkyl group or another group. The examples include a trimethylcyloxy group, triethylcyloxy group, dimethylcyloxy group and others.

As the acyloxy group expressed by R, the examples such as an alkylcarbonyloxy group and an arylcarbonyloxy group are available. Further, such an acyloxy group may possess a substituent. More specifically, an acetyloxy group, α-chloroacetyloxy, benzoyloxy and others should be noted as the examples for such an acyloxy group.

The carbamoyloxy group expressed by R may have a substituent such as an alkyl group or aryl group. For such a carbamoyloxyl group, an N,N-diethylcarbamoyloxy group, N-phenylcarbamoyloxy group and others are available.

The amino group expressed by R may have a substituent such as an alkyl group or aryl group (preferably, a phenyl group). For such an amino group, an ethylamino group, anilino group, m-chloranilino group, 3-pentadecyloxycarbonylanilino group, 2-chloro-5-hexadecanamidanilino and other groups are available.

As an acylamino group expressed by R, an alkylacarbonylamino group, arylcarbonylamino group (preferably, a phenylcarbonylamino group) and others are available. Further, such an acylamino group may possess a substituent, and, more specifically, the examples such as an acetamide group, α-ethylpropanamide group, N-phenylacetamide group, dodecanamide group, 2,4-di-t-amylphenoxyacetamide group, α-3-t-butyl-4-hydroxyphenoxybutanamide group and others are available.

As a sulfonamide group expressed by R, an alkylsulfonylamino group, arylsulfonylamino group and others are available. Further, such sulfonamide groups may possess a substituent, and, more specifically, the examples including a methylsulfonylamino group, pentadecylsulfonylamino group, benzenesulfonamide group, p-toluenesulfonamide group, p-toluenesulfonamide group, 2-methoxy-5-t-amylbenzenesulfonamide group and others are available.

An imide group expressed by R may be whichever an open-chained group or a cyclic group, and, may possess a substituent. For such an imide group, the examples including an imide succinate group, 3-heptadecylimide succinate group, phthalimide group, glutarimide group and others are available.

An ureide group expressed by R may have such a substituent as an alkyl group or aryl group (preferably, a phenyl group). The examples of such an ureide group include an N-ethylureide group, N-methyl-N-decylureide group, N-phenylureide group, N-p-tolylureide and other groups.

An sulfamoylamino group expressed by R may have such a substituent as an alkyl group or aryl group (preferably, a phenyl group). The examples of such a sulfamoylamino group include an N,N-dibutylsulfamoylamino group, N-methylsulfamoylamino group, N-phenylsulfamoylamino group and others.

An alkoxycarbonylamino group expressed by R may possess a substituent. As the examples of such a group, a methoxycarbonylamino group, methoxyethoxycarbonylamino group, octadecyloxycarbonylamino group and others are available.

An aryloxycarbonylamino group expressed by R may possess a substituent. As the examples of such a group, a phenoxycarbonylamino group, 4-methylphenoxycarbonylamino group and others are available.

An alkoxycarbonyl group expressed by R may possess a substituent. As the examples of such a group, a methoxycarbonyl group, butyloxycarbonyl group, dodecyloxycarbonyl group, octadecyloxycarbonyl group, ethoxymethoxycarbonyl group, benzyloxycarbonyl group and others are available.

An aryloxycarbonyl group expressed by R may possess a substituent. As the examples of such a group, a phenoxycarbonyl group, p-chlorophenoxycarbonyl group, m-pentadecyloxycarbonyl group and others are available.

An alkylthio group expressed by R may possess a substituent. As the examples of such a group, an ethylthio group, dodecylthio group, octadecylthio group, phenethylthio group and 3-phenoxypropylthio group are available.

As an arylthio group expressed by R, a phenylthio group is preferred. Additionally, the arylthio group may possess a substituent. For such a group, the following examples are available: a phenylthio group, p-methoxyphenylthio group, 2-t-octylphenylthio group, 3-octadecylphenylthio group, 2-carboxyphenylthio group, p-acetaminophenylthio group and others.

As a heterocyclic thio group, a 5~7 membered group is preferred. At the same time, such a group may possess a condensed ring and/or a substituent. For such a group, the following examples are available: a 2-pyridylthio group, 2-benzothiazorylthio group and 2,4-diphenoxy-1,3,5-1,3,5-triazole-6-thio group.

As a substituent, expressed by X, which may split off due to a reaction with an oxidant derived from a color developing agent, the similar substituents which are so coupled through one of halogen atoms (a chlorine atom, bromine atom, fluorine atom and others) or a carbon atom, oxygen atom, sulfur atom or nitrogen atom contained thereof are available.

Other than a carboxy group, for the substituents so combined through a carbon atom, a group expressed by the following general formula as well as a hydroxymethyl group and a triphenylmethyl group are available. ($R_1'$ has the same meaning as R, mentioned previously, Z' has the same meaning as Z, mentioned previously. $R_2'$ and $R_3'$ respectively represent any one of a hydrogen atom, aryl group, alkyl group and heterocyclic group.)

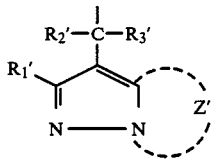

The substituents so combined through an oxygen atom thereof include an alkoxy group, aryloxy group, heterocyclic oxy group, acyloxy group, sulfonyloxy group, alkoxycarbonyloxy group, aryloxycarbonyloxy group, alkyloxalyloxy group and alkoxyoxalyloxy group.

The alkoxy groups may further possess a substituent, and, the examples for such a substituent include an ethoxy, 2-phenoxyethoxy group, 2-cyanoethoxy group, phenethyloxy group, p-chlorobenzyloxy group and others.

As the aryloxy group, phenoxy groups are preferable, and, the aryl group may further possess a substituent. More specifically, the examples for the substituent include a phenoxy group, 3-methylphenoxy group, dodecylphenoxy group, 4-methanesulfonamidephenoxy group, 4-[α-(3'-pentadecylphenoxy)butanamide]-phenoxy group, hexadecylcarbamoylmethoxy group, 4-cyanophenoxy group, 4-methanesulfonylphenoxy group, 1-naphthyloxy group, p-methoxyphenoxy group and others.

As the heterocyclic oxy group, a 5~7-membered heterocyclic oxy group is preferred, and, the group may be of a condensed ring or may have a substituent. More specifically, the heterocyclic oxy groups include a 1-phenyltetrazolyloxy group, 2-benzothiazolyloxy group and others.

As the acyloxy groups, the following examples are available: alkylcarbonyloxy groups including an acetoxy group and butanoyloxy group; alkenylcarbonyloxy groups including a cynnamoyloxy group; arylcarbonyloxy groups including a benzoyloxy group.

As the sulfonyloxy groups, a butanesulfonyloxy group and methanesulfonyloxy groups, for example, are available.

As the alkoxycarbonyloxy groups, an ethoxycarbonyloxy group and benzyloxycarbonyloxy group, for example, are available.

As the aryloxycarbonyl groups, a phenoxycarbonyloxy group and others are available.

As the alkyloxalyloxy groups, a methyloxalyloxy group, for example, is available.

As the alkoxyoxalyloxy groups, an ethoxyoxalyloxy group and others are available.

The substituents so coupled through a sulfur atom thereof include, for example, an alkylthio group, arylthio group, heterocyclic thio group alkyloxythiocarbonylthio group.

The alkylthio groups include a buthylthio group, 2-eyanoethylthio group, phenethylthio group, benzylthio group and others.

The arylthio groups include a phenylthio group, 4-methanesulfonamidophenylthio group, 4-dedecylphenethylthio group, 4-nonafluoropentanamidophenethyl group, 4-carboxyphenylthio group, 2-ethoxy-5-t-buthylphenylthio group and others.

The heterocyclic thio groups include, for example, 1-phenyl-1,2,3,4-tetrazolyl-5-thio group, 2-benzothiazolyl group and others.

The alkyloxythiocarbonylthio groups include a dodecyloxythiocarbonylthio group and others.

The substituents, mentioned above, which are so coupled through a nitrogen atom include, for example, ones expressed by a general formula

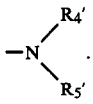

In this case, $R_4'$ and $R_5'$ respectively represent any one of a hydrogen atom, alkyl aryl group, heterocyclic group, sulfamoyl group, carbamoyl group, acyl group, sulfonyl group aryloxycarbonyl group and alkoxycarbonyl group. $R_4'$ and $R_5'$ may combine with each other to form a heterocycle. However, $R_4'$ and $R_5'$ are not simultaneously hydrogen atoms.

The alkyl group may be whichever straight-chained or branched, and, preferably, should have 1~22 carbon atoms. Additionally, such an alkyl group may contain a substituent. As the substituent the following are available: an aryl group, alkoxy group, aryloxy group, alkylthio group, arylthio group, alkylamino group, arylamino group, acylamino group, sulfonamide group, imino group, acyl group, alkylsulfonyl group, arylsulfonyl group, carbamoyl group, sulfamoyl group, alkoxycarbonyl group, aryloxycarbonyl group, alkyloxycarbonylamino group, aryloxycarbonylamino group, hydroxyl group, carboxyl group, cyano group and halogen atom. As the specified examples for the alky group, an ethyl group, octyl group, 2-ethylhexyl group and 2-chlorethyl group are available.

The aryl group expressed by $R_4'$ or $R_5'$, one having 6~32 carbon atoms, in particular, a phenyl group or naphthyl group is preferred. The aryl group may have a substituent. For such a substituent, those substituents expressed by $R_4'$ or $R_5'$, and described, above, as contained in the alkyl group as well as the alkyl group itself are available. More specifically, the aryl groups include, for example, a phenyl group, 1-naphthyl group and 4-methylsulfonylphenyl group.

As the heterocycle group expressed by $R_4'$ or $R_5'$, a 5~6-membered group is preferred, and, the group may be of a condensed ring or may have a substituent. More specifically, the heterocycle groups include a 2-furyl group, 2-pyrimidyl group, 2-benzothiazolyl group, 2-pyridyl group and others.

As the sulfamoyl group expressed by $R_4'$ or $R_5'$, an N-alkylsulfamoyl group, N,N-dialkylsulfamoy group, N-arylsulfamoyl group, N,N-diarylsulfamoyl group and others are available. The alkyl group or aryl group contained in the sulfamoyl group may have the substituent contained within the alkyl group or aryl group mentioned before. As the specific examples for the sulfamoyl group, an N,N-diethylsulfamoyl group, N-methylsulfamoyl group, N-dodecylsulfamoyl group and N-p-tolysulfamoyl group, for example, are available.

As the carbamoyl group expressed by $R_4'$ or $R_5'$, an N-alkylcarbamoyl group, N,N-dialkylcarbamoyl group, N-arylcarbamoyl group, N,N-diarylcarbamoyl group and others are available. The alkyl group or aryl group contained in the cabamoyl group may have the substituent contained within the alkyl group or aryl group mentioned previously. As the specific examples for the carbamoyl group, N,N-diethylcarbamoyl group, N-methylcarbamoyl group, N-dodecylcarbamoyl group, N-p-cyanophenylcarbamoyl group and N-p-tricarbamoyl group are available.

As the acyl group expressed by $R_4'$ or $R_5'$, an alkylcarbonyl group, arylcarbonyl group and heterocyclic carbonyl group, for example, are available. The alkyl group, aryl group and heterocyclic group may possess a substituent. As the specific examples of the acyl group, a hexafluorobutanoyl group, 2,3,4, 5,6-pentafluorobenzoyl group, acetyl group, benzoyl group, naphthoyl group, 2-furylcarbonyl group and others are available.

As the sulfonyl group expressed by $R_4'$ or $R_5'$, an alkylsulfonyl group, arylsulfonyl group, heterocyclic sulfonyl group are available. Such sulfonyl groups may have a substituent, and, more specifically, include an ethanesulfonyl group, benzenesulfonyl group, octanesulfonyl group, naphthalenesulfonyl group, p-chlorobenzenesulfonyl group and others.

The aryloxycarbonyl group expressed by $R_4'$ or $R_5'$ may contain a substituent contained in the previously mentioned aryl group. More specifically, for such an aryloxycarbonyl group, a phenoxycarbonyl group and others are available.

The alkoxycarbonyl group expressed by $R_4'$ or $R_5'$ may contain a substituent contained in the previously mentioned alkyl group. More specifically, for such an alkoxycarbonyl group, a methoxycarbonyl group, dodecyloxycarbonyl group, benzyloxycarbonyl group and others are available.

The heterocycle formed by mutual bonding of $R_4'$ and $R_5'$, a 5~6-membered one is preferred, and, may be saturated or unsaturated, and, may be whichever aromatic or unaromatic, and may be of a condensed ring. The examples of the heterocycle, mentioned above, include an N-phthalimide group, N-succinimide group, 4-N-urazolyl group, 1-N-hydantoinyl group, 3-N-2,4-dioxooxazolidinyl group, 2-N-1,1-dioxo-3-(2H)-oxo-1,2-benzothiazolyl group, 1-pyrrolyl group, 1-pyrrolidinyl group, 1-pyrazolinyl group, 1-pyrazolisinyl group, 1-piperidinyl group, 1-pyrrolinyl group, 1-imidazolyl group, 1-imidazolynyl group, 1-indolyl group, 1-isoindolynyl group, 2-isoindolyl group, 2-isoindolynyl group, 1-benzotriazolyl group, 1-benzoimidazolyl group, 1-(1,2,4-triazolyl) group, 1-(1,2,3-triazolyl) group, 1-(1,2,3,4-tetrazolyl) group, N-morpholinyl group, 1,2,3,4-tetrahydroquinolyl group, 2-oxo-1-pyrrolidinyl group, 2-1H-pyridone group, phthaladinone group, 2-oxo-1-pyperidinyl group and others. These heterocyclic groups may have any one of the substituents such as an alkyl group, aryl group, alkyloxy group, aryloxy group, acyl group, sulfonyl group, alkylamino group, arylamino group, acylamino group, sulfonamino group, carbamoyl group, sulfamoyl group, alkylthio group, arylthio group, ureide group, alkoxycarbonyl group, arylkoxycarbonyl group, imide group, nitro group, cyano group, carboxyl group, halogen atom and others.

As the heterocycle containing nitrogen atoms and formed from Z or Z', a pyrazole ring, imidazole ring, triazole ring, tetrazole ring and others are available. As the substituent each of the heterocycle may have any one of the substituents described for R, mentioned previously.

Additionally, if the substituent (for example R, $R_1$~$R_8$) in the heterocycle expressed by general formula [I] or one of general formulas [II]~[III], which are described later, has the portion, below, the so-called bis-type coupler is formed;

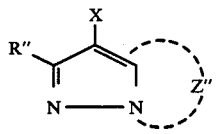

(R", X and Z" are, respectively, the same as R, X and Z in general formula [I].) Naturally, such a type of a coupler is included within the scope of the invention. Additionally, the ring formed from Z, Z', Z" or Z:, which is mentioned later, may further contain another condensed ring (for example, a 5~7-membered cycloalkene ring). For example, $R_5$ and $R_6$ in general formula [V], or, $R_7$ and $R_8$ in general formula [VI] may mutually combine to form a ring (for example, a 5~7-membered cycloalkene or benzene ring).

The groups which are expressed by general formula [I] are more specifically expressed by the general formulas, such as, [II]~[III], below.

General formula [II]

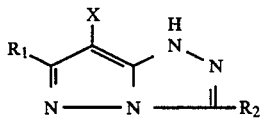

General formula [III]

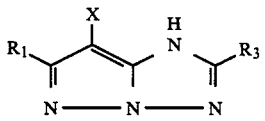

General formula [IV]

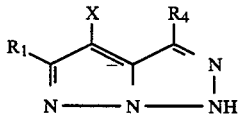

General formula [V]

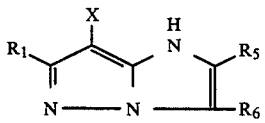

General formula [VI]

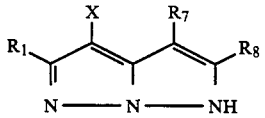

General formula [VII]

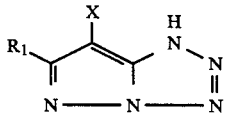

In the above-mentioned general formulas [II]~[VII], $R_1$~$R_8$ and X respectively have the same meanings as Rs and X, mentioned previously.

Additionally, among those expressed by general formula [I], the preferable ones are expressed by general formula [VIII], below.

General formula [VIII]

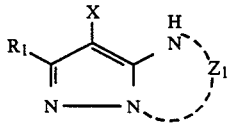

$R_1$, X and $Z_1$ are the same as the R, X and Z in the general formula [I].

Among the magenta couplers expressed by the abovementioned general formulas [II]~[VII], the similar coupler expressed by general formula [II] is especially preferred.

Additionally, in regard to a substituent contained within a heterocycle in general formulas [I]~[VIII], R in general formula [I] is preferred. In general formulas [II]~[VIII], $R_1$ is preferred if it satisfies the following criterion 1, and is more preferred if it satisfies the criteria 1 and 2, and, is much more preferred if it simultaneously satisfies the criteria 1, 2 and 3.

Criterion 1: A root atom directly coupled to a heterocycle is a carbon atom.

Criterion 2: Only one hydrogen atom, if any, is coupled to the carbon atom, mentioned above.

Criterion 3: The coupling between the carbon atom, mentioned above, and adjacent atoms are exclusively of single coupling.

As a substituent R or R' within the above-mentioned heterocycle, the similar substituent expressed by the general formula [IX], below, is most highly favored.

General formula [IX]

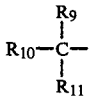

In the formula, $R_9$, $R_{10}$ and $R_{11}$ respectively represent any of the following: a hydrogen atom, halogen atom, alkyl group, cycloalkyl group, alkenyl group, cycloalkenyl group, alkinyl group, aryl group, heterocyclic group, acyl group, sulfonyl group, sulfinyl group, phosphonyl group, carbamoyl group, sulfamoyl group, cyano group, residue of spiro compound, residue of bridged hydrocarbon compound, alcoxy group, aryloxy group, heterocyclic oxy group, siloxy group, acyloxy group, carbamoyloxy group, amino group, acylamino group, sulfonamide group, imide group, ureide group, sulfamoylamino group, alkoxycarbonylamino group, aryloxycarbonylamino group, alkoxycabbonyl group, aryloxycarbonyl group, alkylthio group, arylthio group, heterocyclic thio group. However, only one of $R_9$, $R_{10}$ and $R_{11}$ is, at maximum, a hydrogen atom.

Additionally, two of $R_9$, $R_{10}$ and $R_{11}$, mentioned above, $R_9$ and $R_{10}$, for example may mutually combine to form a ring, whichever saturated or unsaturated (for example, a cycloalkane, cycloalkene and heterocycle), wherein $R_{11}$ may combine with the ring, above, to form a residue of a bridged-hydrocarbon compound.

Any of the groups expressed by $R_9$~$R_{11}$ may have a substituent. As the examples of groups expressed by $R_9$~$R_{11}$ as well as the examples of a substituent which the above-mentioned groups may contain, the groups, expressed by R in general formula [I], mentioned before, and the substituents thereof are available.

Additionally, as the rings formed by bonding of $R_9$ and $R_{10}$, for example, and, as the examples of residues of bridged hydrocarbon compounds formed from two of $R_9$~$R_{10}$, and, as the substituents which such residues may contain, the examples of a cycloaklyl, cycloalkenyl, and heterocyclic bridged-hydrocarbon compound residue expressed by R in general formula [I], mentioned previously, and, the substituents which the examples may contain, are available.

The following cases are preferable among those expressed by general formula [IX].

(i) Two of $R_9 \sim R_{11}$ are alkyl groups.

(ii) One of $R_9 \sim R_{11}$, $R_{11}$, for example, is a hydrogen atom, and, other two, that is, $R_9$ and $R_{10}$ mutually combine to form a cycloalkyl group in combination with a root hydrogen atom.

More specifically, in (i), the example, where two of $R_9 \sim R_{11}$ are alkyl groups, and, the remaining one is a hydrogen atom or an alkyl group, is preferable.

In this case, the alkyl groups and the cycloalkyl group may further possess a substituent. As the examples for the alkyl groups, cycloaklyl group and the substituent, the examples for the alkyl groups and cycloalkyl groups expressed by R in the previously mentioned general formula [I] and for the substituents possessed by the groups are available expressed.

Additionally, as the examples for the substituents whose ring is formed from Z in general formula [I] or $Z_1$ in general formula [VIII], and, as $R_2 \sim R_8$ in general formulas [II]~[VI], those expressed by the general formula [X], below, are preferable.

$$-R^1-SO_2-R^2$$ General formula [X]

In the formula, above, $R^1$ represents an alkylene, $R^2$ denotes an alkyl, cycloalkyl or aryl.

The alkylene expressed by R' should have more than two, and, more preferably, three to six carbon atoms in the straight chain portion. The alkylene may be whichever straight-chained or branched, and, further, may possess a substituent.

As the examples for the above-mentioned substituent, the substituents which was so described that the alkyl group represented by R in the previously mentioned general formula [I] may possess, are available.

As the preferable substituent, a phenyl should be noted.

The following are the preferable examples for the alkylene expressed by $R^1$.

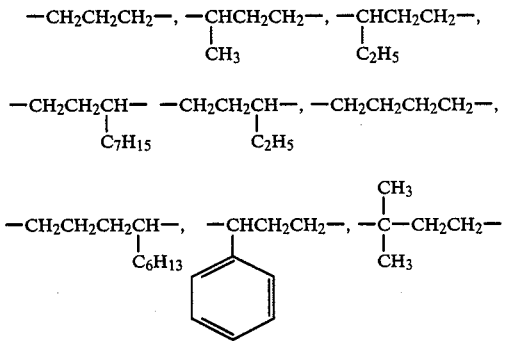

The alkyl group expressed by $R^2$ may be whichever straight-chained or branched.

More specifically, the examples for such an alkyl group include a methyl, ethyl, propyl, isopropyl, butyl, 2-ethylhexyl, octyl, dodecyl, tetradecyl, hexadecyl, octadecyl, 2-hexyldecyl and others are available.

As the cycloalkyl group expressed by $R^2$, 5~6-membered groups are preferable, and, a cyclohexyl, for example, is available.

The alkyl or cycloalkyl expressed by $R^2$ may have a substituent.

As the examples for such a substituent, those described for the substituents which the previously-mentioned $R^1$ may have are available.

As the aryl expressed by $R^2$, the examples include a phenyl and naphthyl. The aryl group may have a substituent. As examples of such a substituent, a straight-chained or branched alkyl group as well as those described as substituents the previously mentioned $R^1$ may possess.

If the aryl group have more that two substituents, these substituents may be whichever identical or different.

The compounds expressed by general formula [I] and most highly favored are those expressed by general formula [XI], below.

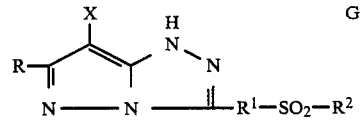

General formula [XI]

In the formula, R and X have the same meaning as R and X in general formula [I], and, $R^1$ and $R^2$ are identical to $R^1$ and $R^2$ in general formula [X].

The following illustrate the examples of the compounds employed in the present invention.

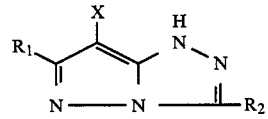

| Compound | X | $R_1$ | $R_2$ |
|---|---|---|---|
| 1 | 2 | 11 | 52 |
| 2 | 2 | 11 | 71 |
| 3 | 3 | 11 | 37 |
| 4 | 2 | 11 | 66 |
| 5 | 2 | 11 | 62 |
| 6 | 184 | 11 | 46 |
| 7 | 2 | 11 | 108 |
| 8 | 2 | 11 | 124 |
| 9 | 2 | 11 | 121 |
| 10 | 2 | 11 | 115 |
| 11 | 184 | 11 | 62 |
| 12 | 2 | 11 | 136 |
| 13 | 2 | 11 | 142 |
| 14 | H | 11 | 88 |
| 15 | 2 | 11 | 102 |
| 16 | 2 | 13 | 52 |
| 17 | 217 | 14 | 52 |
| 18 | 2 | 11 | 79 |
| 19 | 2 | 22 | 80 |
| 20 | 2 | 22 | 20 |
| 21 | 234 | 11 | 166 |
| 22 | 2 | 15 | 71 |
| 23 | 2 | 15 | 52 |
| 24 | 2 | 15 | 51 |
| 25 | 2 | 15 | 38 |
| 26 | 2 | 15 | 36 |
| 27 | 2 | 15 | 59 |
| 28 | 2 | 15 | 62 |
| 29 | 2 | 15 | 47 |
| 30 | 184 | 15 | 31 |
| 31 | 3 | 15 | 68 |
| 32 | 2 | 15 | 79 |
| 33 | 2 | 15 | 77 |
| 34 | 217 | 15 | 78 |
| 35 | 2 | 15 | 49 |
| 36 | 199 | 15 | 42 |
| 37 | 236 | 15 | 165 |
| 38 | 2 | 15 | 88 |
| 39 | 183 | 15 | 89 |
| 40 | 2 | 15 | 22 |
| 41 | 2 | 15 | 108 |

-continued
| | | | |
|---|---|---|---|
| 42 | 2 | 15 | 102 |
| 43 | 2 | 15 | 194 |
| 44 | 2 | 15 | 128 |
| 45 | 2 | 15 | 136 |
| 46 | 2 | 15 | 134 |
| 47 | 2 | 15 | 132 |
| 48 | 2 | 15 | 135 |
| 49 | 2 | 15 | 127 |
| 50 | 2 | 15 | 133 |
| 51 | 2 | 15 | 138 |
| 52 | 2 | 15 | 131 |
| 53 | 2 | 15 | 130 |
| 54 | 2 | 15 | 139 |
| 55 | 2 | 15 | 137 |
| 56 | 2 | 15 | 129 |
| 57 | 2 | 15 | 140 |
| 58 | 2 | 15 | 142 |
| 59 | 2 | 15 | 121 |
| 60 | 2 | 15 | 120 |
| 61 | 2 | 15 | 118 |
| 62 | 2 | 15 | 115 |
| 63 | 2 | 15 | 105 |
| 64 | 2 | 15 | 126 |
| 65 | 184 | 15 | 113 |
| 66 | 2 | 15 | 123 |
| 67 | 221 | 15 | 107 |
| 68 | 2 | 15 | 112 |
| 69 | 2 | 15 | 117 |
| 70 | 182 | 15 | 119 |
| 71 | 3 | 15 | 109 |
| 72 | 2 | 15 | 114 |
| 73 | 204 | 15 | 121 |
| 74 | 2 | 15 | 111 |
| 75 | 2 | 15 | 104 |
| 76 | 2 | 15 | 189 |
| 77 | 3 | 15 | 181 |
| 78 | 2 | 15 | 233 |
| 79 | 2 | 15 | 238 |
| 80 | 211 | 15 | 52 |
| 81 | 213 | 15 | 52 |
| 82 | H | 15 | 52 |
| 83 | 2 | 18 | 52 |
| 84 | 2 | 21 | 52 |
| 85 | 2 | 21 | 44 |
| 86 | 2 | 21 | 116 |
| 87 | 2 | 24 | 110 |
| 88 | 2 | 24 | 55 |
| 89 | 2 | 24 | 32 |
| 90 | 2 | 153 | 71 |
| 91 | 2 | 153 | 75 |
| 92 | 222 | 153 | 52 |
| 93 | 2 | 151 | 89 |
| 94 | 2 | 153 | 141 |
| 95 | 234 | 153 | 106 |
| 96 | 2 | 153 | 125 |
| 97 | 2 | 152 | 89 |
| 98 | 2 | 151 | 121 |
| 99 | 2 | 16 | 71 |
| 100 | 2 | 16 | 52 |
| 101 | 2 | 16 | 56 |
| 102 | 2 | 16 | 54 |
| 103 | 2 | 16 | 35 |
| 104 | 2 | 16 | 69 |
| 105 | 2 | 16 | 66 |
| 106 | 3 | 16 | 48 |
| 107 | 2 | 16 | 39 |
| 108 | 183 | 16 | 29 |
| 109 | 184 | 16 | 59 |
| 110 | 2 | 16 | 61 |
| 111 | 227 | 16 | 85 |
| 112 | 2 | 16 | 88 |
| 113 | 200 | 16 | 45 |
| 114 | 2 | 16 | 101 |
| 115 | 182 | 16 | 108 |
| 116 | 2 | 16 | 27 |
| 117 | 2 | 16 | 79 |
| 118 | 214 | 16 | 74 |
| 119 | 2 | 16 | 41 |
| 120 | 2 | 16 | 72 |
| 121 | 2 | 16 | 73 |
| 122 | 2 | 16 | 128 |
| 123 | 3 | 16 | 136 |
-continued
| | | | |
|---|---|---|---|
| 124 | 2 | 16 | 135 |
| 125 | 214 | 16 | 136 |
| 126 | 203 | 16 | 136 |
| 127 | 2 | 16 | 136 |
| 128 | 2 | 16 | 143 |
| 129 | 2 | 16 | 144 |
| 130 | 2 | 16 | 121 |
| 131 | 2 | 16 | 115 |
| 132 | 2 | 16 | 123 |
| 133 | H | 16 | 122 |
| 134 | 236 | 16 | 231 |
| 135 | 2 | 26 | 52 |
| 136 | 2 | 16 | 24 |
| 137 | 199 | 19 | 52 |
| 138 | 2 | 28 | 52 |
| 139 | 2 | 25 | 36 |
| 140 | 2 | 155 | 51 |
| 141 | 2 | 154 | 52 |
| 142 | 2 | 16 | 164 |
| 143 | 197 | 16 | 44 |
| 144 | 2 | 161 | 55 |
| 145 | 2 | 168 | 11 |
| 146 | 2 | 171 | 128 |
| 147 | 2 | 171 | 45 |
| 148 | 197 | 232 | 40 |
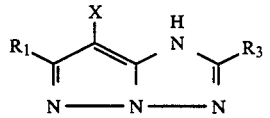
| Compound | X | $R_1$ | $R_3$ |
|---|---|---|---|
| 149 | 2 | 16 | 42 |
| 150 | 2 | 15 | 66 |
| 151 | 2 | 16 | 193 |
| 152 | 2 | 62 | 11 |
| 153 | 2 | 76 | 11 |
| 154 | 2 | 89 | 11 |
| 155 | 198 | 27 | 11 |
| 156 | 2 | 193 | 11 |
| 157 | 2 | 11 | 34 |
| 158 | 2 | 56 | 11 |
| 159 | 192 | 56 | 11 |
| 160 | 187 | 23 | 11 |
| 161 | 2 | 11 | 58 |
| 162 | 186 | 11 | 58 |
| 163 | 2 | 67 | 11 |
| 164 | 2 | 16 | 93 |
| 165 | 1 | H | 94 |
| 166 | 2 | 196 | 33 |
| 167 | 225 | 188 | 11 |
| 168 | 2 | 11 | 81 |
| 169 | 2 | 11 | 84 |
| 170 | 2 | 11 | 82 |
| 171 | 201 | 63 | 11 |
| 172 | 235 | 11 | 89 |
| 173 | 232 | 167 | 11 |
| 174 | 191 | 70 | 11 |
| 175 | 223 | 195 | 11 |
| 176 | 220 | 11 | 11 |
| 177 | 190 | 11 | 58 |
| 178 | 2 | 16 | 90 |
| 179 | 224 | 11 | 95 |
| 180 | 2 | 11 | 65 |
| 181 | 2 | 64 | 11 |
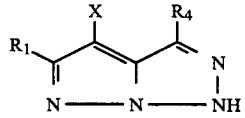
| Compound | X | $R_1$ | $R_4$ |
|---|---|---|---|
| 182 | 2 | 16 | 53 |
| 183 | 2 | 52 | 11 |
| 184 | 2 | 92 | 11 |
| 185 | 218 | 96 | 11 |
| 186 | 219 | 99 | 172 |
| 187 | 215 | 15 | 89 |
| 188 | 224 | 98 | 11 |
| 189 | 184 | 13 | 83 |
| 190 | H | 52 | 11 |

-continued
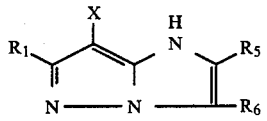
| Compound | X | $R_1$ | $R_5$ | $R_6$ |
|---|---|---|---|---|
| 191 | 2 | 16 | 11 | 52 |
| 192 | 2 | 15 | H | 52 |
| 193 | 2 | 16 | 60 | H |
| 194 | 2 | 174 | 11 | H |
| 195 | 184 | 11 | 30 | H |
| 196 | 2 | 152 | H | 57 |
| 197 | 185 | 12 | 162 | 11 |
| 198 | 3 | 11 | 11 | 89 |
| 199 | H | 226 | H | H |
| 200 | 2 | 23 | 173 | 17 |
| 201 | 2 | 23 | H | H |
| 202 | H | 23 | H | H |
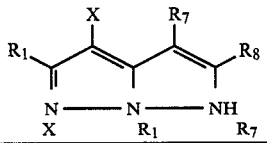
| Compound | X | $R_1$ | $R_7$ | $R_8$ |
|---|---|---|---|---|
| 203 | 2 | 11 | H | 91 |
| 204 | 2 | 11 | H | 92 |
| 205 | 219 | 172 | H | 100 |
-continued
| | | | | |
|---|---|---|---|---|
| 206 | 235 | 15 | H | 87 |
| 207 | 2 | 11 | H | 62 |
| 208 | 202 | 13 | 11 | 97 |
| 209 | H | 11 | H | 91 |
| 210 | 2 | 16 | H | 52 |
| 211 | 2 | 16 | H | 42 |
| 212 | 184 | 15 | H | 66 |
| 213 | 2 | 203 | H | 163 |
| 214 | 204 | 212 | H | 50 |
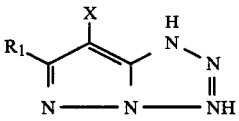
| Compound | X | $R_1$ |
|---|---|---|
| 215 | 2 | 20 |
| 216 | 184 | 88 |
| 217 | 2 | 69 |
| 218 | 222 | 216 |
| 219 | 199 | 188 |
| 220 | 2 | 98 |
| 221 | 2 | 86 |
| 222 | 235 | 43 |
| 223 | 2 | 103 |
The figures in tables correspondingly represent the following groups.
1 2 3
—F —Cl —Br
11 12 13
$-CH_3$ $-CF_2$ $-C_2H_5$
14 15 16
$-C_3H_7$ $-(i)C_3H_7$ $-(t)C_4H_9$
17 18 19
$-C_5H_{11}$ 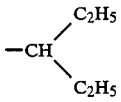 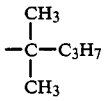
20 21 22
$-C_7H_{15}$ 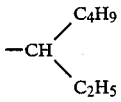 $-C_{15}H_{31}$
23 24 25
$-C_{17}H_{35}$ 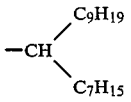 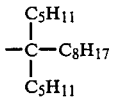
26 27 28
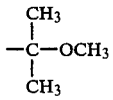 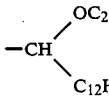 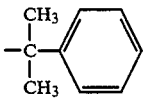
29
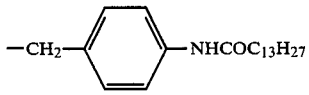

-continued
30
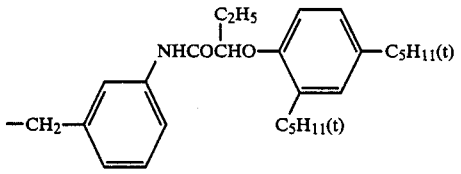
31
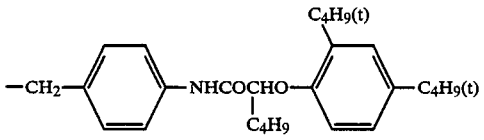
32
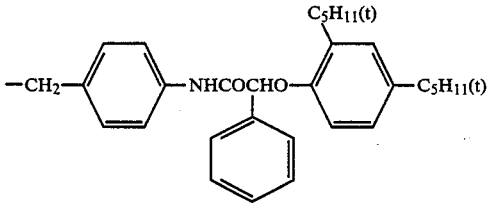
33
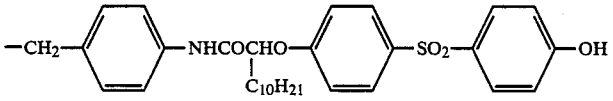
34
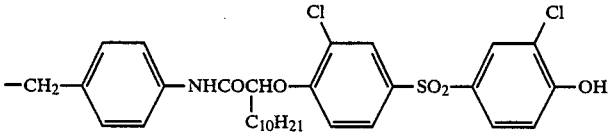
35
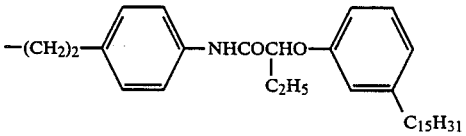
36
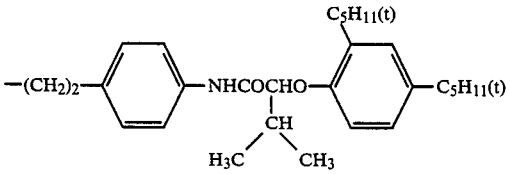
37
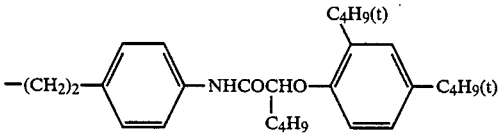
38
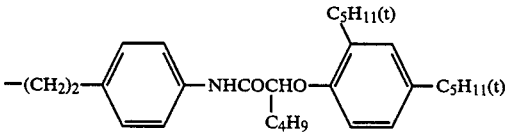
39
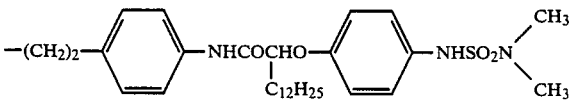

-continued
40
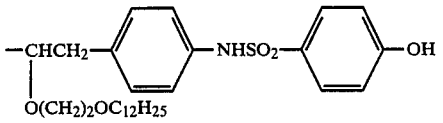
41
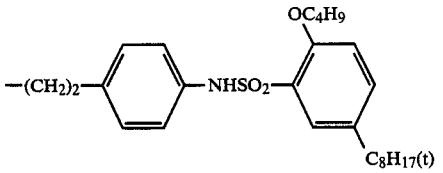
42
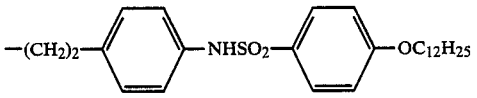
43
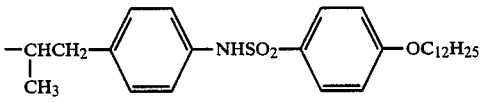
44
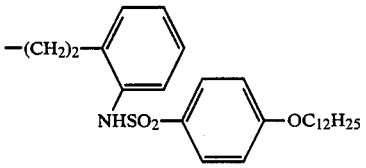
45
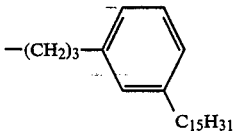
46
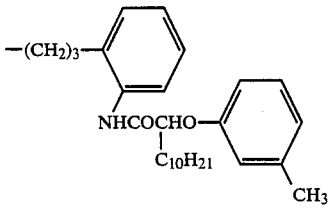
47
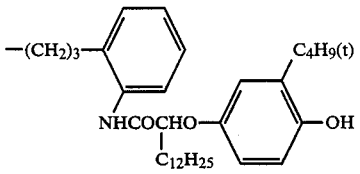
48
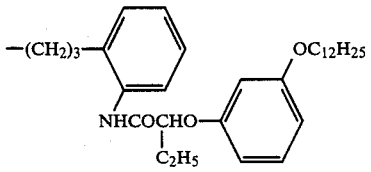

-continued

49

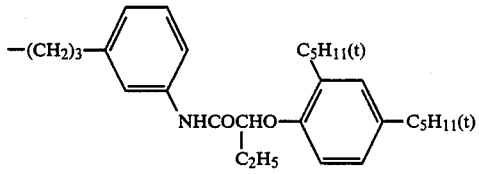

50

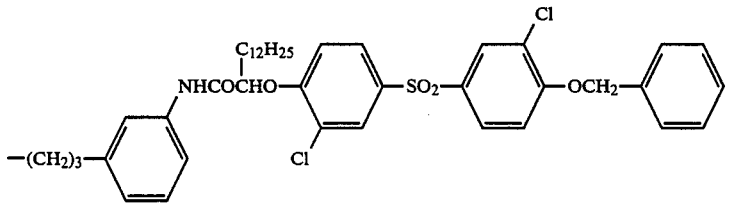

51

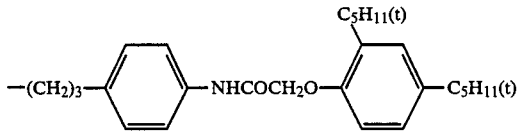

52

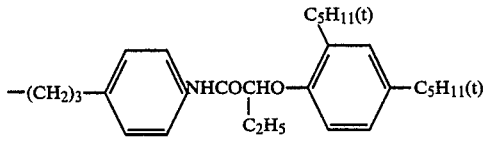

53

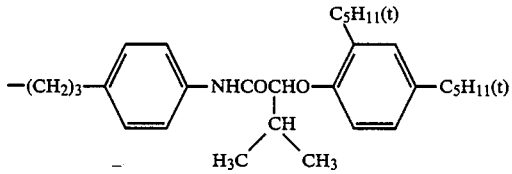

54

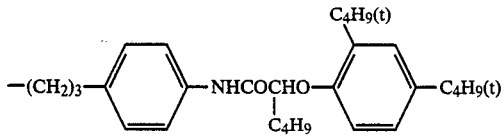

55

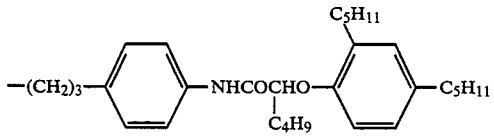

56

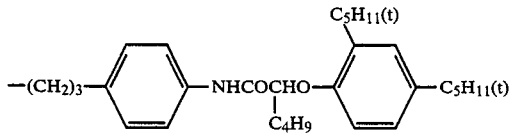

57

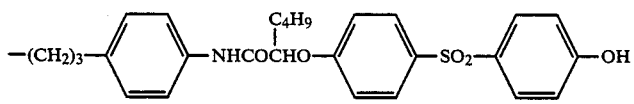

These couplers employed in the present invention can be synthesized by referring to the descriptions in, for instance, Journal of the Chemical Society, Perkin I (1977), 2047~2052, U.S. Pat. No. 3725067, Japanese Patent O.P.I. Publication Nos. 99437/1984, 42045/1983, 162548/1984, 171956/1984, 33552/1985, 43659/1985, 172982/1985 and 190779/1985.

The couplers employed in the present invention may be employed at the rate of $1\times10^{-3}\sim1$, or, preferably, $1\times10^{-2}\sim18\times10^{31}$ 1 mol per mol silver halide.

Additionally, the couplers according to the present invention may be employed in combination with other types of magenta couplers, as far as such an employment does not jeopardize the objects of the present invention.

In the present invention, a compound, employed in combination with a magenta coupler expressed by the previously mentioned general formula [I] and having a piperazine or homopiperazine ring, and, a coumarane ring expressed by the previously mentioned general formula [XIIIa] as well as a hydroxyindane compound expressed by general formula [XIIIb] are compounds independently known in the art.

For example, Japanese Patent OP.I. Publication No. 31297/1985 and Japanese Patent Examined Publication No. 85194/1985 disclosed that the compounds comprising piperazine or homopiperazine, according to the invention, expressed by the previously mentioned general formula [XII] is effective in stabilizing a magenta dye image derived from a magenta coupler employed in the invention.

Also, Japanese Patent Application No. 280486/1984 and Japanese Patent O.P.I. Publication No. 85195/1985 disclosed that coumaran or chroman compounds expressed by the previously mentioned general formula [XIIIa], according to the invention, are effective in stabilizing a magenta dye image derived from a magenta coupler employed in the invention. Additionally, Japanese Patent Applications Nos. 25793/1985 and 85193/1985 disclosed that hydroxyindane compounds expressed by the general formula [XIIIb], according to the invention, are effective in stabilizing a magenta dye image derived from a magenta coupler employed in the invention.

However, the previously mentioned specifications totally failed to state the effect, obtainable from the combined employment of at least one compound selected from the compounds expressed by the general formula [XII] of the invention and the general formula [XIIIa] of the invention, upon the stabilization of a magenta dye image derived from a magenta coupler employed in the invention.

The inventors have found, after the concentrated study, that the light fastness of a magenta dye image derived from a magenta coupler of the invention, may be remarkably improved when a magenta coupler expressed by general formula [I] of the invention, is simultaneously employed with not only a compound expressed by general formula [XII] of the invention, but at least one compound selected from compounds expressed by general formulas [XIIIa] and [XIIIb] of the invention.

The compounds expressed by general formulas [XII], [XIIIa] and [XIIIb], mentioned above, are, unless otherwise specified, referred to as magenta dye stabilizers employed in the present invention.

Every magenta dye image stabilizer employed in the invention in combination with a magenta coupler, according to the invention, features preventive effects against fading and discoloration of a magenta dye image due to light. One type of such a stabilizer is a compound, comprizing a piperazine or homopiperazine, and expressed by general formula [XII], below.

General formula [XII]

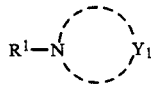

[In the formula, above, $R^1$ represents an aliphatic group, cycloalkyl group, aryl group or heterocyclic group. $Y^1$ represents a plurality of nonmetal atoms necessary for forming a piperazine or homopiperazine ring, in combination with an nitrogen atom.]

In the above-mentioned general formula [XII], $R^1$ represents an aliphatic group, cycloalkyl group, aryl group or heterocyclic group. As an aliphatic group expressed by $R^1$, saturated alkyl groups or unsaturated alkyl groups, for example, are available, and, such groups may have a substituent. The saturated alkyl groups include a methyl group, ethyl group, butyl group, octyl group, dodecyl group, tetradecyl group, hexadecyl group and others. The unsaturated alkyl groups include an ethynyl group, propenyl group and others.

As a cycloalkyl group expressed by $R^1$, 5~7-membered groups, more specifically, a cyclopenthyl group, cyclohexyl group and others are available, and, such groups include those having a substituent.

As an aryl group expressed by $R^1$, a phenyl group, naphthyl group and others are available,and, such groups include those having a substituent.

As a heterocyclic group, a 2-pyridyl group, 4-piperidyl group, 2-furyl group, 2-thienyl group, 2-pyrimidyl group and others are available, and, such groups include those having a substituent.

As a substituent which an aliphatic group, cycloalkyl group, aryl group or heterocyclic group, expressed by $R^1$, may have, an alkyl group, aryl group, alkoxy group, carbonyl group, carbamoyl group, acylamino group, sulfamoyl group, sulfonamide group, carbonyloxy group, alkylsulfonyl group, arylsufonyl group, hydroxy group, heterocyclic group, alkylthio group, arylthio group and others are available, and, such groups may further possess a substituent.

In the above-mentioned general formula [XII], $Y_1$ represents a plurality of nonmetal atoms necessary for forming a piperazine or homopiperazine ring, in combination with a nitrogen atom, and, additionally, such a piperazine or homopiperazine ring may possess a substituent. The examples for such a substituent include an alkyl group, cycloalkyl group, aryl group, heterocyclic group and others.

As piperazine compounds among the compounds employed in the invention and expressed by the above-mentioned general formula [XII], piperazine compounds expressed by general formula [XII'], below, are especially preferable.

General formula [XII']

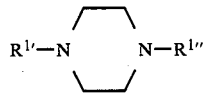

In the formula, above, $R^1$ represents an alkyl group, cycloalkyl group or aryl group. $R^{1''}$ represents a hydrogen atom, alkyl group, cycloalkyl group or aryl group.

At the same time, as homopiperazine compounds among the compounds expressed by the above-mentioned general formula [XII], homopiperazine class compounds expressed by general formula [XII''], below, are especially preferable.

General formula [XII'']

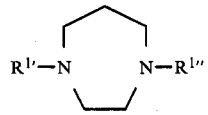

In the formula, above, $R^{1'}$ and $R^{1''}$ respectively represent the same atom or group as $R^{1'}$ and $R^{1''}$ in the abovementioned general formula [XII'].

Additionally, the total number of carbon atoms contained in $R^{1'}$ or $R^{1''}$, in general formula [XII'] or [XII''], including a substituent which $R^{1'}$ or $R^{1''}$ have, should be preferably 6~40.

The following are the typical examples for a compound expressed by the above-mentioned general formula [XII]. However, the scope of the present invention is not limited only to these examples.

P-1

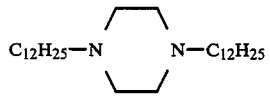

P-2

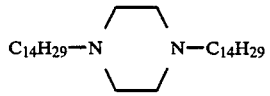

P-3

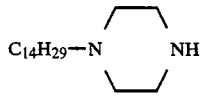

P-4

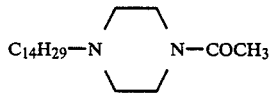

P-5

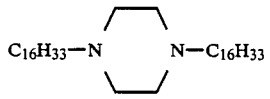

P-6

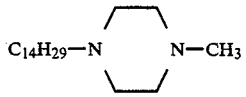

P-7

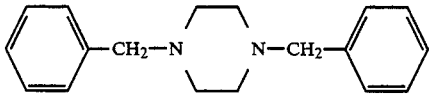

P-8

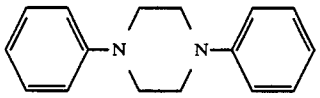

P-9

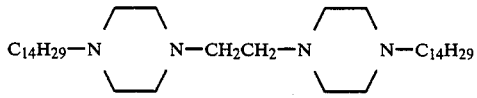

P-10

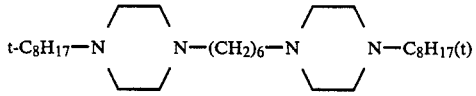

P-11

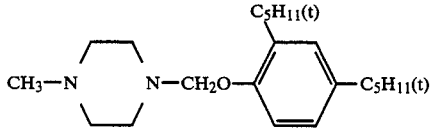

P-12

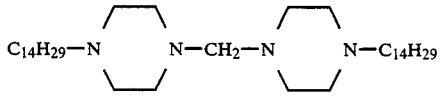

-continued
P-13
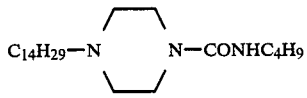
P-14
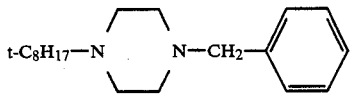
P-15
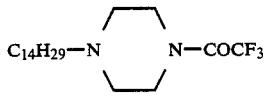
P-16
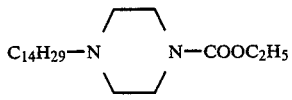
P-17
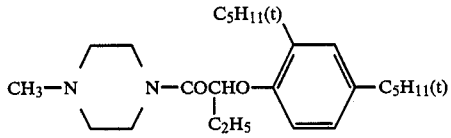
P-18
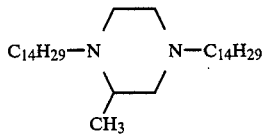
P-19
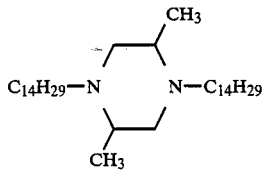
P-20
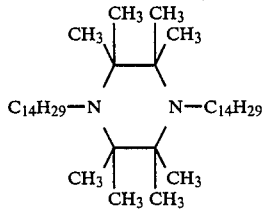
P-21
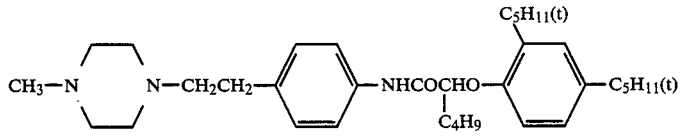
P-22
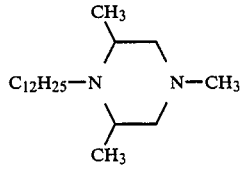

-continued
P-23
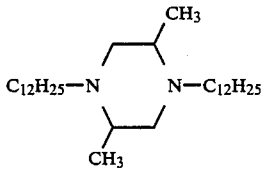
P-24
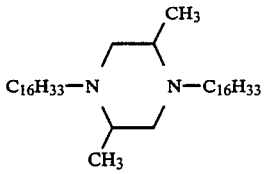
P-25
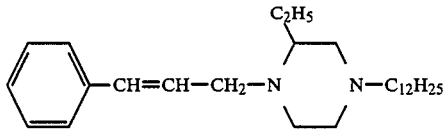
P-26
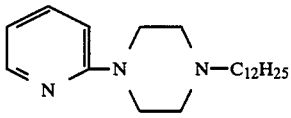
P-27
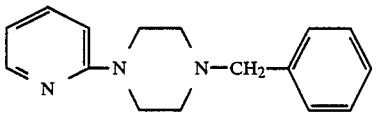
P-28
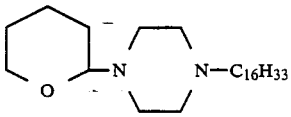
P-29
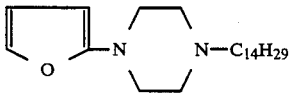
P-30
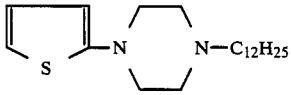
P-31
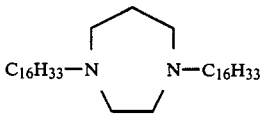
P-32
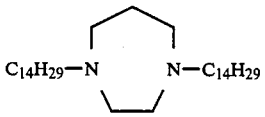
P-33
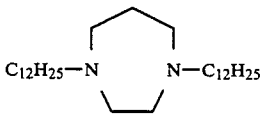

-continued
P-34
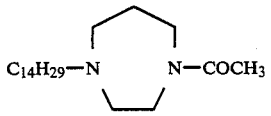
P-35
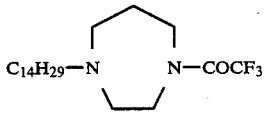
P-36
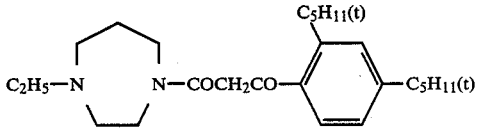
P-37
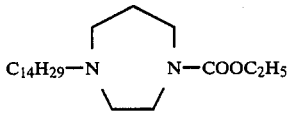
P-38
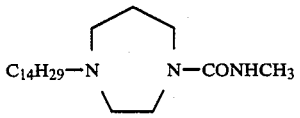
P-39
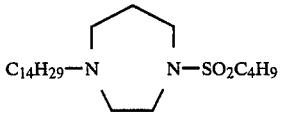
P-40
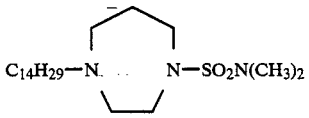
P-41
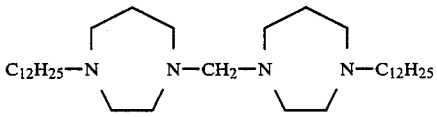
P-42
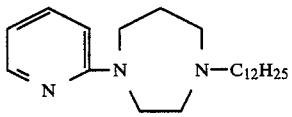
P-43
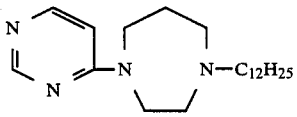
P-44
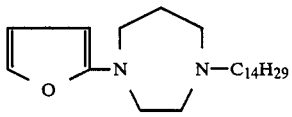
P-45
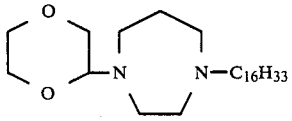

-continued

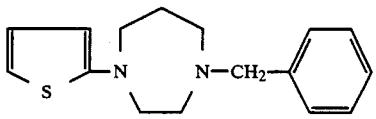

P-46

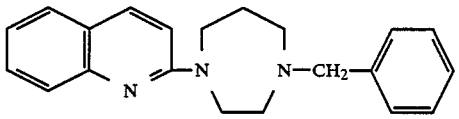

P-47

The previously mentioned magenta dye image stabilizer, expressed by the before-mentioned general formula [XII] and employed in the invention, can be synthesized by employing a synthesis method disclosed, for example, in Japanese Patent Applications No. 31297/1985 and No. 85194/1985.

Next, the compounds expressed by the previously mentioned general formula [XIIIa] are further described in detail.

Each group expressed by $R_2 \sim R_5$ in general formula [XIIIa] may possess another substituent, and, the examples of such a substituent include, for example, an alkyl group, alkenyl group, alkoxy group, aryloxy group, hydroxy group, alkoxycarbonyl group, aryloxycarbonyl group, acylamino group, carbamoyl group, sulfonamide group, sulfamoyl group and others.

A chroman or coumarane ring formed by containing $Y_2$ may possess a substituent such as a halogen atom, alkyl group, cycloalkyl group, alkoxy group, alkenyl group, alkenyloxy group or heterocyclic group, and, further, may form a spiro ring.

Among the compounds expressed by general formula [XIIIa], the compounds most useful for the invention include those expressed by general formulas [XIVa], [XVa], [XVIa], [XVIIa] and [XVIIIa].

General formula [XIVa]

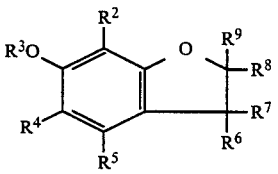

General formula [XVa]

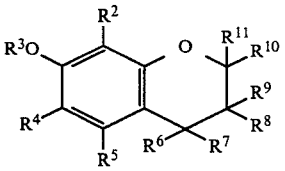

General formula [XVIa]

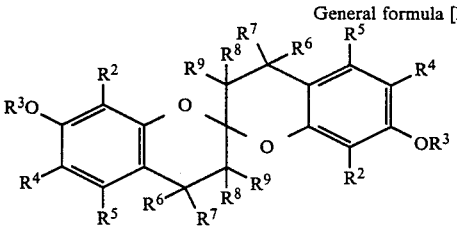

-continued

General formula [XVIIa]

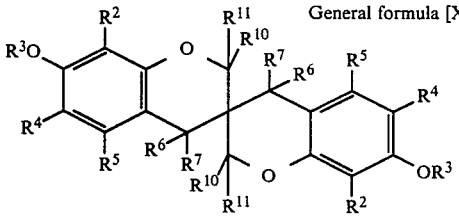

General formula [XIIIa]

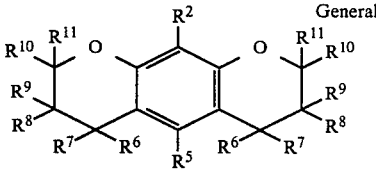

$R^2$, $R^3$, $R^4$ and $R^5$ in general formulas [XIVa], [XVa], [XvIa], [XVIIa] and [XvIIIa] respectively have the same meaning as those in the previously mentioned general formula [XIIIa]. $R^6$, $R^7$, $R^8$, $R^9$, $R^{10}$ and $R^{11}$ respectively represent any one of a hydrogen atom, halogen atom, alkyl group, cycloalkyl group, alkoxy group, hydroxy group, alkenyl group, alkenyloxy group, aryl group, aryloxy group and heterocyclic group.

Additionally, $R^6$ and $R^7$, or $R^7$ and $R^8$, or $R^8$ and $R^9$, or $R^9$ and $R^{10}$, or $R^{10}$ and $R^{11}$ may mutually cyclize to form a hydrocarbon ring, and, further, an alkyl group may, as a substituent, take a position in the carboycle.

With the previously mentioned general formulas [XIVa], [XVa], [XVIa], [XVIIa] and [XVIIIa], the compounds which have a hydrogen atom, alkyl group, alkoxy group, hydroxy group or cycloalkyl group in the positions $R^2$ and $R^5$, and, a hydrogen atom, alkyl group or cycloalkyl group in the positions $R^3$ and $R^4$, and, a hydrogen atom, alkyl group or cycloalkyl group in the positions $R^6$, $R^7$, $R^8$, $R^9$, $R^{10}$ and $R^{11}$ are especially useful.

The following are the typical examples for the compounds, above. However, such examples do not limit the compounds employed in the present invention.

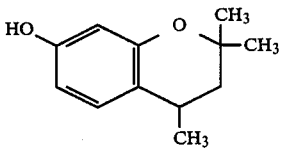
(CH-1)
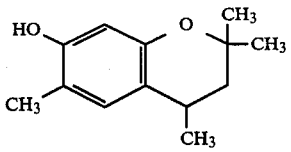
(CH-2)
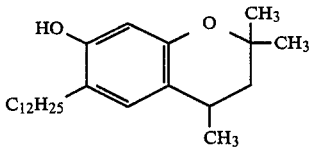
(CH-3)
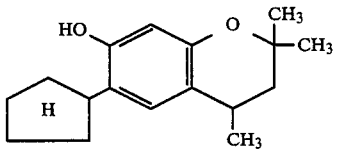
(CH-4)
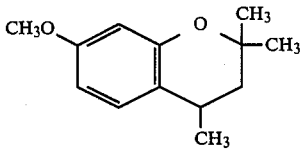
(CH-5)
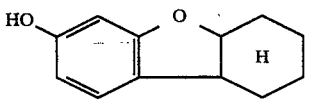
(CH-6)
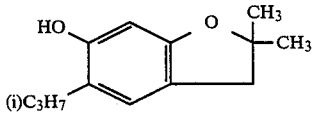
(CH-7)
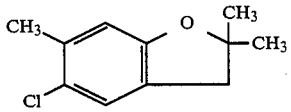
(CH-8)
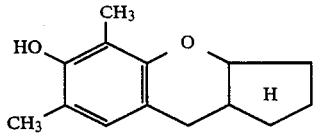
(CH-9)
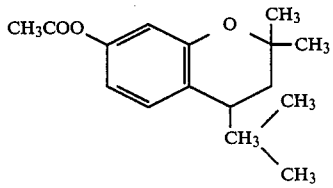
(CH-10)

-continued
(CH-11)
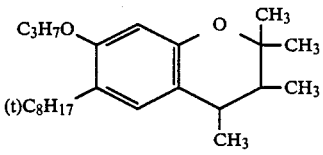
(CH-12)
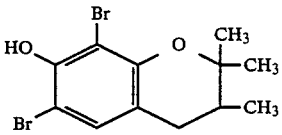
(CH-13)
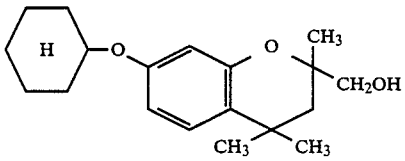
(CH-14)
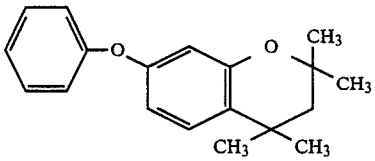
(CH-15)
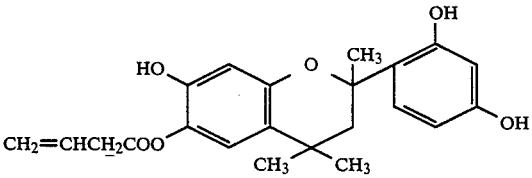
(CH-16)
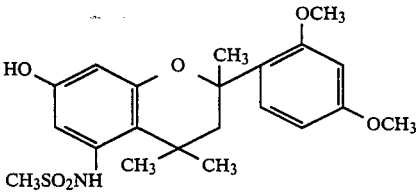
(CH-17)
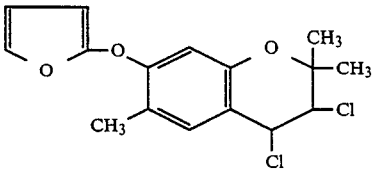
(CH-18)
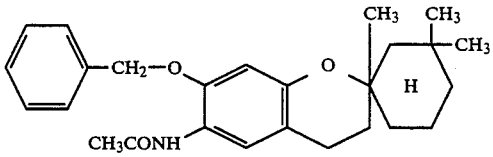
(CH-19)
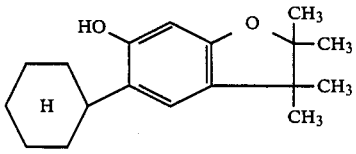

-continued
(CH-20)
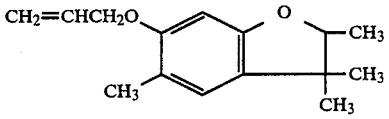
(CH-21)
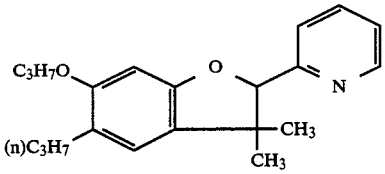
(CH-22)
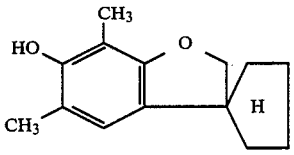
(CH-23)
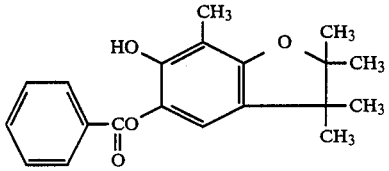
(CH-24)
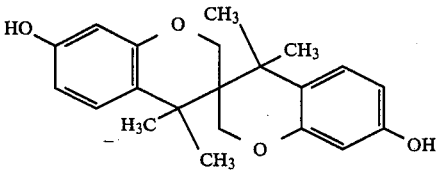
(CH-25)
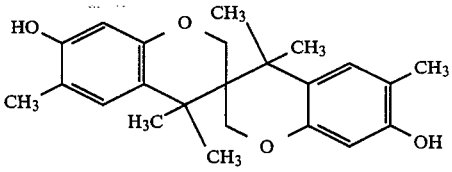
(CH-26)
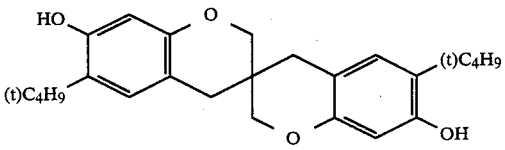
(CH-27)
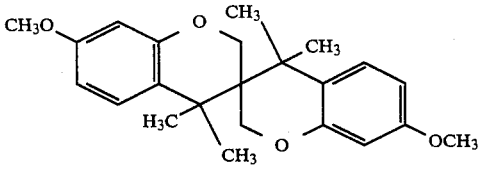
(CH-28)
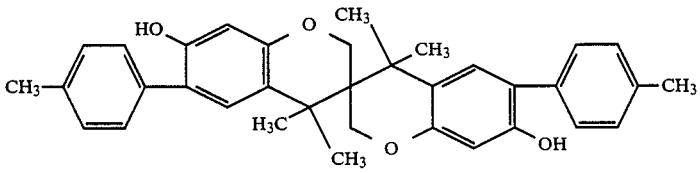

-continued
(CH-29)
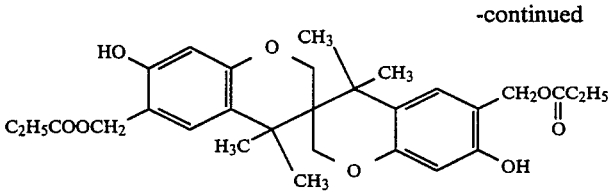
(CH-30)
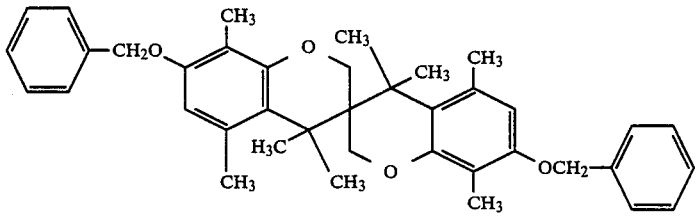
(CH-31)
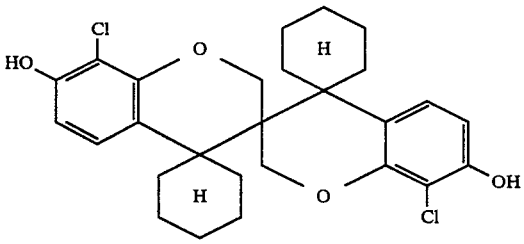
(CH-32)
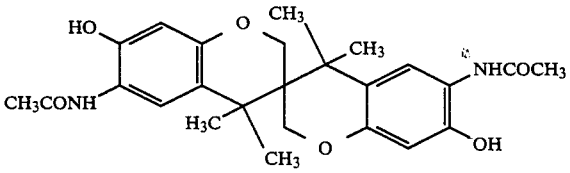
(CH-33)
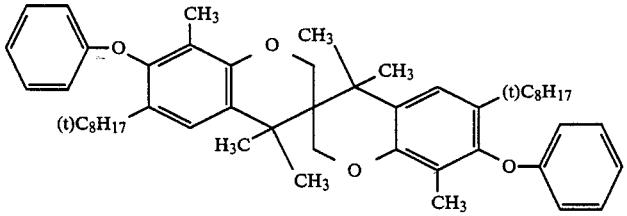
(CH-34)
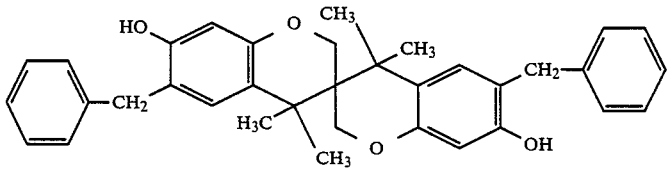
(CH-35)
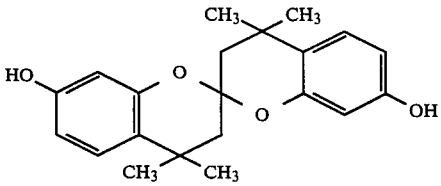
(CH-36)
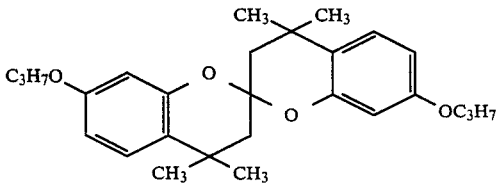

-continued
(CH-37)
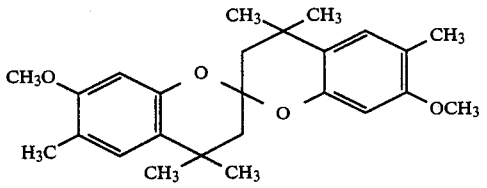
(CH-38)
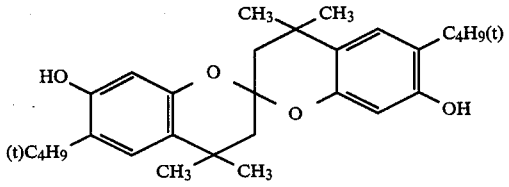
(CH-39)
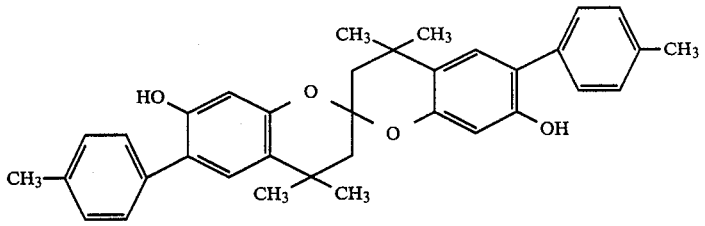
(CH-40)
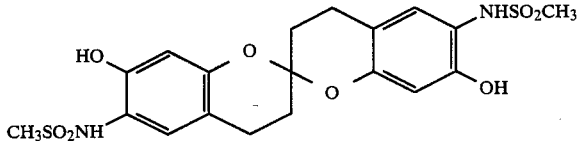
(CH-41)
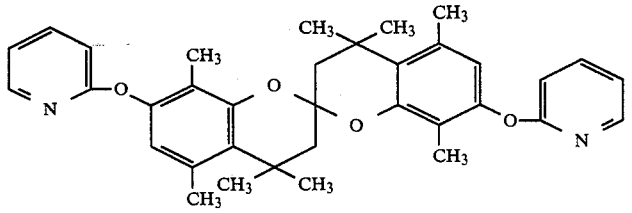
(CH-42)
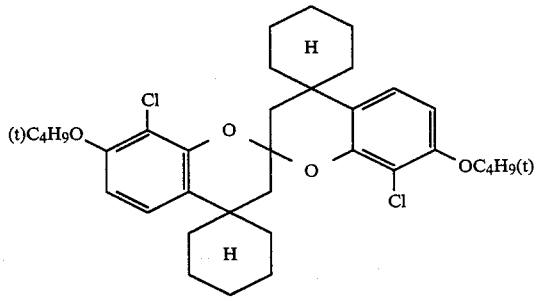
(CH-43)
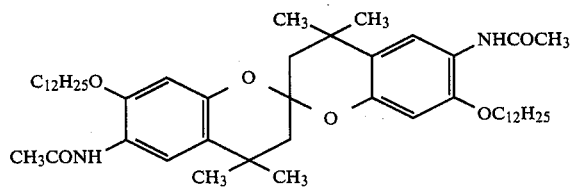

-continued
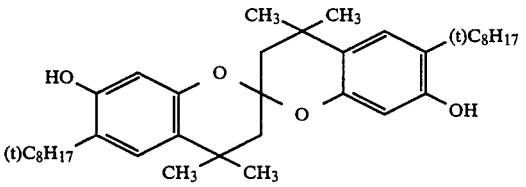
(CH-44)
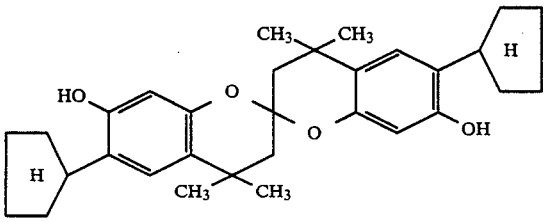
(CH-45)
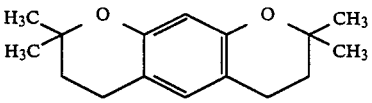
(CH-46)
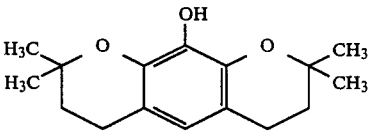
(CH-47)
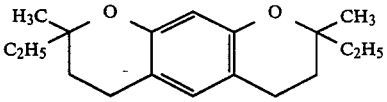
(CH-48)
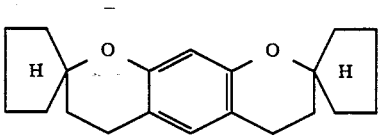
(CH-49)
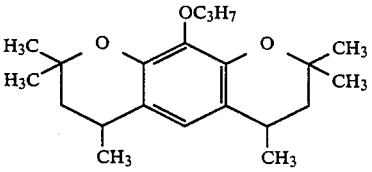
(CH-50)
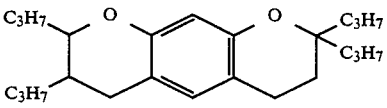
(CH-51)
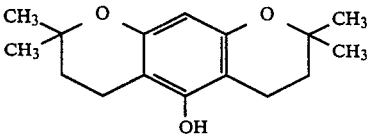
(CH-52)
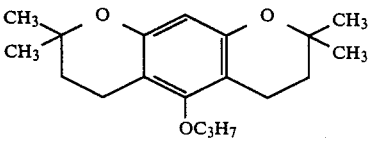
(CH-53)

-continued (CH-54)

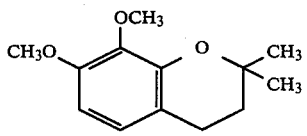

(CH-55)

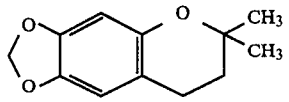

The magenta dye image stabilizers expressed by the previously mentioned general formula [XIIIa] include the compounds disclosed in the following literatures and can be synthesized by employing a method disclosed in the literatures: Tetrahedron, 1970, vol. 26, pp 4743~4751; Journal of Chemical Society of Japan, 1972, No 10, pp 1987~1990; Chemical Letter, 1972 (4), pp 315~316; Japanese Patent O.P.I. Publication No. 139383/1980.

The compounds expressed by the previously mentioned general formula [XIIIb] are further described, below, in detail.

As specific examples for a halogen atom, alkyl group, alkenyl group, alkoxy group, aryl group, aryloxy group, acyl group, acylamino group, acyloxy group, sulfonamide group, cycloalkyl group and alkoxycarbonyl group expressed by either $R^{12}$ or $R^{14}$, the groups described in detail for R in general formula [I] are available.

As specific examples for a halogen atom, alkyl group, alkenyl group, aryl group, acyl group, acylamino group, acyloxy group, sulfonamide group, cycloalkyl group and alkoxycarbonyl group expressed by $R^{13}$, the groups described in detail for R in general formula [I] are available.

Each group, mentioned above, may possess another substituent. The examples for such a substituent include an alkyl group, alkenyl group, alkoxy group, aryl group, aryloxy group, hydroxy group, alkoxycarbonyl group, aryloxycarbonyl group, acylamino group, carbamoyl group, sulfonamide group, sulfamoyl group and others.

Additionally, a 5- or 6-membered hydrocarbon ring formed by mutual closure of $R^{13}$ and $R^{14}$ may possess a substituent such as a halogen atom, alkyl group, cycloalkyl group, alkoxy group, alkenyl group, hydroxy group, aryl group, aryloxy group or heterocyclic group.

$Y_3$ represents a plurality of atoms necessary for the forming of an indane ring. Such an indane ring may possess a substituent such as a halogen atom, alkyl group, alkenyl group, alkoxy group, cycloalkyl group, hydroxy group, aryl group, aryloxy group or heterocyclic group, and may further form a spiro ring.

Among the compounds expressed by general formula [XIIIb], the especially useful compounds for the invention include the compounds expressed by general formulas [XIVb]~[XVIb].

General formula [XIVb]

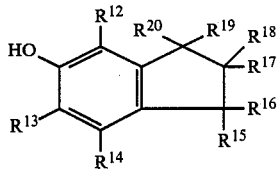

General formula [XVb]

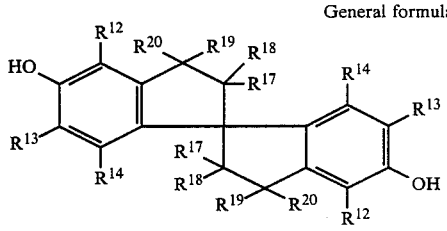

General formula [XVIb]

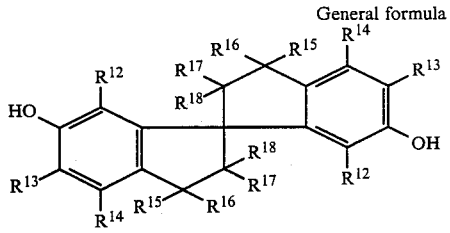

$R^{12}$, $R^{13}$ and $R^{14}$ in general formulas [XIVb]~[XVIb] have the same meanings as in general formula [XIIIb]. $R^{15}$, $R^{16}$, $R^{17}$, $R^{18}$, $R^{19}$ and $R^{20}$ respectively represent any one of a hydrogen atom, halogen atom, alkyl group, alkoxy group, alkenyl group, hydroxy group, aryl group, aryloxy group or heterocyclic group. $R^{15}$ and $R^{16}$, or, $R^{16}$ and $R^{17}$, or, $R^{17}$ and $R^{18}$, or, $R^{18}$ and $R^{19}$, or $R^{19}$ and $R^{20}$ may mutually cyclize to form a carbocycle, and, further, an alkyl group may, as a substituent, take a position in the carbocycle.

With the previously mentioned general formulas [XIVb]~[XVIb], the compounds where a hydrogen atom, alkyl group, alkoxy group, hydroxy group or cycloalkyl group takes the positions $R^{12}$ and $R^{14}$, and a hydrogen atom, alkyl group, hydroxy group or cycloalkyl group takes the position $R^{13}$, and a hydrogen atom, alkyl group or cycloalkyl group takes the positions $R^{15}$, $R^{16}$, $R^{17}$, $R^{18}$, $R^{19}$ and $R^{20}$ are especially useful.

The typical examples for these compounds are shown below. However, these examples do not limit the scope of the compounds employed in the present invention.

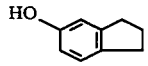

HI-1

-continued
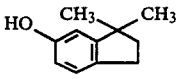
HI-2
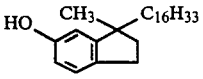
HI-3
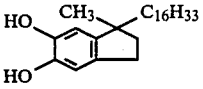
HI-4
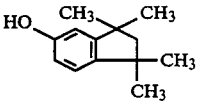
HI-5
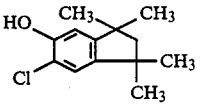
HI-6
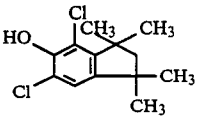
HI-7
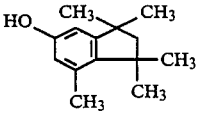
HI-8
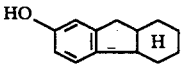
HI-9
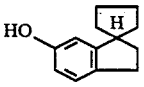
HI-10
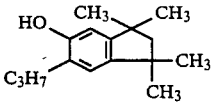
HI-11
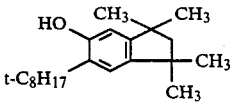
HI-12
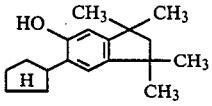
HI-13
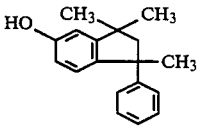
HI-14
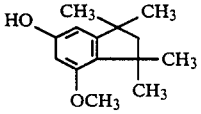
HI-15
-continued
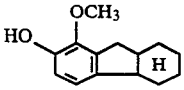
HI-16
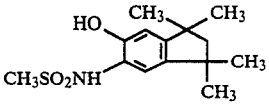
HI-17
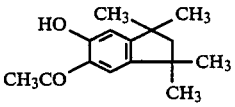
HI-18
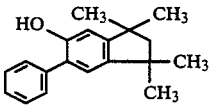
HI-19
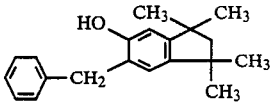
HI-20
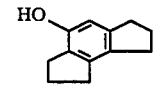
HI-21
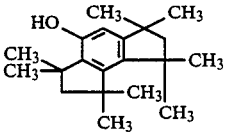
HI-22
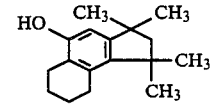
HI-23
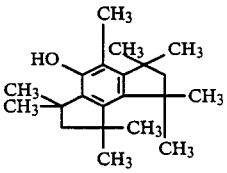
HI-24
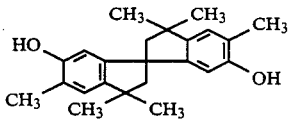
HI-25
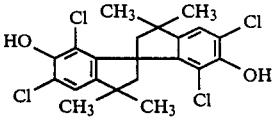
HI-26
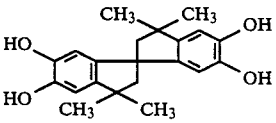
HI-27
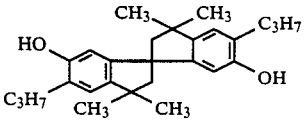
HI-28

-continued

HI-29

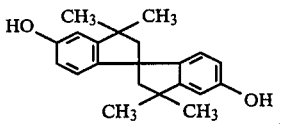

HI-30

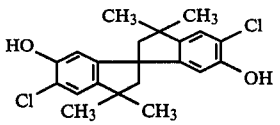

HI-31

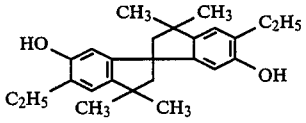

HI-32

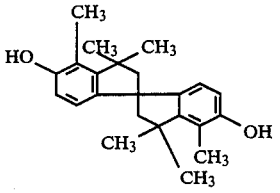

HI-33

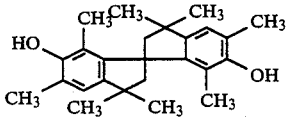

HI-34

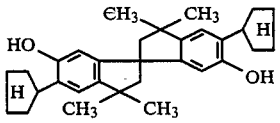

HI-35

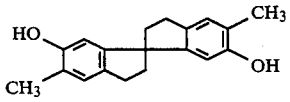

HI-36

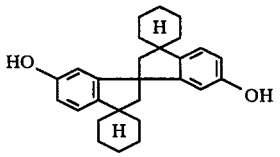

HI-37

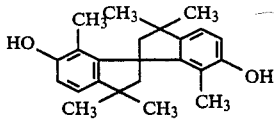

HI-38

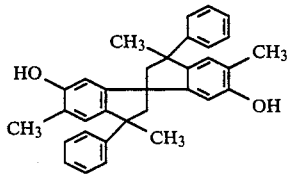

-continued

HI-39

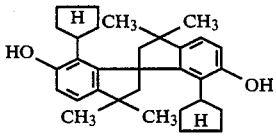

HI-40

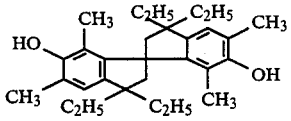

HI-41

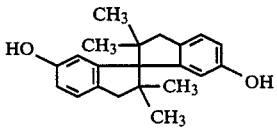

HI-42

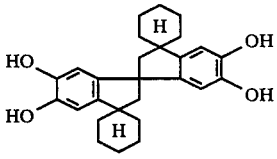

HI-43

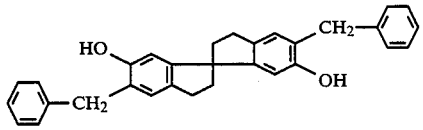

HI-44

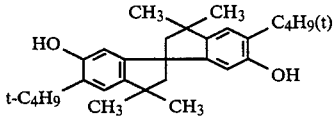

HI-45

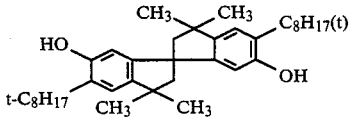

The method for synthesizing the magenta dye image stabilizers employed in the present invention and expressed by the previously mentioned general formulas [XIIIb], [XIVb]~[XVIb], is known in the art, and, such stabilizers can be synthesized by referring to the descriptions in such literatures as: Journal of Chemical Society, 1962, pp 415~417; Japanese Patent Examined Publication No. 32785/1984; Bulletin of Chemical Society of Japan, 1980, 53, pp 555-556.

The magenta dye image stabilizer expressed by general formula [XIIIb] and employed in the invention was disclosed in Japanese Patent Examined Publication No. 32785/1984 and was used as a stabilizer for a magenta dye image derived from a magenta coupler involving a pyrazolone, indazolone or cyanoacetyl. The Publication further states that the stabilizer, mentioned above, is especially useful as a stabilizer for a magenta dye image derived from a magenta coupler involving a 5-pyrazolone. However, the Publication totally fails to suggest that the stabilizer, mentioned above, is useful as a stabilizer for a magenta dye image derived from a magenta coupler of the invention, which has a constitution completely different from that of the previously mentioned magenta coupler. Furthermore, it is unexpected from the above-mentioned Publication that, if the stabilizer, expressed by the formula [XIIIb], and a magenta dye image stabilizer expressed by the previously mentioned magenta dye image stabilizer expressed by general formula [XII], mentioned above, are combinedly employed, the preservability of a magenta dye image derived from a magenta coupler of the invention, is uniquely and effectively improved to the unpredictable degree.

The amount employed of magenta dye image stabilizers expressed by the previously mentioned general formula [XII], [XIIIa] or [XIIIb], is 5~400 mol %, or, more preferably, 10~250 mol % per 100 mol % magenta coupler expressed by the previously mentioned general formula [I] and employed in the invention.

When a compound expressed by the previously mentioned general formula [XII], according to the invention, and a compound expressed by the previously mentioned general formula [XIIIa] are combinedly employed, or, when a compound expressed by the previously mentioned general formula [XII], according to the invention, and a compound expressed by the previously mentioned general formula [XIIIb] are combinedly employed, the total amount employed of magenta dye image stabilizers is 10~500 mol %, or, more preferably, 20~400 mol % per 100 mol % magenta coupler of the invention.

Additionally, the proportion of amounts employed, in terms of molar ratio between a compound expressed by the previously mentioned general formula [XII], according to the invention, and a compound expressed by the previously mentioned general formula [XIIIa] or general formula [XIIIb], according to the invention, is within the range of 0.1~10, or, more preferably, 0.25~4.0.

When three compounds respectively expressed by the previously mentioned general formula [XII], according to the invention, the previously mentioned general formula [XIIIa] and the previously mentioned general formula, the total amount employed of a magenta dye image stabilizer is 15~500 mol %, or, more preferably, 30~400 mol % per 100 mol % magenta coupler, according to the invention.

Additionally, when three magenta dye image stabilizers are combinedly employed, the amount employed of each dye image stabilizer is 5~90 mol %, or, more preferably, 10~70 mol % of the total amount employed of all the dye image stabilizers.

According to one of the most favorable embodiment of the present invention, the object of the invention is best attained under the coexistance of at least one metallic complex having a singlet oxygen of which optical quenching rate is more than $3\times10^7$ $M^{-1}.sec^{-1}$.

Next, the description on a metallic complex, utilized in the invention and having a singlet oxygen of which optical quenching rate constant is more than $3\times10^7$ $M^{-1}.sec^{-1}$, is given below.

The optical quenching rate constant of the above-mentioned singlet oxygen is determined with a measuring method for the light-fading of rubrene disclosed in Journal of Physical Chemistry, 83, 591 (1979) and others.

According to the method, above, the chloroform solution containing rubrene as well as the chloroform solution containing the mixture of rubrene and a compound to be measured are respectively exposed to lights having an equal energy.

In this method, when assuming that the initial concentration of rubrene is [R], and that the concentration of the compound to be measured is [Q], and that the post-test rubrene concentration of the solution singly containing rubrene is $[R]_F^O$ and that the post-test rubrene concentration of the solution simultaneously containing rubrene and the compound to be measures is $[R]_F^Q$, the optical quenching rate constant of singlet oxygen (kq) is determined with the following expression.

$$kq = \frac{5.3\times10^7\left([R]_F^Q - [R]_F^O\right) + 1.7\times10^4 \ln\left([R]_F^Q/[R]_F^O\right)}{[Q]\ln\left([R]/[R]_F^Q\right)}$$

The metallic compounds employed in the invention are the compounds having the optical quenching rate constant of singlet oxygen, determined with the expression, above, more than $3\times10^7$ $M^{-1}.sec^{-1}$, or, more preferably, $1\times10^8$ $M^{-1}.sec^{-1}$. Furthermore, the principal metal within a metallic complex is preferably a transitional metal, or, more preferably a metallic atom such as Fe, Co, Ni, Pd, Pt, and, most favorably, a Ni metallic atom.

As the metallic complexes, employed in the invention and having an optical quenching rate constant of singlet oxygen more than $3\times10^7$ $M^{-1}.sec^{-1}$, those expressed by the following general formula [L - I]~[L - IV] are preferable.

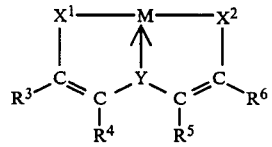

General formula [L-I]

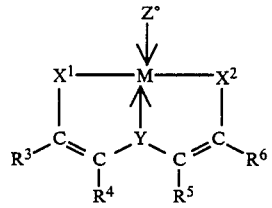

General formula [L-II]

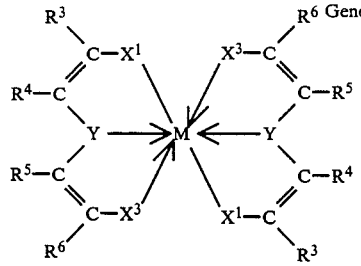

General formula [L-III]

[In general formulas [L - I], [L - II] and [L - III], M represents a metallic atom.]

$X^1$ and $X^2$ respectively represent an oxygen atom, sulfur atom or —$NR^7$— ($R^7$ represents a hydrogen atom, alkyl group, aryl group or hydroxy group). $X^3$ represents a hydroxy group or mercapto group. Y represents an oxygen atom or sulfur atom. $R^3$, $R^4$, $R^5$ and $R^6$ respectively represent any one of a hydrogen atom, halogen atom, cycano group , or, an alkyl group, aryl group, cycloalkyl group or heterocyclic group which directly or via a bivalent bonding group connects with a carbon atom. Additionally, at least one combination, that is, $R^3$ and $R^4$, and, $R^5$ and $R^6$, may form a 5- or 6-membered ring by mutually combining and bonding a carbon atom.

$Z^0$ represents a compound which may be coordinated at the position M or a residue derived from such a compound.

General formula [L-IV]

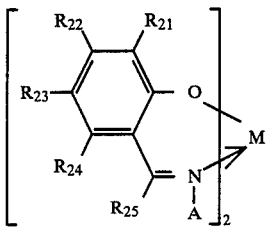

[In the formula, above, $R_{21}$, $R_{22}$, $R_{23}$ and $R_{24}$ respectively represent any one of a hydrogen atom, halogen atom, hydroxy group, cyano group, or, an alkyl group, aryl group, cycloalkyl group or heterocyclic group which may directly or indirectly via a bivalent bonding group combine to a carbon atom on a benzene ring. Additionally, $R_{21}$ and $R_{22}$, or, $R_{22}$ and $R_{23}$, or, $R_{23}$ and $R_{24}$ may mutually combine to form a 6-membered ring.

$R_{25}$ represents a hydrogen atom, alkyl group, or aryl group. A represents a hydrogen atom, alkyl group, aryl group or hydroxy group. M represents a metallic atom.]

In the above-mentioned general formulas [L - I], [L - II] and [L - III], $X^1$ and $X^2$ may be whichever identical or different, in addition, they respectively represents any one of an oxygen atom, sulfur atom or —$NR^7$— ($R^7$ represents any one of a hydrogen atom, alkyl groups including, for example, a methyl group, ethyl group, n-propyl group, i-propyl group, n-butyl group, t-butyl group, i-butyl group, benzyl group and others), or, aryl groups (such as a phenyl group, tolyl group, naphthyl group and others) or hydroxy group. Among these examples, an oxygen atom of sulfur atom is favorable, and, more specifically, an oxygen atom is more favorable.

$X^3$ in general formula [L - III] represents a hydroxy group or mercapto group, and, a hydroxy group is more preferred.

Y in general formulas [L - I], [L - II] and [L - III] represents an oxygen atom or sulfur atom, and, a sulfur atom is favorable. Additionally, two Ys in general formula [L - III] may be whichever identical or different.

$R^3$, $R^4$, $R^5$ and $R^6$ in general formulas [L - I], [L - II] and [L - III] may be whichever identical or different, and, may be respectively one of the following: a hydrogen atom; a halogen atom such as a fluorine, chlorine, bromine or iodine; a cyano group; an alkyl group (such as a methyl group, ethyl group, propyl group, butyl group, hexyl group, octyl group, dodecyl group, hexadecyl group and others, and, additionally, these alkyl groups may be whichever straight-chained or branched ones) which directly or via a bivalent bonding group (such as —O—, —S—, —$NR^{7'}$— [where $R^{7'}$ represents one of such monovalent groups including a hydrogen atom, hydroxy group, or, an alkyl group (such as a methyl group, ethyl group, n-propyl group, i-propyl group, n-butyl group, t-butyl group, i-butyl group and others), aryl group (such as a phenyl group, tolyl group, naphthyl group and others)], —OCO—, —CO—, —NHCO—, —CONH—, —COO—, —$SO_2$NH—, —$NHSO_2$—, —$SO_2$— and others) connects with a carbon atom; an aryl group such as a phenyl group, naphthyl group and others; a cycloalkyl group such as a cyclopentyl group, cyclohexyl group and others; a heterocyclic group such as a pyridyl group, imidazolyl group, furyl group, thienyl group, pyrrolyl group, pyrrodinyl group, quinolyl group morpholinyl group and others. Among these examples, as a group formed from an alkyl group, aryl group, cycloalkyl group in combination with a bivalent bonding group, above, and connecting with a carbon atom via the bivalent bonding group, above, the following examples are available: an alkoxy group (a straight-chained or branched alkyloxy group, such as a methoxy group, ethoxy group, n-butyloxy group, octyloxy group and others); an alkoxycarbonyl group (a straight-chained or branched alkyloxycarbonyl group such as a methoxycarbonyl group, ethoxycarbonyl group, n-hexadecyloxycarbonyl group and others); an alkylcarbonyl group (a straight-chained or branched alkylcarbonyl group such as an acetyl group, valeryl group, stearoyl group and others); an arylcabonyl group such as a benzoyl group and others; an alkylamino group (a straight-chained or branched alkylamino group, such as an N-n-butylamino group, N,N-di-n-butylamino group, N,N-di-n-octylamino group and others); an alkylcarbamoyl group (a straight-chained or branched alkylcarbamoyl group such as an n-butylcarbamoyl group, n-dodecylcarbamoyl group and others); an alkylsulfamoyl group (a straight-chained or branched alkylsulfamoyl group such as an n-butylsulfamoyl group, n-dodecylsulfamoyl group and others); an alkylacylamino group (a straight-chained or branched alkylcarbonylamino group such as an acetylamino group, palmitoylamino group and others); an aryloxy group such as a phenoxy group, naphthoxy group and others; an aryloxycarbonyl group such as a phenoxycarbonyl group, naphtoxycarbonyl group and others; an arylamino group such as an N-phenylamino group, N-phenyl-N-methylamino group and others; an arylcarbamoyl group such as a phenylcarbamoyl group and others; an arylsulfamoyl group such as a phenylsulfamoyl group and others; an arylacylamino group such as a benzoylamino group and others.

Additionally, any of $R^3$, $R^4$, $R^5$ and $R^6$ in general formulas [L - I], [L - II] and [L - III] may form a 5 or 6-membered ring, together with a carbon atom to which at least one of the combinations, $R^3$ and $R^4$, and, $R^5$ and $R^6$, couples by mutual closure of the two components. In this case, the 5 or 6-membered rings formed from mutual bonding, involving a carbon atom, within at least one combination of components expressed by $R^3$ and $R^4$, and, $R^5$ and $R^6$, include a hydrocarbon ring and a heterocycle (for example, a 5 or 6-membered heterocycle containing a nitrogen atom), which, having at least one unsaturated bond, are exemplified by, for example, a cyclopentene ring, cyclohexene ring, benzene ring (the benzene ring, however, contains a condensed benzene ring, that is, for example, a naphthalin ring, anthracene ring and others). If such a 5 or 6-membered ring has a substituent, the examples for the substituent include the following: a halogen atom (fluorine, chlorine, bromine and iodine), a cyano group, an alkyl group (for example, a straight-chained or branched alkyl group containing 1~20 carbon atoms, such as a methyl group, ethyl group, n-propyl group, n-butyl group, n-octyl group, t-octyl group, n-hexadecyl group and others), an aryl group (for example, a phenyl group, naphthyl group and others), an alkoxy group (for example, a straight-chained or branched alkyloxy group, such as a methoxy group, n-butoxy group, t-butoxy group and others), an aryloxy group such as a phenoxy group and others, an alkoxycarbonyl group (for example, a straight-chained or branched alkyloxycarbonyl group, such as an n-pentyloxycarbonyl group, t-pentyloxycarbonyl group, n-octyloxycarbonyl group, t-octyloxycarbonyl group and others), an aryloxycarbonyl group (for example, a phenoxycarbonyl group and others), an acyl group (for example, a straight-chained or branched alkylcarbonyl group such as an acetyl group, stearoyl group and others), an acylamino group (for example, a straight-chained or branched alkylcarbonylamino group such as an acetamide group and others, and, an arylcarbonylamino group such as a benzoylamino group and others), an arylamino group (for example, an N-phenylamino group and others), an alkylamino group (for example, a straight-chained or branched alkylamino group such as an N-n-butylamino group, N,N-diethylamino group and others), a carbamoyl group (for example, a straight-chained or branched alkylcarbamoyl group such as an n-butylcarbamoyl group), a sulfamoyl group (for example, a straight-chained or branched alkylsulfamoyl group such as an N,N-di-n-butylsulfamoyl group, N-n-dodecylsulfamoyl group and others), a sulfonamide group (for example, a straight-chained or branched alkylsulfonylamino group such as a methylsulfonylamino group and others, and, an arylsulfonylamino group such as a phenylsulfonylamino group and others), a sulfonyl group (for example, a starlight-chained or branched alkylsulfonyl group such as a mecyl group and others, and, an arylsulfonyl group such as a tocyl group and others), a cycloalkyl group (for example, a cyclohexyl group and others).

General formulas [L - I], [L - II] and [L - III] are preferred when an alkyl group or aryl group expressed by $R^3$, $R^4$, $R^5$ and $R^6$ forms a 5 or 6-membered ring combinedly with a carbon atom wherein at least one pair among $R^3$ and $R^4$, and, $R^5$ and $R^6$ mutually combine and connect with the atom. Further, the case where the pairs $R^3$ and $R^4$, and, $R^5$ and $R^6$ respectively form a 6-membered ring, or, preferably, a benzene ring by mutually bonding and connecting with a carbon atom.

Additionally, in general formulas [L - I], [L - II] and [L -III], M represents a metal atom, which is preferably a transition-metal atom, or, more preferably, a nickel atom, copper atom, cobalt atom, palladium atom or platinum atom, or, most favorably, a nickel atom.

A compound which may coordinate with M represented by $Z^0$ in general formula [L - II] is preferably an alkylamine having a straight-chained or branched alkyl group, and, more preferably, dialkylamine or trialkylamine having 2~36 carbon atoms within an alkyl group. The specific examples of such an alkylamine include the following: monoalkylamines including a butylamine, octylamine (for example, a t-octylamine), dodecylamin (for example, n-dodecylamine), hexadecylamin, octanolamine and others; dialkylamines including a diethylamine, dibutylamine, dioctylamine, didodecylamine, diethanolamine, dibutanolamine and others; trialkylamines including a triethyamine, tributylamine, trioctylamine, triethanolamine, tributanolamine, trioctanolamine and others.

The more favorable metallic complexes of the invention among those expressed by general formulas [L - I], [L - II] and [L - III] are the metallic complexes expressed by the following general formulas [L - Ia], [L - IIa] and [L - IIIa].

General formula [L-Ia]

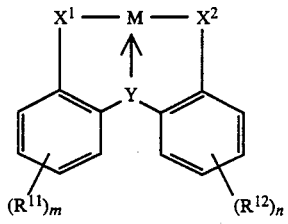

General formula [L-IIa]

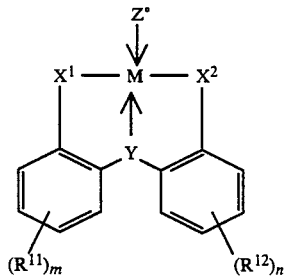

General formula [L-IIIa]

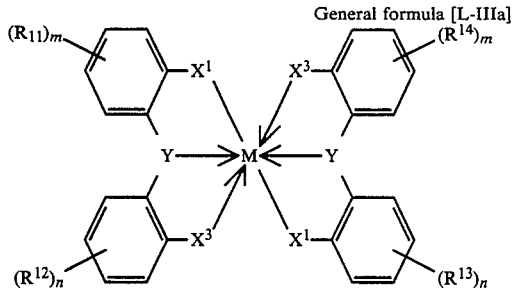

In general formulas [L - Ia], [L - IIa] and [L - IIIa], M, $X^1$, $X^2$, $X^3$, Y and Z have the same meanings as were previously mentioned.

In general formulas [L - Ia], [L - IIa] and [L - IIIa], $R^{11}$, $R^{12}$, $R^{13}$ and $R^{14}$ respectively represent any one of the following: an alkyl group (a straight-chained or branched alkyl group having 1~20 carbon atoms, such as a methyl group, ethyl group, n-propyl group, n-butyl group, n-octyl group, t-octyl group, n-hexadecyl group and others); an aryl group, such as a phenyl group, naphthyl group and others; an alkoxy group (a straight-chained or branched alkyloxy group, such as a methoxy group, n-butoxy group, t-butoxy group and others); an aryloxy group, such as a phenoxy group and others; an alkoxycarbonyl group (a straight-chained or branched alkyloxycarbonyl group, such as an n-pentyloxycarbonyl group, t-pentyloxycarbonyl group, n-octyloxycarbonyl group, t-octyloxycarbonyl group and others); an aryloxycarbonyl group, such as a phenoxycarbonyl group and others; an acyl group (a straight-chained or branched alkylcarbonyl group, such as an acetyl group, stearoyl group and others); an acylamino group (a straight-chained or branched alkylcarbonylamino group, such as an acetamide group and others, and, an arylcarbonylamino group, such as a benzoylamino group); an arylamino group such as an N-phenylamino group and others; an alkylamino group (a straight-chained or branched alkylamino group, such as an N-n-butylamino group, N,N-diethylamino group and others); a carbamoyl group (a straight-chained or branched alkylcarbamoyl group, such as an n-butylcarbamoyl group and others); a sulfamoyl group (a straight-chained or branched alkylsulfamoyl group, such as an N,N-di-n-butylsulfamoyl group, N-n-dodecylsulfamoyl group and others); a sulfonamide group (a straight-chained or branched alkylsulfonylamino group such as a methylsulfonylamino group and others, and, an arylsulfonylamino group, such as a phenylsulfonylamonic group and others); a sulfonyl group (a straight-chained or branched alkylsulfonyl group, such as a mesyl group, and, an arylsulfonyl group, such as a tosyl group); a cycloalkyl group, such as a cyclohexyl group and others). m and n respectively represent any one of the integers, 0~4. Among the compounds expressed by general formulas [L - I], [L - IIa] and [L - IIIa], those more favored are the compounds expressed by general formula [L - IIa]. Amcng the compounds expressed by general formula [L - IIa], the most favorable ones are expressed by general formula [L - IIb].

General formula [L-IIb]

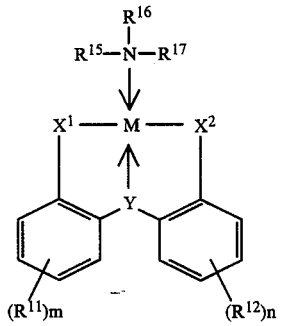

In general formula [L - IIb], M, $X^1$, $X^2$, Y, $R^{11}$, $R^{12}$, m and n respectively have the same meaning as mentioned before. $R^{15}$, and $R^{16}$ and $R^{17}$ respectively represent any one of a hydrogen atom, alkyl group (such as a butyl group, octyl group, stearyl group and others), or an aryl group (such as phenyl group, naphthyl group and others). Additionally, at least two or $R^{15}$, $R^{16}$ and $R^{17}$ represent an alkyl group or aryl group.

In general formula [L - IV], mentioned previously as a halogen atom expressed by $R_{21}$, $R_{22}$, $R_{23}$ and $R_{24}$, a fluorine atom, chlorine atom, bromine atom and iodine atom are available.

An alkyl group expressed by any one of $R_{21}$, $R_{22}$, $R_{23}$ and $R_{24}$ should be preferably one having 1~19 carbon atoms, and may be whichever a straight-chained or branched alkyl group, and may possess a substituent.

An aryl group expressed by any one of $R_{21}$. $R_{22}$, $R_{23}$ and $R_{24}$ should be preferably one having 6~14 carbon atoms, and may possess a substituent.

A heterocyclic group expressed any one of $R_{21}$. $R_{22}$, $R_{23}$ and $R_{24}$ should be preferably a 5 or 6-membered ring, and may possess a substituent.

A cycloalkyl group expressed any one of $R_{21}$. $R_{22}$, $R_{23}$ and $R_{24}$ should be preferably of a 5 or 6-membered ring, and may possess a substituent.

As a 6-membered ring formed from mutual bonding between $R_{21}$ and $R_{22}$, the following available.

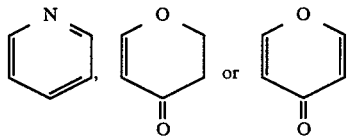

As a 6-membered ring formed from mutual bonding between $R_{22}$ and $R_{23}$, or, $R_{23}$ and $R_{24}$, a benzene ring is preferred, and, such a benzene ring may have a substituent, and may have been condensed.

As an alkyl group expressed any one of $R_{21}$, $R_{22}$, $R_{23}$ and $R_{24}$ the examples such as a methyl group, ethyl group, propyl group, butyl group, t-butyl group, hexyl group, octyl group, decyl group, dodecyl group, tetradecyl group, hexadecyl group, octadecyl group and others are available.

As an aryl group expressed by any one of $R_{21}$, $R_{22}$, $R_{23}$ and $R_{24}$, a phenyl group and naphthyl group, for example, are available.

A heterocyclic group, expressed by any one of $R_{21}$, $R_{22}$, $R_{23}$ and $R_{24}$, is a 5 or 6-membered similar group having within a ring thereof at least one nitrogen atom, oxygen atom or sulfur atom serving as a hetero atom. The examples for such a heterocyclic group include a furyl group, hydrofuryl group, thienyl group, pyrrolyl group, pyrrolidyl group, pyridyl group, imidazolyl group, pyrazolyl group, quinolyl group, indolyl group, oxazolyl group, thiazolyl group and others.

As a cycloalkyl group, expressed by any one of $R_{21}$, $R_{22}$, $R_{23}$ and $R_{24}$, a cyclopentyl group, cyclohexyl group, cyclohexenyl group, cyclohexadienyl group and others are available.

As a 6-membered ring formed from mutual bonding between any two of $R_{21}$. $R_{22}$, $R_{23}$ and $R_{24}$, a benzene ring, naphthalene ring, isobenzothiophene ring, isobenzofuran ring, isoindon ring and others are available.

An alkyl group, cycloalkyl group, aryl group or heterocyclic group, expressed by any one of $R_{21}$, $R_{22}$, $R_{23}$ and $R_{24}$, mentioned above, may combine with a carbon atom on a benzene ring via a bivalent bonding group, such as an oxy group (—o—), thio group (—s—), amino group, oxycarbonyl group, carbonyl group, carbamoyl group, sulfamoyl group, carbonylamino group, sulfonylamino group, sulfonyl group, carbonyloxy group and others. Some of such cases may provide a favorable group.

The examples wherein an alkyl group expressed by $R_{21}$, $R_{22}$, $R_{23}$ or $R_{24}$ combines with a carbon atom on a benzene ring via bivalent group, mentioned above, include an alkoxy group (for example, a methoxy group, ethoxy group, butoxy group, propoxy group, 2-ethylhexyloxyl group, n-decyloxy group, n-dodecyloxy group, n-hexadecyloxy group and others), an alkoxycarbonyl group (for example, a methoxycarbonyl group, ethoxycarbonyl group, butoxycarbonyl group, n-decyloxycarbonyl group, n-hexadecyloxycarbonyl group and others), an acyl group (for example, an acetyl group, valeryl group, stearoyl group, benzoyl group, toluoyl group and others), an acyloxy group (for example, an acetoxy group, hexadecylcarbonyloxy group and others), an alkylamino group (for example, an n-butylamino group, N,N-diethylamino group, N,N-didecylamino group and others), an amylcarbamoyl group (for example, a butylcarbamoyl group, N,N-diethylcarbamoyl group, n-dodecylcarbamoyl group and others), an alkylsulfamoyl group (for example, a butyl-sulfamoyl group, N,N-diethylsulfamoyl group, n-dodecylsulfamoyl group and others), a sulfonylamino group (for example, a methylsulfonylamino group, butylsulfonylamino group and others), a sulfonyl group (for example, a mesyl group, ethanesulfonyl group and others), an acylamino group (for exmaple, an acetylamino group, valerylamino group, palmitoyl group, benzoylamino group, toluolylamino group and others).

The examples wherein an cycloalkyl group expressed by $R_{21}$, $R_{22}$, $R_{23}$ and $R_{24}$ combines with a carbon atom on a benzene ring via bivalent group, mentioned above, include a cyclohexyloxy group, cyclohexylcarbonyl group, cyclohexyloxycarbonyl group, cyclohexylamino group, cyclohexenylcarbonyl group, cyclohexenyloxy group and others.

The examples wherein an aryl group expressed by $R_{21}$, $R_{22}$, $R_{23}$ or $R_{24}$ combines with a carbon atom on a benzene ring via bivalent group, mentioned above, include an aryloxy group (for example, a phenoxy group, naphthoxy group and others), an aryloxycarbonyl group (for example, a phenoxycarbonyl group, naphthoxycarbonyl group and others), an acyl group (for example, a benzoyl group, a naphthoyl group and others), an anilino group (for example, a phenylamino group, N-methylanilino group, N-acetylanilino group and others), an acyloxy group (for example, a benzoyloxy group, toluoyloxy group and others), an arylcarbamoyl group (for example, a phenylcarbamoyl group and others), an arylsulfamoyl group (for example, a phenylsulfamoyl group and others), an arylsulfonylamino group (for example, a phenylsulfonylamino group, p-tolylsulfonylamino group and others), an arylsulfonyl group (for example, a benzenesulfonyl group, tosyl group and others), an acylamino group (for example, a benzoylamino group and others).

An alkyl group, aryl group, heterocyclic group and cycloalkyl group expressed by any of $R_{21}$, $R_{22}$, $R_{23}$ and $R_{24}$, mentioned above, as well as a 6-membered ring formed from mutual bonding between $R_{21}$, and $R_{22}$, or $R_{22}$ and $R_{23}$, or $R_{23}$ and $R_{24}$, may have a substituent such as the following: a halogen atom (for example, a chlorine atom, bromine atom, fluorine atom and others), a cyano group, an alkyl group (for example, a methyl group, ethyl group, i-propyl group, butyl group, hexyl group, octyl group, decyl group, dodecyl group, tetradecyl group, hexadecyl group, heptadecyl group, octadecyl group, methoxyethoxyethyl group and others), an aryl group (for example, a phenyl group, tolyl group, naphthyl group, chlorophenyl group, methoxyphenyl group, acetylphenyl group and others), an alkoxy group (for example, a methoxy group, ethoxy group, butoxy group, propoxy group, methoxyethoxy group and others), an aryloxy group (for example, a phenoxy group, tolyloxy group, naphthoxy group, methoxyphenoxy group and others), an alkoxycarbonyl group (for example, a methoxycarbonyl group, butoxycarbonyl group, phenoxymethoxycarbonyl group and others), an aryloxycarbonyl group (for example, a phenoxycarbonyl group, tolyloxycarbonyl group, methoxyphenoxycarbonyl group and others), an acyl group (for example, a formyl group, acetyl group, valeryl group, stearoyl group, benzoyl group, toloyl group, naphthoyl group, p-methoxybenzoyl group and others), an acyloxy group (for example, an acetoxy group, and acyloxy group and others), an acylamino group (for example, acetamide group, benzamide group, methoxyacetamide group and others), an anilino group (for example, a phenylamino group, N-methylanilino group, N-phenylanilino group, N-acetylanilino group and others), an alkylamino group (for example, an n-butylamino group, N,N-diethylamino group, 4-methoxy-n-butylamino group and others), a carbamoyl group (for example, an n-butylcarbamoyl group, N,N-diethylcarbamoyl group, n-butylsulfamoyl group, N,N-diethylsulfamoyl group, n-dodecylsulfamoyl group, N-(4-methoxy-n-butyl) sulfamoyl group and others), a sulfonylamino group (for example, a methylsulfonylamino group, phenylsulfonylamino group, methoxymethylsulfonylamino group and others), a sulfonyl group (for example, a mecyl group, tocyl group, methoxymethanesulfonyl group and others).

Alkyl groups expressed by $R_{25}$ and A include those having a substituent, and may be whichever straight-chained or branched. Such alkyl groups, preferably, have $1 \sim 20$ carbon atoms other than the similar atoms in a substituent, and include a methyl group, ethyl group, propyl group, butyl group, hexyl group, octyl group, decyl group, dodecyl group, tetradecyl group, hexadecyl group, heptadecyl group, octadecyl group and the like.

Aryl groups expressed by $R_{25}$ and A include those having a substituent, and, are preferably the similar groups having $6 \sim 14$ carbon atoms other than the similar atoms in a substituent. Such aryl groups include a phenyl group, tolyl group, naphthyl group and the like. Further, two ligands may combine with such an aryl group via A.

In the formula, M represents a metallic atom, which is preferably a transitional metallic atom, and, more preferably Cu, Co, Ni, Pd, Fe or Pt. The most favorable one is Ni. As a group expressed by A, a hydroxy group is preferred.

Additionally, among complexes expressed by the above-mentioned general formula [L - IV] those preferably employed have the following features: the place, $R_{21}$, is occupied by an oxy group, thio group, an alkyl group which is combined via a carbonyl group, or, a cycloalkyl group, aryl group, heterocyclic group, hydroxy group or a fluorine atom, and; at least one group expressed by $R_{22}$, $R_{23}$ or $R_{24}$ is a hydrogen atom, hydroxy group, alkyl group or alkoxy group. Among such complexes, the similar complex having a hydrogen atom in $R_{25}$, and having more than four carbon atoms in total within the groups expressed by $R_{22}$, $R_{23}$ and $R_{24}$.

The example metallic complexes of the invention are given below, however, the scope of the present invention is not limited only to these compounds.

Exemplified metallic complexes

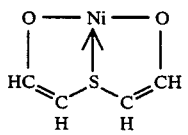

(1)

-continued
(2)
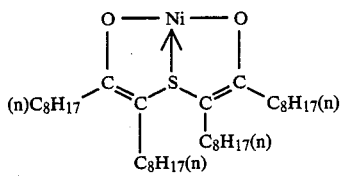
(3)
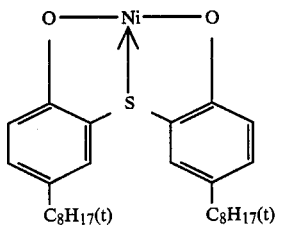
(4)
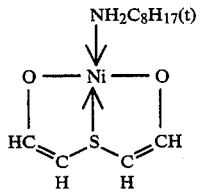
(5)
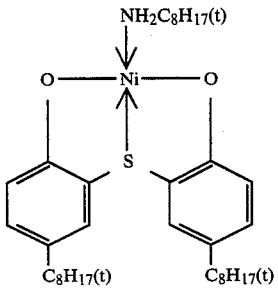
(6)
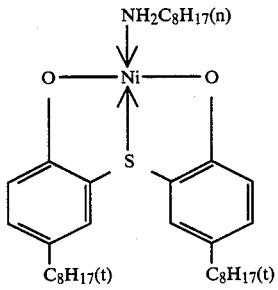
(7)
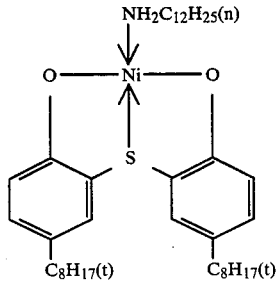

-continued
(8)
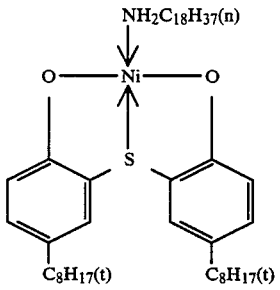
(9)
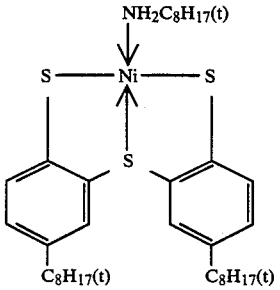
(10)
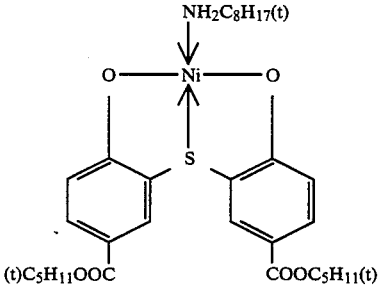
(11)
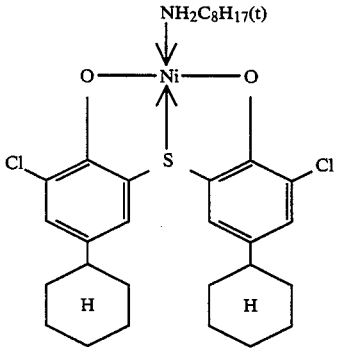
(12)
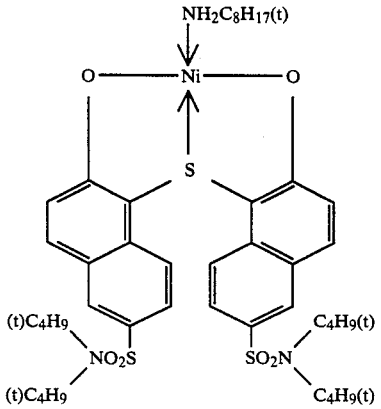

-continued
(13)
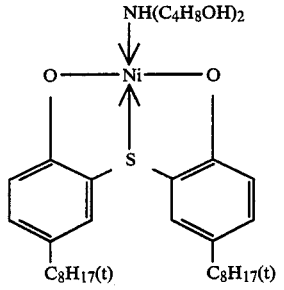
(14)
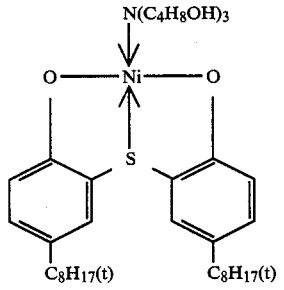
(15)
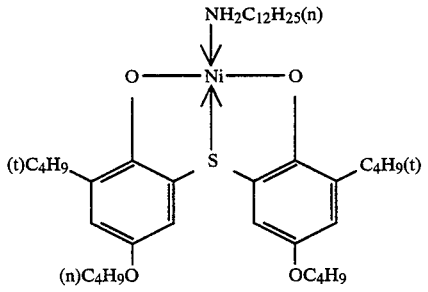
(16)
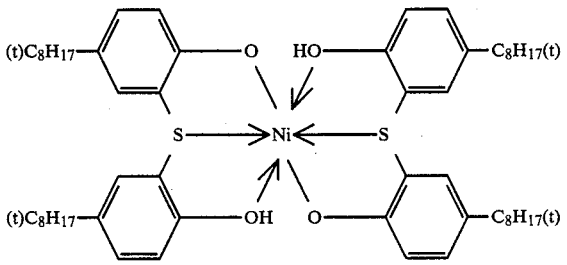
(17)
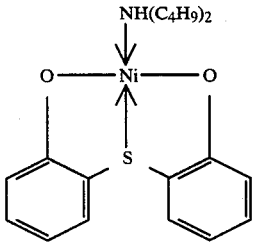

-continued
(18)
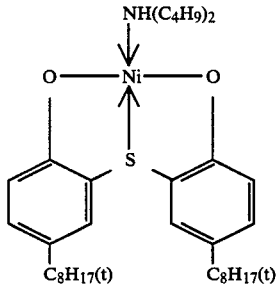
(19)
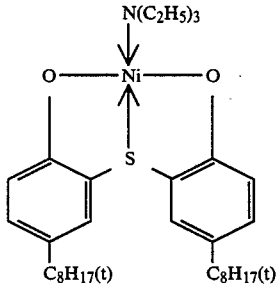
(20)
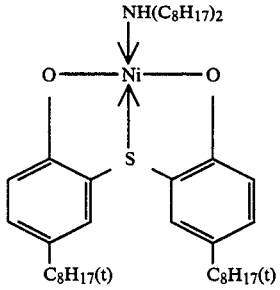
(21)
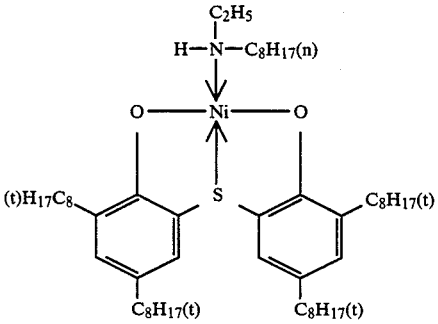
(22)
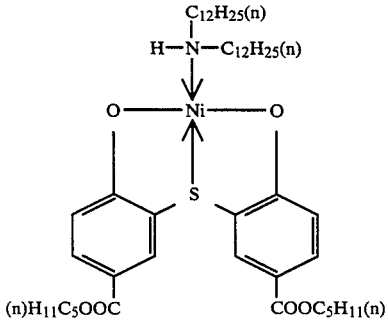

-continued
(23)
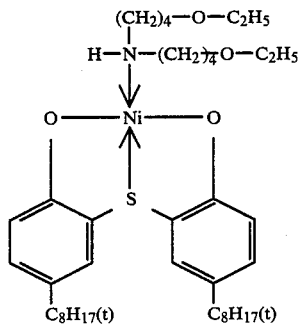
(24)
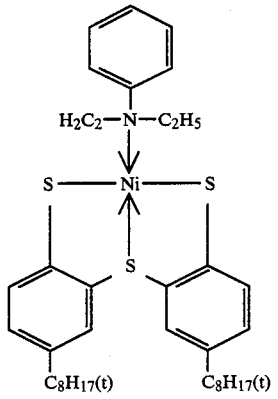
(25)
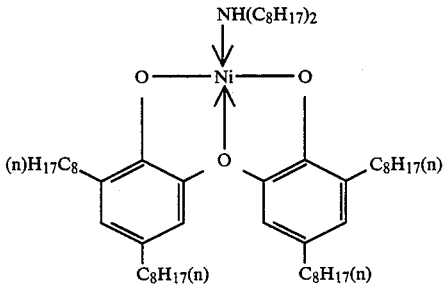
(26)
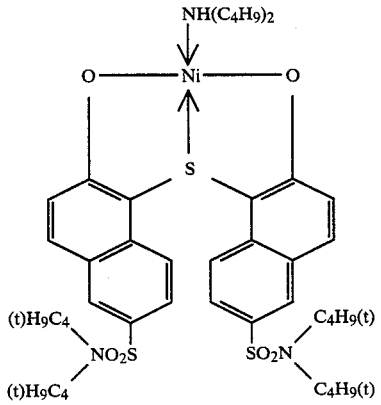

-continued
(27)
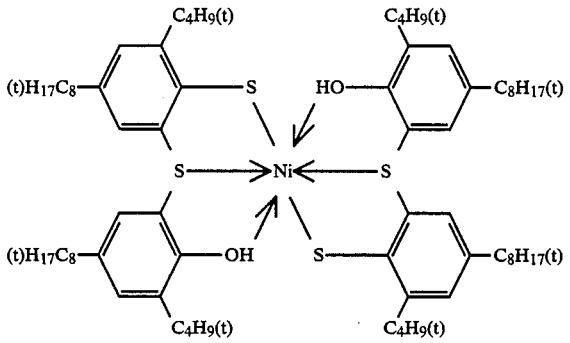
(28)
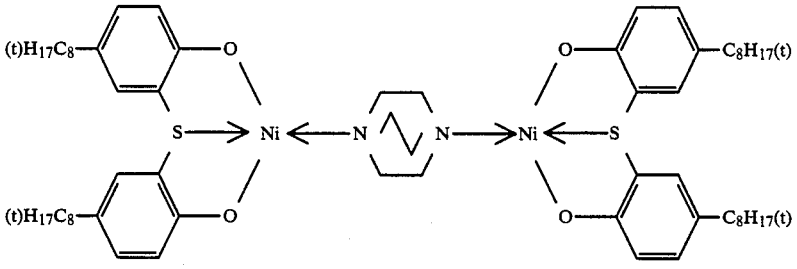
(29)
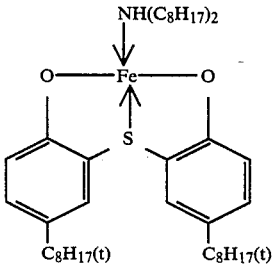
(30)
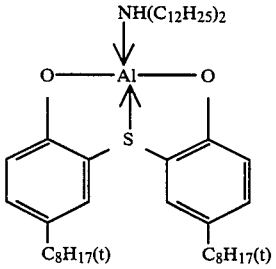
(31)
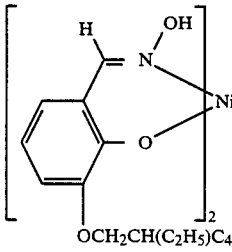

-continued
(32)
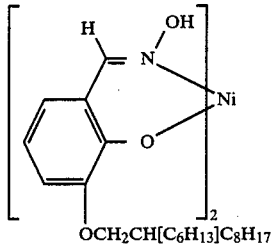
(33)
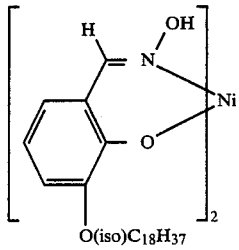
(34)
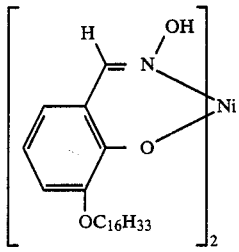
(35)
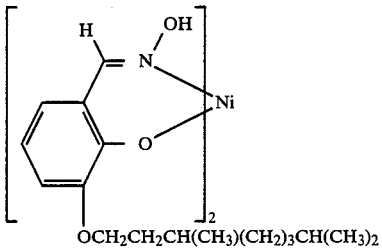
(36)
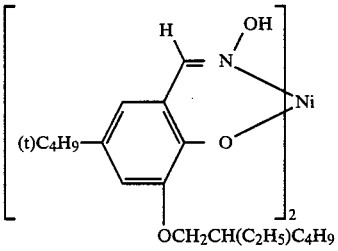
(37)
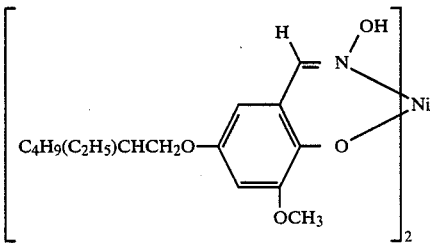

-continued
(38)
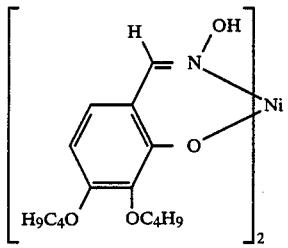
(39)
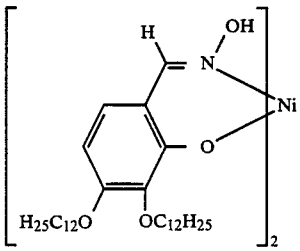
(40)
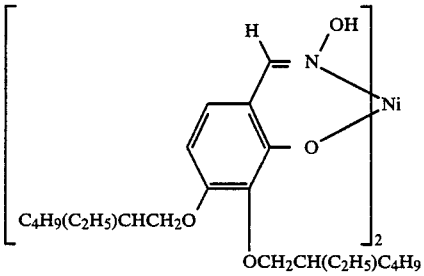
(41)
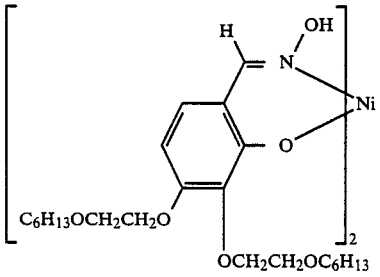
(42)
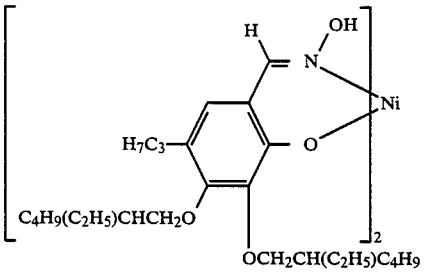
(43)
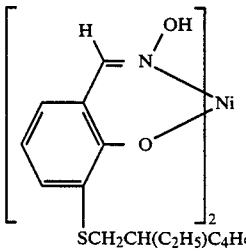

-continued
(44)
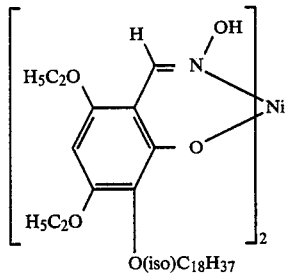
(45)
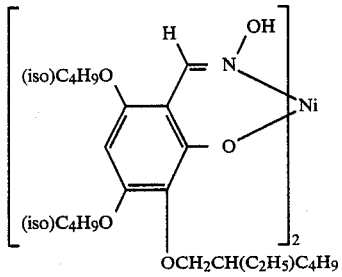
(46)
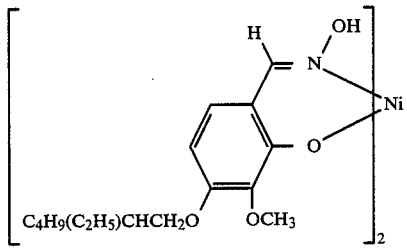
(47)
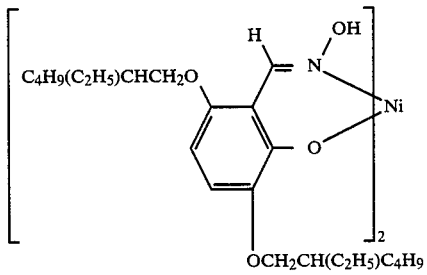
(48)
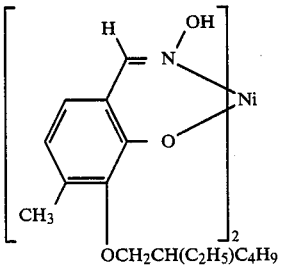

-continued
(49)
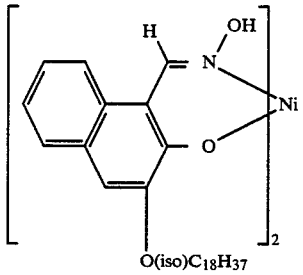
(50)
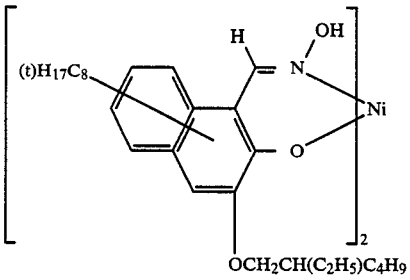
(51)
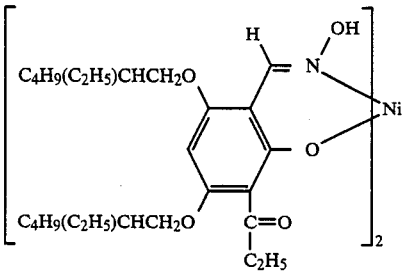
(52)
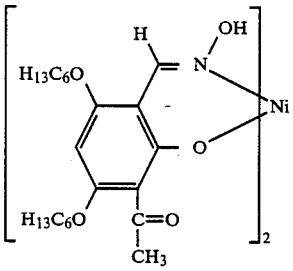
(53)
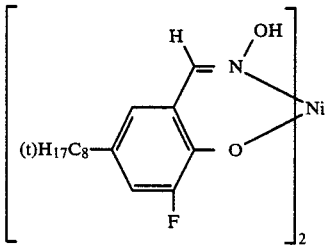

-continued
(54)
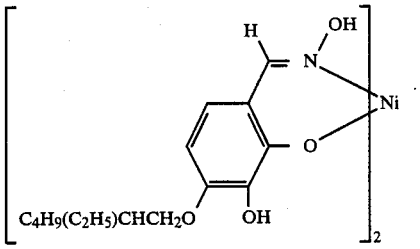
(55)
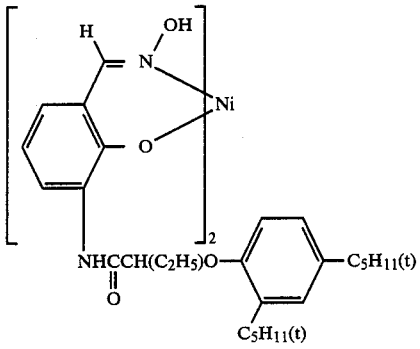
(56)
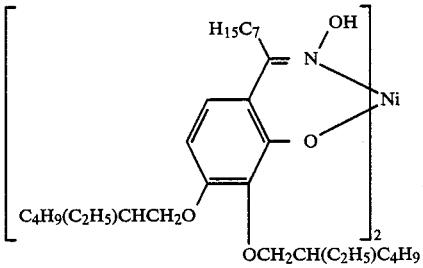
(57)
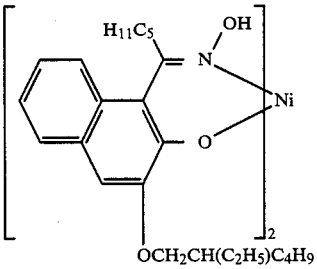
(58)
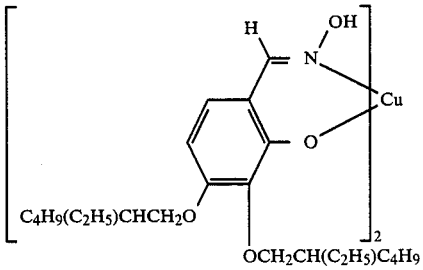

-continued
(59)
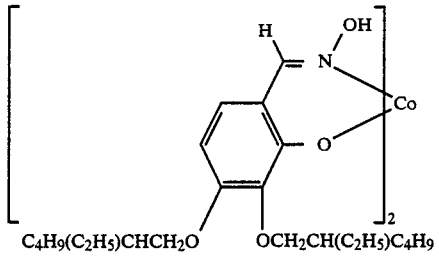
(60)
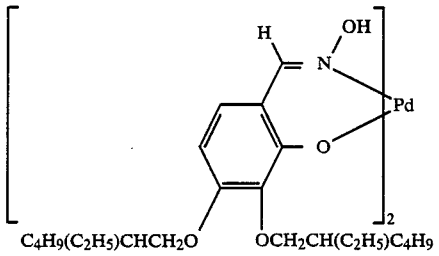
(61)
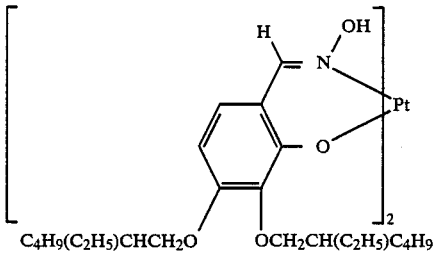
(62)
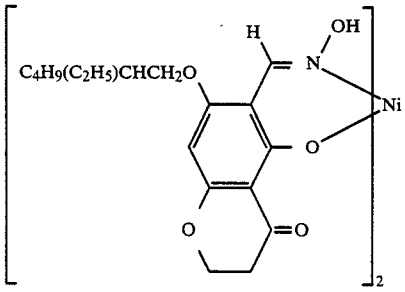
(63)
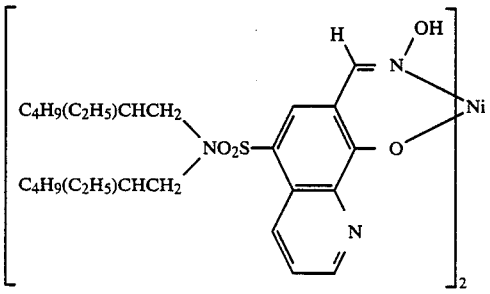

-continued
(64)
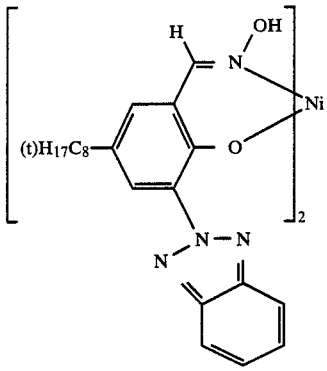
(65)
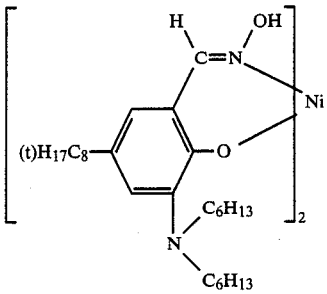
(66)
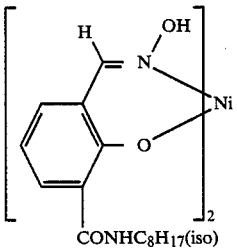
(67)
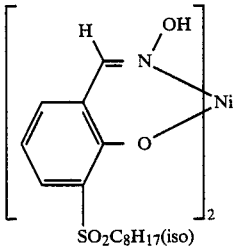
(68)
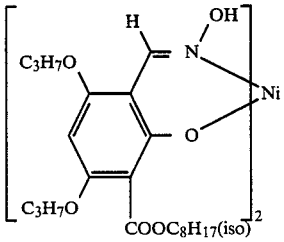

-continued
(69)
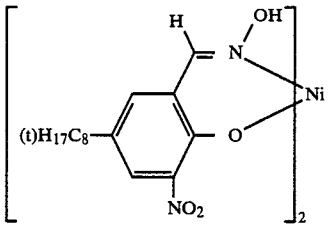
(70)
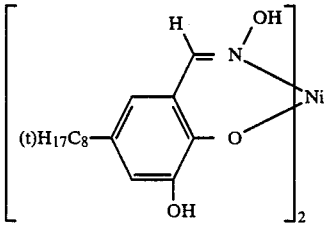
(71)
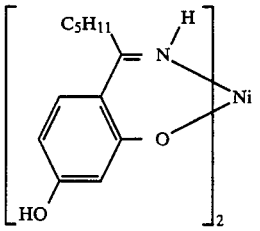
(72)
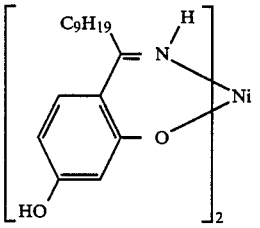
(73)
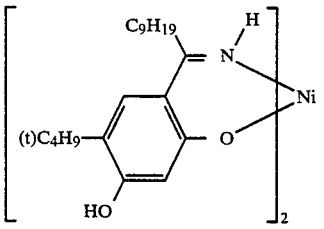
(74)
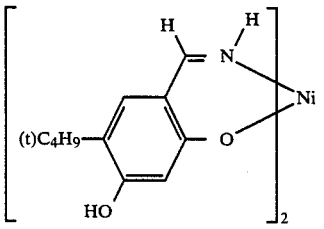

-continued
(75)
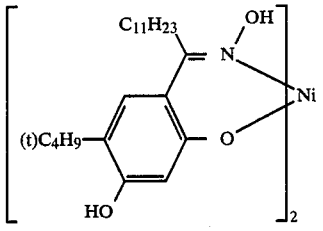
(76)
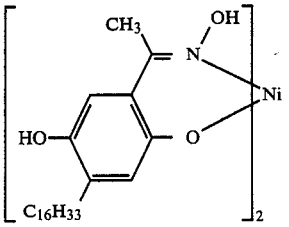
(77)
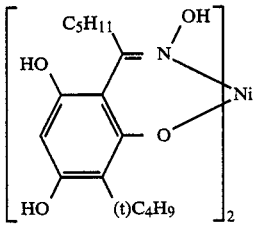
(78)
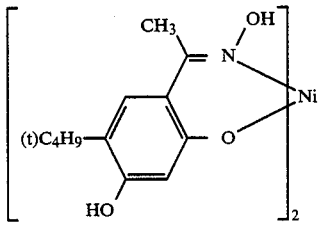
(79)
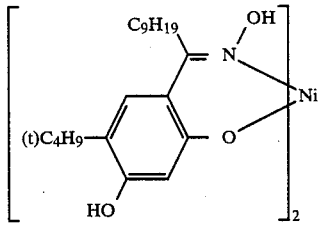
(80)
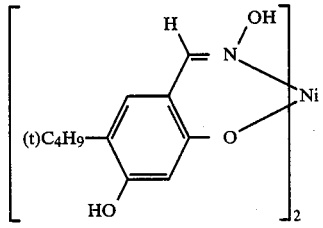

-continued
(81)
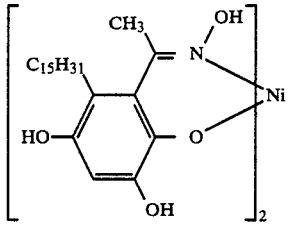
(82)
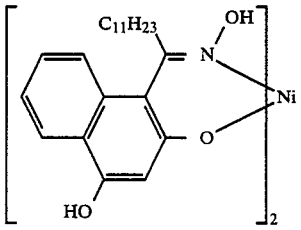
(83)
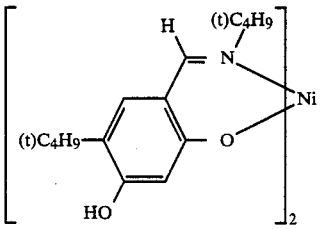
(84)
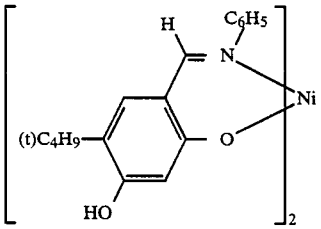
(85)
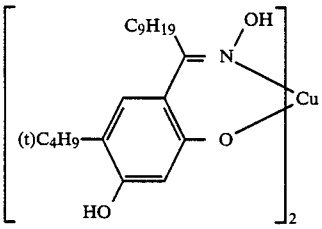
(86)
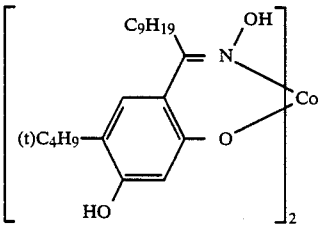

-continued
(87)
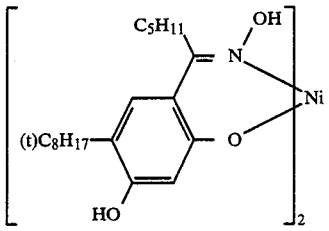
(88)
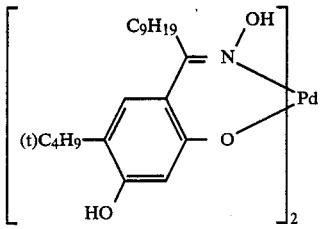
(89)
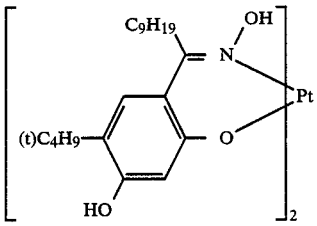
(90)
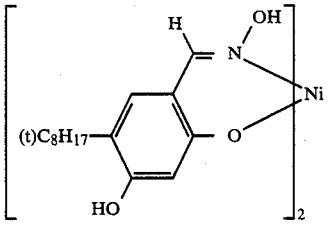
(91)
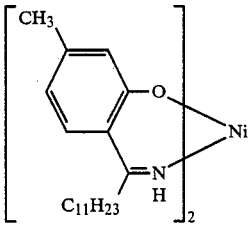
(92)
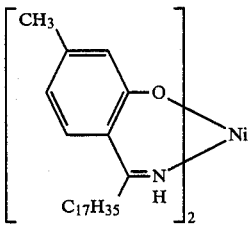
(93)
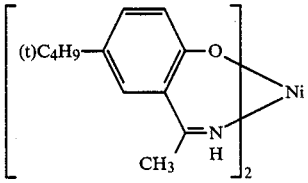

-continued
(94)
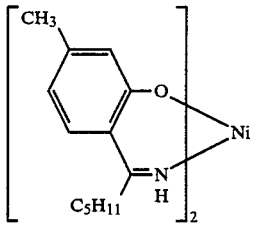
(95)
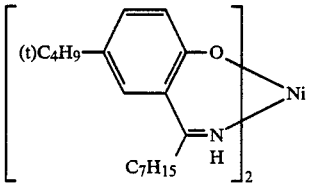
(96)
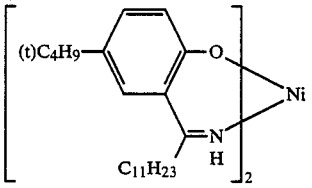
(97)
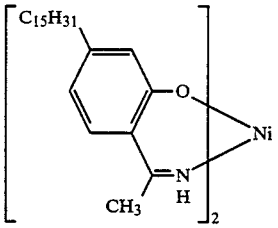
(98)
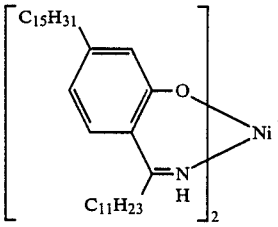
(99)
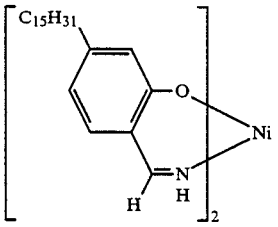
(100)
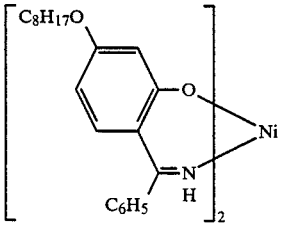

-continued
(101)
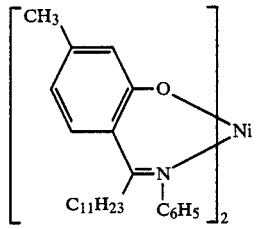
(102)
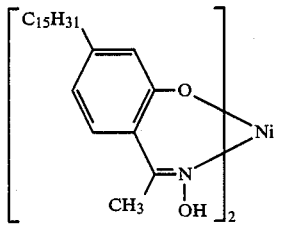
(103)
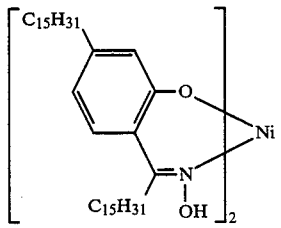
(104)
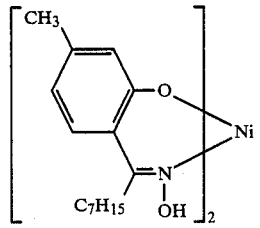
(105)
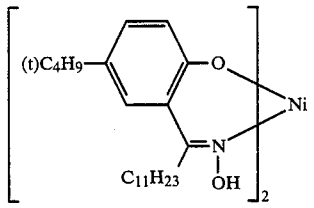
(106)
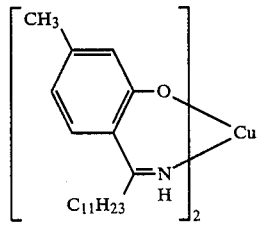

-continued
(107)
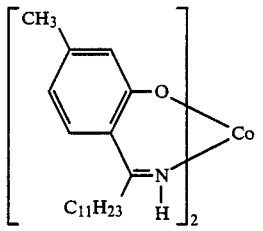
(108)
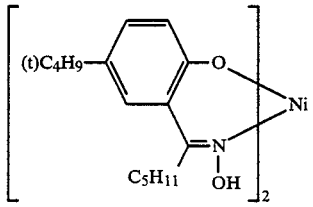
(109)
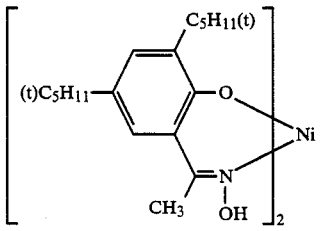
(110)
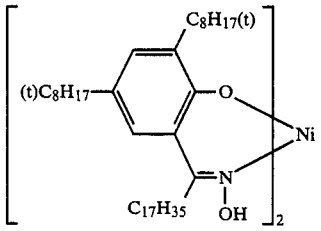
(111)
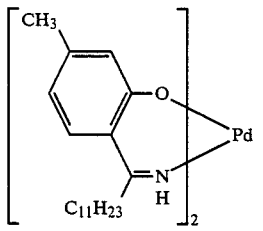
(112)
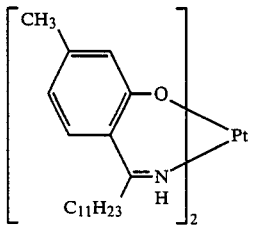

-continued
(113)
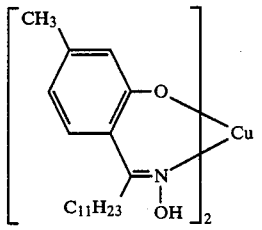
(114)
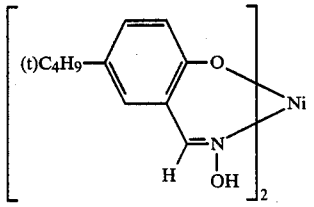
(115)
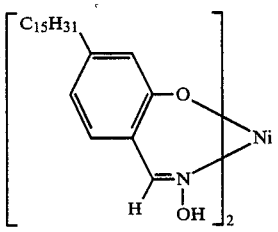
(116)
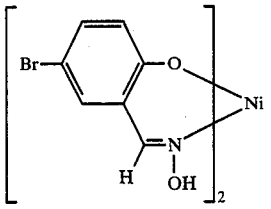
(117)
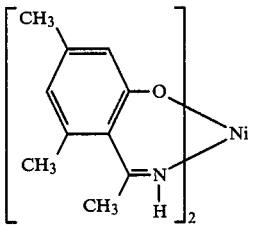
(118)
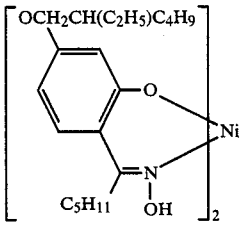
(119)
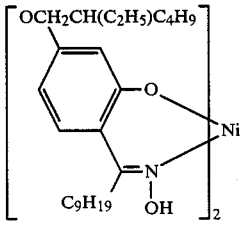

-continued
(120)
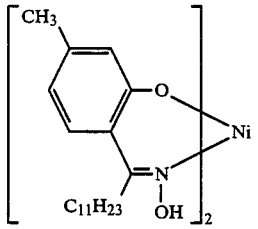
(121)
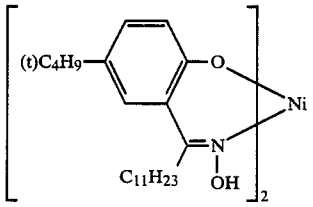
(122)
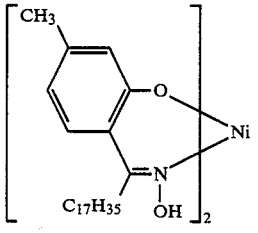
(123)
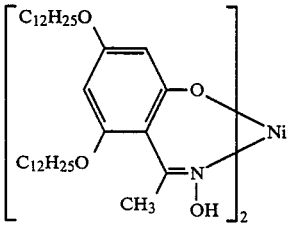
(124)
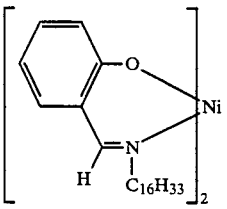
(125)
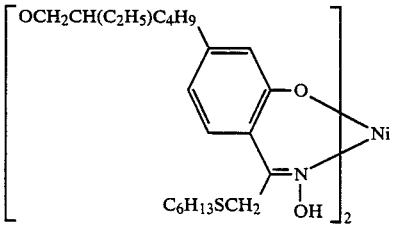

-continued
(126)
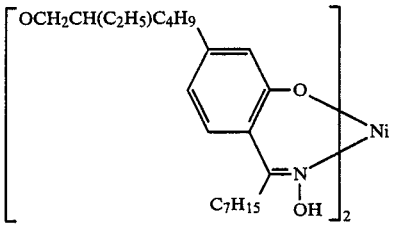
(127)
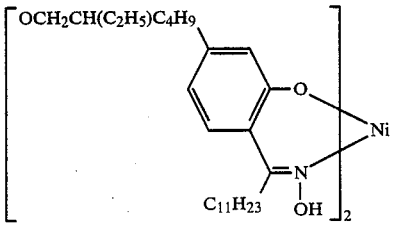
(128)
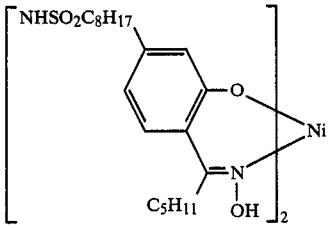
(129)
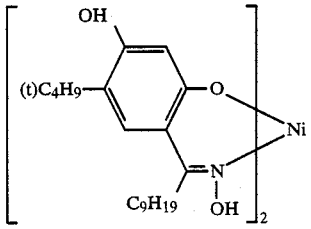
(130)
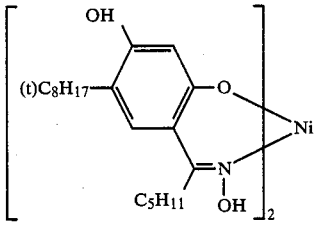
(131)
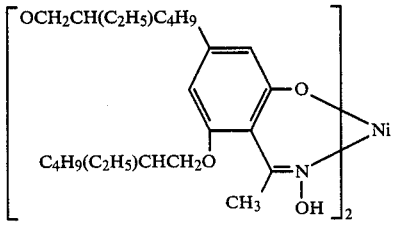

-continued
(132)
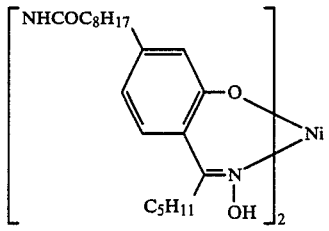
(133)
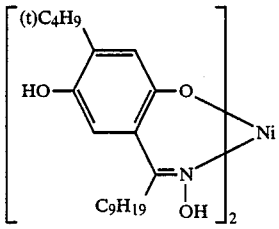
(134)
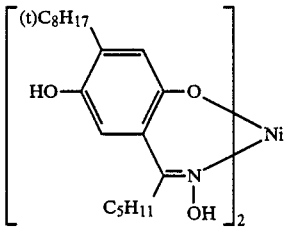
(135)
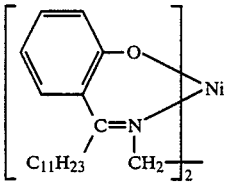
(136)
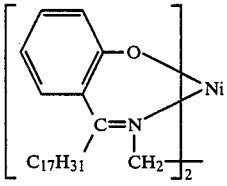
(137)
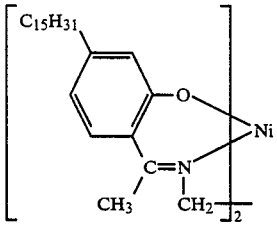
(138)
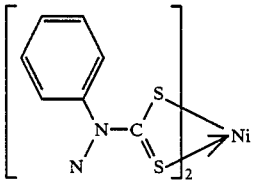

-continued
(139)
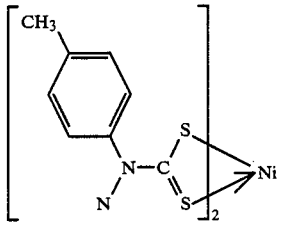
(140)
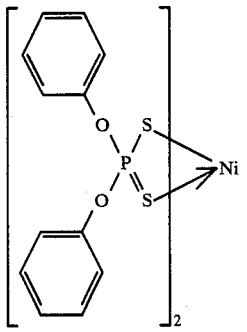
(141)
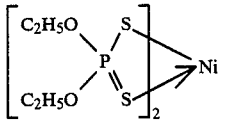
(142)
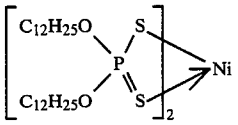
(143)
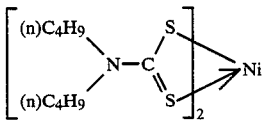
(144)
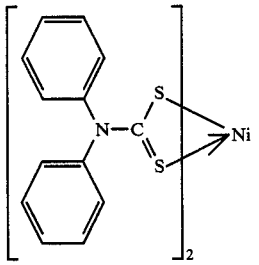
(145)
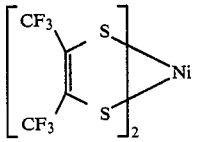

-continued (146)

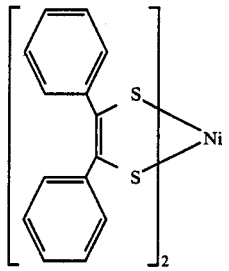

(147)

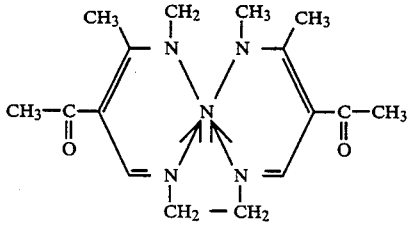

(148)

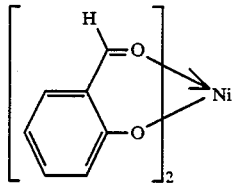

(149)

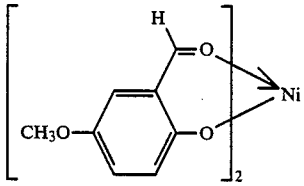

(150)

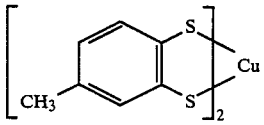

(151)

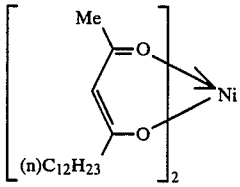

The metallic complexes expressed by the general formulas [L - I] ~[L - III], mentioned previously, can be synthesized with a method described in U.K. Patent No. 858890, West German OLS Patent No. 2042652 and others.

The metallic complexes expressed by general formula [L - IV], mentioned previously, can be synthesized with a method described in E. G. Cox, F. W. Pinkard, W. Wardlaw and K. C. Webster, Journal of Chemical Society, 1935, 459.

Though varying according to the type of a metallic complex employed and the type of a coupler employed, the amount employed of a metallic complex of the present invention is within the range of 0.1~2 mol, or, more preferably, within the range of 0.5~1 mol per mol magenta coupler which is expressed by the previously mentioned general formula [I].

The amounts employed of the compounds expressed by general formulas [XII], [XIIIa] and [XIIIb], mentioned previously, as well as the cases where a metallic complex, according to the invention, (hereinafter referred to as the metallic complex of the invention), having an optical quenching rate constant of a singlet oxygen more than $3\times10^7.M^{-1}$ are described below.

In the case where the three contents, that is, a metallic complex of the invention, a compound expressed by the previously mentioned general formula [XII] and a compound expressed by the previously mentioned general formula [XIIIb], are combinedly employed, each favorable amount employed is, respectively, 0.1~1 mol, 0.5~2 mol and 1~2 mol per mol magenta coupler, according to the invention.

When the four contents, that is, a metallic complex of the invention, compounds expressed by the previously mentioned general formulas [XII], [XIIIa] and [XIIIb], are simultaneously employed, each favorable amount employed is, respectively, 0.1~1 mol, 0.5~2 mol, 1~2 mol and 1~2 mol per mol magenta coupler of the invention.

Additionally, these image stabilizers may be employed in combination with another type of image stabilizer. The stabilizers whose combined employment is preferable are those expressed by the following general formulas [A], [J] and [K].

General formula [A]

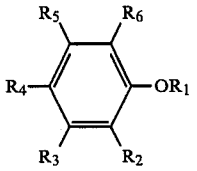

In the formula, above, $R_1$ represents a hydrogen atom, alkyl group, alkenyl group, aryl group or heterocyclic group. $R_2$, $R_3$, $R_5$ and $R_6$ respectively represents any one of a hydrogen atom, halogen atom, hydroxy group, alkyl group, alkenyl group, aryl group, alcoxy group, or acylamino group. $R_4$ represents an alkyl group, hydroxy group, aryl group or alcoxy group.

Additionally, $R_1$ and $R_2$ may mutually close a ring of a counterpart, forming a 5~6-membered ring. In such a case, $R_4$ represents a hydroxy group or alcoxy group. $R_3$ and $R_4$ may mutually close a ring of a counterpart, forming a 5-membered hydrocarbon ring. In such a case, $R_1$ represents an alkyl group, aryl group or heterocyclic group. However, the latter is not applicable, if $R_1$ is a hydrogen atom, and at the same time, $R_4$ is a hydroxy group.

As a ring which $R_1$ and $R_2$ form, in combination with a benzene ring by mutually closing a ring of a counterpart, the examples such as a chroman ring, coumarane ring and methylenedioxybenzene ring are available.

As a ring which $R_3$ and $R_4$ form, in combination with a benzene ring, by mutually closing a ring of a counterpart, an indane ring, for example, is example. Such rings may have a substituent such as an alkyl group, alcoxy group and aryl group.

Additionally, the atom within a ring, which is formed by mutual closure of $R_1$ and $R_2$, or, $R_3$ and $R_4$, may be allowed to function as a spiro atom, forming a spiro compound, or, a bis compound may be formed by involving $R_2$ or $R_4$ as a bonding group.

Among phenol compounds orphenylether compounds expressed by the above-mentioned general formula [A], those favorable are biindane compounds having four RO- groups (R represents an alkyl group, alkenyl group, aryl group or heterocyclic group), and, the most favorable compounds can be expressed by the following general formula [A - 1].

General formula [A-1]

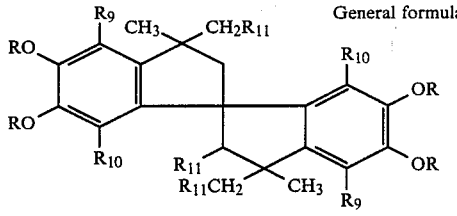

In the formula, above, R represents an alkyl group, alkenyl group, aryl group or a group represented by a heterocyclic group (for example, tetrahydropyranyl or pyrimidyl). Either $R_9$ and $R_{10}$ represents a hydrogen atom, halogen atom, alkyl group, alkenyl group or alcoxy group. $R_{11}$ represents a hydrogen atom, alkyl group or alkenyl group.

The compounds expressed by the general formula [A], described previously, include those disclosed in U.S. Pat. Nos. 3,935,016, 3,982,944 and 4,254,216, Japanese Patent O.P.I. Publication Nos. 21004/1980 and 145530/1979, U.K. Patent Laid-Open Publication Nos. 2077455 and 2062888, U.S. Pat. Nos. 3,764,337, 3,432,300, 3,574,627 and 3,573,050, Japanese Patent O.P.I. Publication Nos. 152225/1977, 20327/1978, 17729/1978 and 6321/1980, U.K. Patent No. 1347556, U.K. Patent Laid-Open Publication No. 2066975, Japanese Patent Examined Publication Nos. 12337/1979 and 31625/1973, U.S. Pat. No. 3,700,455 and others.

The amount employed of a compound expressed by the general formula [A], mentioned previously, is preferably 5~300 mol %, or, more preferably, 10~200 mol % per 100 mol % magenta coupler.

The typical examples for the compounds expressed by the general formula [A] are as follows.

Type (1)

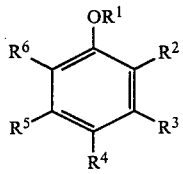

Type (2)

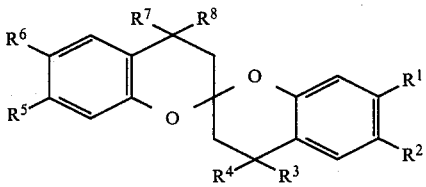

Type (3)

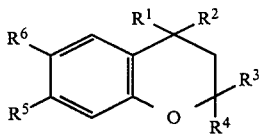

Type (4)

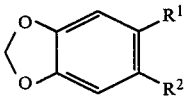

Type (5)

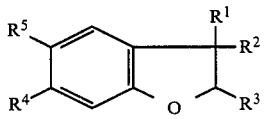

-continued

Type (6)

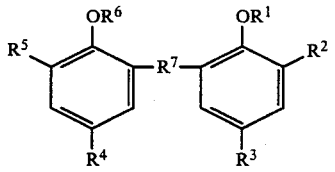

Type (7)

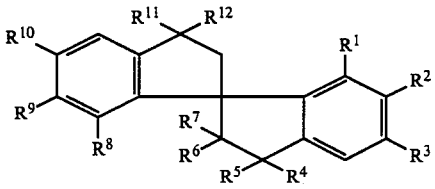

Type (4)

| Compound No. | $R^1$ | $R^2$ |
|---|---|---|
| A-4 | $C_3H_7$ | 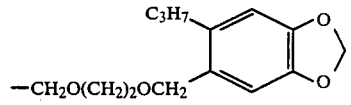 |
| A-9 | $C_3H_7$ | $-CH_2O(CH_2)_2OC_4H_9$ |

Type (5)

| Compound No. | $R^1$ | $R^2$ | $R^3$ | $R^4$ | $R^5$ |
|---|---|---|---|---|---|
| A-5 | $CH_3$ | $CH_3$ | $C_2H_5O$ | (t)$C_8H_{17}$ | OH |

Type (1)

| Compound No. | $R^1$ | $R^2$ | $R^3$ | $R^4$ | $R^5$ | $R^6$ |
|---|---|---|---|---|---|---|
| A-1 | H | OH | $-C(CH_3)_2CH_2C(CH_3)_3$ | $CH_3O$ | H | $-C(CH_3)_2CH_2C(CH_3)_3$ |
| A-8 | $C_8H_{17}$ | $C(CH_3)_2C_2H_5$ | H | $C_8H_{17}O$ | $C(CH_3)_2C_2H_5$ | H |
| A-14 | H | H | OH | $C(CH_3)_2CH_2C(CH_3)_3$ | H | H |
| A-16 | H | $C(CH_3)_2C_3H_7$ | H | $CH_3O$ | $C(CH_3)_2C_3H_7$ | H |

Type (2)

| Compound No. | $R^1$ | $R^2$ | $R^3$ | $R^4$ | $R^5$ | $R^6$ | $R^7$ | $R^8$ |
|---|---|---|---|---|---|---|---|---|
| A-2 | $CH_3$ | OH | $CH_3$ | $CH_3$ | $CH_3$ | OH | $CH_3$ | $CH_3$ |
| A-10 | $CH_3$ | $OCH_3$ | $CH_3$ | $CH_3$ | $CH_3$ | $CH_3O$ | $CH_3$ | $CH_3$ |

Type (6)

| Compound No. | $R^1$ | $R^2$ | $R^3$ | $R^4$ | $R^5$ | $R^6$ | $R^7$ |
|---|---|---|---|---|---|---|---|
| A-6 | H | (t)$C_4H_9$ | $CH_3$ | $CH_3$ | (t)$C_4H_9$ | H | $CH_2$ |
| A-15 | $CH_3$ | (t)$C_4H_9$ | $CH_3$ | $CH_3$ | (t)$C_4H_9$ | $CH_3$ | $CH_2$ |

Type (3)

| Compound No. | $R^1$ | $R^2$ | $R^3$ | $R^4$ | $R^5$ | $R^6$ |
|---|---|---|---|---|---|---|
| A-3 | $CH_3$ | $CH_3$ | H | $CH_3$ | (t)$C_8H_{17}$ | OH |
| A-11 | $CH_3$ | $CH_3$ | H | $CH_3$ | (t)$C_8H_{17}$ | $C_8H_{17}O$ |
| A-12 | $CH_3$ | $CH_3$ | H | $CH_3$ | $CH_3$ | $O(CH_2)_2OC_{10}H_{21}$ |
| A-17 | H | $CH_3$ | $CH_3$ | $CH_3$ | (t)$C_8H_{17}$ | OH |
| A-18 | $CH_3$ | $CH_3$ | $CH_3$ | 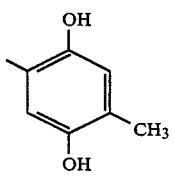 | $CH_3$ | OH |

Type (7)

| Compound No. | $R^1$ | $R^2$ | $R^3$ | $R^4$ | $R^5$ | $R^6$ | $R^7$ | $R^8$ | $R^9$ | $R^{10}$ | $R^{11}$ | $R^{12}$ |
|---|---|---|---|---|---|---|---|---|---|---|---|---|
| A-13 | H | $C_3H_7O$ | $C_3H_7O$ | $CH_3$ | $CH_3$ | H | H | H | $C_3H_7O$ | $C_3H_7O$ | $CH_3$ | $CH_3$ |
| A-19 | H | $CH_3O$ | $CH_3O$ | $CH_3$ | $CH_3$ | H | H | H | $CH_3O$ | $CH_3O$ | $CH_3$ | $CH_3$ |
| A-20 | $CH_3$ | $C_4H_9O$ | $C_4H_9O$ | $CH_3$ | $CH_3$ | H | H | $CH_3$ | $C_4H_9O$ | $C_4H_9O$ | $CH_3$ | $CH_3$ |
| A-21 | H | $C_2H_5O$ | $C_2H_5O$ | $CH_3$ | $CH_3$ | H | H | H | $C_2H_5O$ | $C_2H_5O$ | $CH_3$ | $CH_3$ |
| A-22 | H | $CH_3O$ | $CH_3O$ | $C_2H_5$ | $CH_3$ | H | $CH_3$ | H | $CH_3O$ | $CH_3O$ | $CH_3$ | $C_2H_5$ |
| A-23 | H | $C_7H_{15}COO$ | $C_7H_{15}COO$ | $CH_3$ | $CH_3$ | H | H | H | $C_7H_{15}COO$ | $C_7H_{15}COO$ | $CH_3$ | $CH_3$ |
| A-24 | H | $C_4H_9O$ | $C_4H_9O$ | $CH_3$ | $CH_3$ | H | H | H | $C_4H_9O$ | $C_4H_9O$ | $CH_3$ | $CH_3$ |
| A-25 | H | $CH_3O(CH_2)_2O$ | $CH_3O(CH_2)_2O$ | $CH_3$ | $CH_3$ | H | H | H | $CH_3O(CH_2)_2O$ | $CH_3O(CH_2)_2O$ | $CH_3$ | $CH_3$ |
| A-26 | H | $CH_2{=}CHCH_2O$ | $CH_2{=}CHCH_2O$ | $CH_3$ | $CH_3$ | H | H | H | $CH_2{=}CHCH_2O$ | $CH_2{=}CHCH_2O$ | $CH_3$ | $CH_3$ |
| A-27 | H | $C_3H_7O$ | $C_3H_7O$ | $C_6H_5CH_2$ | $CH_3$ | $C_6H_5$ | H | H | $C_3H_7O$ | $C_3H_7O$ | $C_6H_5O$ | $CH_3$ |
| A-28 | $CH_3O$ | $C_4H_9O$ | $C_4H_9O$ | $CH_3$ | $CH_3$ | H | H | $CH_3$ | $C_4H_9O$ | $C_4H_9O$ | $CH_3$ | $CH_3$ |
| A-29 | H | (s)$C_5H_{11}O$ | (s)$C_5H_{11}O$ | $CH_3$ | $CH_3$ | H | H | H | (s)$C_5H_{11}O$ | (s)$C_5H_{11}O$ | $CH_3$ | $CH_3$ |
| A-30 | H | $C_4H_9O$ | $C_4H_9O$ | (i)$C_3H_7$ | $CH_3$ | $CH_3$ | $CH_3$ | H | $C_4H_9O$ | $C_4H_9O$ | (i)$C_3H_7$ | $CH_3$ |
| A-31 | H | $C_{18}H_{37}O$ | $C_{18}H_{37}O$ | $CH_3$ | $CH_3$ | H | H | H | $C_{18}H_{37}O$ | $C_{18}H_{37}O$ | $CH_3$ | $CH_3$ |
| A-32 | H | $C_6H_5CH_2O$ | $C_6H_5CH_2O$ | $CH_3$ | $CH_3$ | H | H | H | $C_6H_5CH_2O$ | $C_6H_5CH_2O$ | $CH_3$ | $CH_3$ |

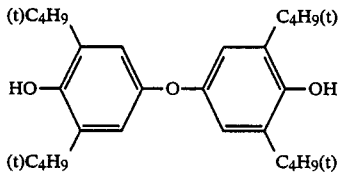

A-7

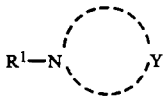

General formula [J]

[In the formula, above, $R^1$ represents an aliphatic group, cycloalkyl group or aryl group. Y represents a plurality of nonmetal atoms necessary for forming a 5~6-membered heterocycle, in combination with a nitrogen atom. However, among the nonmetal atoms including a nitrogen atom and forming the heterocycle, if there are more than two hetero atoms, at least two hetero atoms are those who do not neighbor with each other.]

The examples for an aliphatic acid expressed by $R^1$ include a saturated alkyl group which may possess a substituent and an unsaturated alkyl group which may possess a substituent.

In the general formula [J], above, Y represents a plurality of nonmetal atoms necessary for forming a 5~7-membered heterocycle, in combination with a nitrogen atom, and, at least two atoms among the nonmetal atoms including a nitrogen atom must be hetero atoms, and, additionally, these at least two hetero atoms must not neighbor with each other. If all the hetero atoms in a heterocycle within a compound expressed by the general formula [J] are in adjacency with each other, a function expected for a magenta dye image stabilizer is not fulfilled, and, such a case is undesirable.

The above-mentioned 5~7-membered heterocycle within a compound expressed by general formula [J], mentioned previously, may have a substituent.

At the same time, the 5~7-membered heterocycle may be whichever saturated or unsaturated, however, saturated heterocycle is preferred. Additionally, a benzene ring or another ring may have been condensed into the heterocycle, or, the heterocycle may form a spiro ring.

The amount employed of the compound expressed by the previously mentioned general formula [J], according to the invention, is preferably 5~300 mol %, or, more preferably, 10~200 mol % per 100 mol % magenta coupler expressed by the previously mentioned general formula [I], according to the invention.

The typical examples expressed by the general formula [J] are as follows.

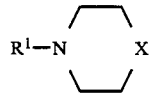

| | X | $R_1$ |
|---|---|---|
| J-1 | O | $C_{12}H_{25}$ |
| J-2 | O | $C_{14}H_{29}$ |
| J-3 | O | $C_6H_5CH{=}CH-$ |
| J-4 | O | 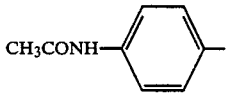 |
| J-5 | O | α-naphthyl |
| J-6 | O | 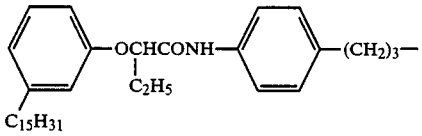 |
| J-7 | O | 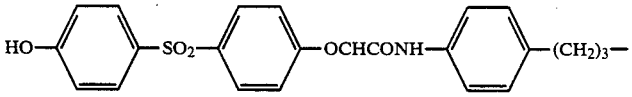 |
| J-8 | O | 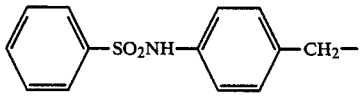 |
| J-9 | O | 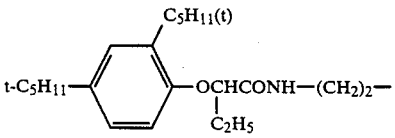 |

-continued
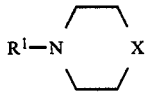
| | X | $R_1$ |
|---|---|---|
| J-10 | O | 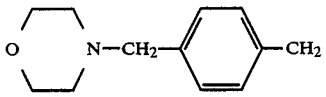 |
| J-11 | S | $C_{14}H_{29}$ |
| J-12 | S | 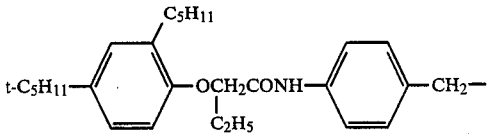 |
| J-13 | S | 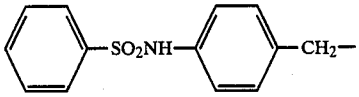 |
| J-14 | S | 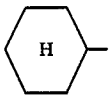 |
| J-15 | S | 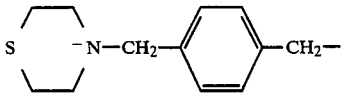 |
| J-16 | | 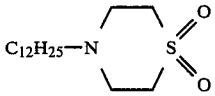 |
| J-17 | | 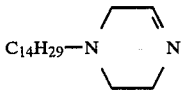 |
| J-18 | | 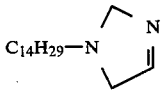 |
| J-19 | | 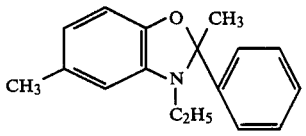 |
| J-20 | | 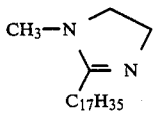 |

-continued
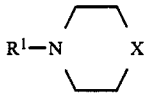
| X | $R_1$ |
|---|---|
| J-21 | 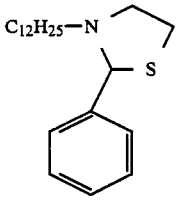 |
| J-22 | 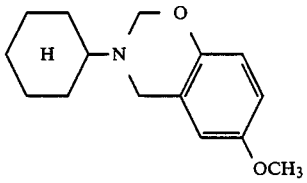 |
| J-23 | 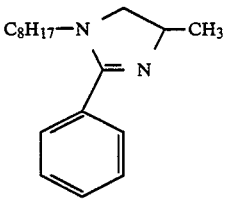 |
| J-24 | 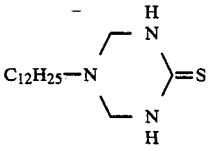 |
| J-25 | 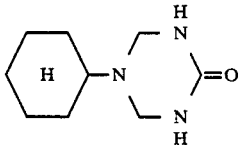 |
| J-26 | 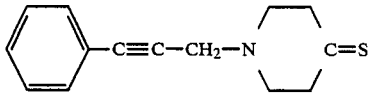 |
| J-27 | 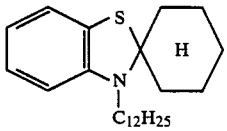 |

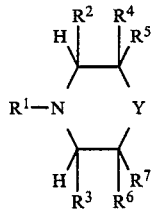

General formula [K]

In the formula, $R^1$ represents an aliphatic group, cycloalkyl group or aryl group. Y represents a mere bonding group or a bivalent hydrocarbon group necessary for forming a 5~7-membered heterocycle, in combination with a nitrogen atom. $R^2$, $R^3$, $R^4$, $R^5$, $R^6$ and R respectively represent any one of a hydrogen atom, aliphatic group, cycloalkyl group or aryl group. At the same time, $R^2$ and $R^4$, or $R^3$ and $R^6$ may couple with each other, forming a mere bonding group, so as to form an unsaturated 5~7-membered heterocycle, in combination with a nitrogen atom as well as Y. Additionally, if Y is simply a bonding group, $R^5$ and $R^7$ may couple with each other to form an unsaturated 5-membered heterocycle, in combination with a nitrogen atom as well as Y. If Y is not simply a bonding group, $R^5$ and Y, or, $R^7$, and Y, or, Y itself may form an unsaturated bond, further forming an unsaturated 6 or 7-membered heterocycle, in combination with a nitrogen atom as well as Y.

As an aliphatic group represented by $R^1$, a saturated alkyl group which may possess a substituent and an unsaturated alkyl group which may possess a substituent are available.

In the general formula [K], above, Y represents a mere bonding group or a bivalent hydrocarbon group necessary for forming a 7~7-membered heterocycle, in combination with a nitrogen atom. At the same time, if Y is simply a bonding group, $R^5$ and $R^7$ may couple with each other to form a mere bonding group, further forming an unsaturated 5-membered heterocycle, and, if Y is a bivalent hydrocarbon group, that is, a methylene group, $R^5$ and Y, or, $R^7$ and Y may form an unsaturated bond, so as to form an unsaturated 6-membered heterocycle. Additionally, if Y is an ethylene group, $R^5$ and Y, or, $R^7$, and Y, or, Y itself may form an unsaturated bond, so as to form an unsaturated 7-membered heterocycle. Further, A bivalent hydrocarbon group expressed by R may possess a substituent.

In general formula [K], mentioned previously, $R^2$, $R^3$, $R^4$, $R^5$, $R^6$ and $R^7$ respectively represent any one of a hydrogen atom, aliphatic group, cycloalkyl group or aryl group. As an aliphatic group, expressed by any of $R^2$~$R^7$, a saturated alkyl group which may possess a substituent and an unsaturated alkyl group which may possess a substituent are available.

As a compound expressed by the general formula [K], mentioned previously, one having a saturated 5~7-membered ring is preferable to one having an unsaturated ring.

The amounts employed of the following compounds expressed by the general formula [K] are within the range of 5~300 mol %, or, more preferably, 10~200 mol % per 100 mol % magenta coupler, expressed by the previously mentioned general formula [I] and employed in the invention.

The typical compounds expressed by the previously mentioned general formula [K] are later exemplified.

As the methods where a magenta coupler and a metallic complex, according to the invention, as well as image stabilizers, expressed by general formulas [XII], [IIIa] and [XIIIb], are added into a silver halide photographic light sensitive material, various methods are applicable, in addition to a method where an ordinary hydrophobic compound is employed. These methods include solid dispersion method, latex dispersion method, oil-in-water type emulsification distribution method and others. A suitable method may be selected from the examples, above, in compliance with a chemical constitution, for example, of a hydrophobic compound such as a coupler. For the oil-in-water type emulsification distribution method, various methods for distributing a hydrophobic compound such as a coupler may be applied, and, principally, a low-boiling point and/or soluble organic solvent is combinedly used, in compliance with a requirement, with a high-boiling point organic solvent having a boiling point higher than 150° C., wherein the compound is solved, which is emulsified and distributed within a hydrophilic binder such as a gelatin solution, by means of a agitator, homogenizer, colloid mill, flow jet mixer, ultrasonic wave apparatus and the like, then, the emulsion is added into a hydrophilic colloid layer which needs the emulsion. Additionally, a fluid dispersion or a process, where a low-boiling point organic solvent is removed at the same time with dispersion the emulsion, may be also incorporated.

As a high-boiling point organic solvent, those which do not react with an oxidant derived from a developing agent and have a boiling point higher than 150° C., such as a phenol derivative, phthalic ester, phosphoric ester, citric ester, benzoic ester, alkylamide, aliphatic ester, trimesic ester and others are employed.

In the present invention, the high-boiling point organic solvents preferably employed when distributing a metallic complex of the invention as well as the above-mentioned image stabilizer and others are compounds with a dielectric constant less than 6.0 and include, for example, esters such as a phthalic ester, phosphoric esters and others, organic amides, ketones, hydrocarbonic compounds and others, all of which have a dielectric constant less than 6.0. Preferably, such solvents are the high-boiling point organic solvents having a dielectric constant within the range less than 6.0 and more than 1.9 and having a vapor pressure less than 0.5 mmHg at 100° C. More preferably, such compounds are a phthalic ester or phosphoric ester contained in the high-boiling point organic solvent. Additionally, the high-boiling point organic solvent may be a mixture of more than two solvents.

The dielectric constant in respect to the present invention refers to the dielectric constant at 30° C.

As the phthalic ester advantageously employed in the invention, the similar esters expressed by the following general formula [a] should be noted.

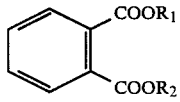

General formula [a]

In the formula, above, either $R_1$ or $R_2$ represents an alkyl group, alkenyl group or aryl group. However, the total Of carbon atoms within groups expressed by both $R_1$ and $R_2$ is 8~32, and, more preferably, 16~24.

The alkyl groups employed in the invention and expressed either by $R_1$ or $R_2$ in general formula [a], above, may be whichever straight-chained or branched type.

As the phosphoric esters advantageously employed in the invention, those expressed by the following general formula [b] are available.

General formula [b]

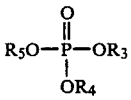

In the formula above, $R_3$, $R_4$ and $R_5$ respectively represent any one of an alkyl group, alkenyl group or aryl group. However, the total of carbon atoms contained in those expressed by $R_3$, $R_4$ and $R_5$ is 24~54. The following are the typical examples for the organic solvents employed in the invention, however, the scope of the invention is not limited only to these examples.

Exemplified organic solvents

S-1

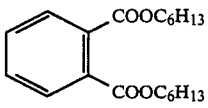

S-2

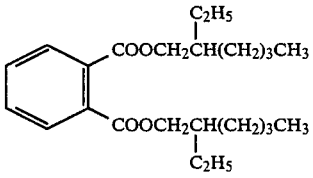

S-3

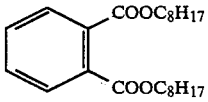

S-4

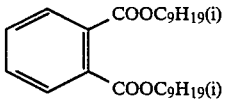

S-5

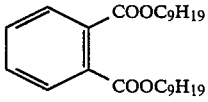

S-6

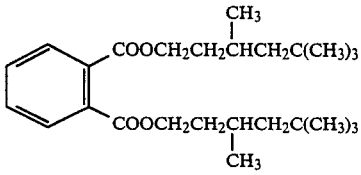

S-7

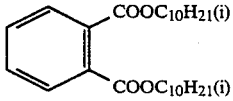

S-8

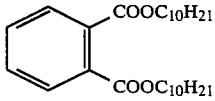

-continued

Exemplified organic solvents

S-9

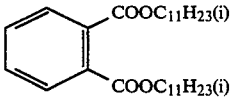

S-10

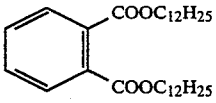

S-11

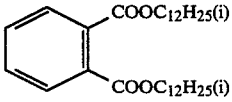

These organic solvents are employed, principally, at the rate of 5~100 weight %, and, preferably, 30~80 weight % per the total amount representing at least one compound selected from the metallic complexes of the invention, the compounds expressed by the previously mentioned general formula [XII] as well as the compounds expressed by the previously mentioned general formulas [XIIIa] and [XIIIb]. Additionally, the magenta coupler of the invention should be preferably employed in a silver halide photographic light sensitive material by using such organic solvents in addition to a metallic complex as well as the above-mentioned image stabilizer.

As an dispersion auxiliary used when solving a hydrophobic compound such as a coupler and others into the solvent solely comprizing a high-boiling point solvent or containing both high-boiling point and low-boiling point solvents, and, then, dispersing the compound, above, into water mechanically or by means of ultrasonic, an anion surface active agent, nonionic surface active agent and cation surface active agent can be employed.

The silver halide photographic light sensitive materials can be, for example, those for color negative film, color positive film and color photographic paper, however, especially in the case of a color photographic paper which is appreciated by human eyes, the effect of the method, according to the invention, is effectively attained.

The silver halide photographic light sensitive materials, including the color photographic paper, above, can be whichever monochromatic or multi-colored. In principal, a multicolored silver halide photographic light sensitive material has, in order to provide a subtractive color reproduction, a constitution wherein silver halide emulsion layers containing magenta, yellow and cyan couplers serving as photographic couplers as well as non-light sensitive layers are laminated on a support in an adequate number and order, however, the number and order may be arbitrarily modified in compliance with the important performance and utilization purposes.

For the silver halide emulsions employed in the silver photographic light sensitive materials of the invention, any of the silver halides, contained in ordinary silver halide emulsions and containing silver bromide, silver iodo-bromide, silver iodo-chloride, silver chloro-bromide, silver chloride and the like, may be arbitrarily employed.

The silver halide grains employed in the silver halide emulsions may be obtained through whichever an acid process, neutral process or ammonium process. The grains may be allowed to grow at once or may be allowed to develop after forming seed grains. The two methods to form seed grains and to grow grains may be whichever same or different.

In preparing a silver halide emulsion, both halide ions and silver ions may be simultaneously added into an emulsion, or, halide ions may be added into an emulsion containing only silver ions, or, vice versa. Additionally, considering the critical growth rate of a silver halide crystal, the halide ions and the silver ions may be added into a mixing kiln whichever consecutively or simultaneously while controlling the pH and pAg values within the kiln, so as to generate the silver halide crystals. After the crystals have grown up, the silver halide constitution within the grains may be transformed by means of a conversion process.

During the course of the production of the silver halide of the invention, the size, configuration, size distribution and growth of silver halide grains may be controlled by, if so required, employing a silver halide solvent.

With the silver halide grains employed in the silver halide emulsion layer of the invention, while the grains are formed and/or developed, the interior and/or surface of the grains are allowed to contain metallic ions, by employing a cadmium salt, zinc salt, lead salt, thallium salt, iridium salt or complex salt, rhodium salt or complex salt, iron salt or complex salt, and, the interior and/or surface of the grains may be endowed with reducing sensitization cores by placing the grains under an adequate reducing atmosphere.

Unnecessary soluble salts may be whichever removed from or remained in the silver halide emulsion of the invention after silver halide grains have satisfactorily grown. If the salts are removed, the removal can be exercised by following the method mentioned in Research Disclosure No. 17643.

The interior and the surface of a silver halide grain employed in a silver halide emulsion, according to the invention, may be whichever of the identical layer or difference layers.

The silver halide grains employed in the silver halide emulsion of the invention may be the grains wherein a latent image is principally formed whichever on the surface thereof or in the interior thereof.

The silver halide grains employed in the silver halide emulsion of the invention may be the grains having whichever regular crystals or irregular crystals such as circular or sheet-shaped. Among such grains, the proportion between [100]-faced and [101]-faced crystals may be arbitrarily selected. Additionally, such grains may have composites between the crystal configurations, above, or contain grains of various crystal configurations.

More than two of separately prepared silver halide emulsions may be mixed to prepare the silver halide emulsion, according to the invention.

A silver halide emulsion of the invention is chemically sensitized with a conventional method. More specifically, a sulfur sensitization method where a compound or activated gelatin containing sulfur and can react with silver ions, a selenium sensitization method involving a selenium compound, a reducing sensitization method involving a reducing substance, a noble metal sensitization method involving gold and other noble metals and other methods may be independently or combinedly employed.

A silver halide emulsion of the invention can be optically sensitized to the desirable wavelength range by employing a dye known as a sensitizing dye in the photographic art. The sensitizing dyes may be whichever independently or combinedly employed. The emulsion may allowed to contain, in addition to a sensitizing dye, a supersensitizer which is a dye not having a light-sensitization capability or a compound not actually absorbing visible radiation and serving to enhance a sensitization function of the sensitization dye.

Into a silver halide emulsion of the invention may be added a compound, known as an anti-fogging agent or a stabilizer in the photographic art, during and/or at the completion of the chemical ripening of a light sensitive material and/or after the chemical ripening before the coating of a silver halide emulsion, in order to prevent the fogging of the light sensitive material during the preparation, storage and photographic treatment of the similar material.

It is advantageous to use gelatin as a binder (or, a protective colloid) of the silver halide emulsion, according to the invention. Other than this material, above, a gelatin derivative, graft polymer between gelatin and another high polymer, protein, sugar derivative, cellulose derivative, or a hydrophilic colloid derived from synthesized high polymer compound such as a monomer or copolymer may be also employed.

The photographic emulsion layers containing silver halide emulsion of the invention as well as other hydrophilic colloid layers may be hardened by independently or combinedly employing hardeners which bridge binder (or, a protective colloid) molecules so as to enhance the fastness of the layers. The amount of hardeners should be so much as to harden the light sensitive material and to the extent that the addition of hardener into processing solutions is not required, however, the addition of the hardener into the processing solutions is also allowable.

In order to improve the plasticity of the silver halide emulsion layers containing light sensitive materials involving silver halide emulsion of the invention and/or other hydrophilic colloid layers, the similar layers may be allowed to have a plasticizer, and, the silver halide emulsion layers containing light sensitive materials involving silver halide emulsion of the invention and other hydrophilic colloid layers are allowed to contain a material (latex) wherein an unsoluble or slightly soluble synthesized polymer is dispersed so as to improve the dimension stability and other properties.

In the emulsion layers of a silver halide color photographic material, a dye forming coupler is employed, and, this dye forming coupler couples, during the color forming development process, with an oxidant derived from an aromatic primary amine developer (for example, a p-phenylenediam.nei derivative or aminophenol derivative and the like). Normally, the dye forming coupler is selected so that a dye which absorbs a photosensitive spectrum of an emulsion layer can form in every corresponding emulsion layer, and, in a blue-sensitive emulsion layer a yellow dye forming coupler, in a green sensitive emulsion layer a magenta dye forming coupler, in a red-sensitive emulsion layer a cyan dye forming coupler are respectively employed. However, a combination other than those mentioned above may be employed to prepare a silver halide photographic light sensitive material, in compliance with a specific purpose.

As a cyan dye forming coupler of the invention, a 4-equivalent or 2-equivalent type cyan dye forming couplers derived from phenols or naphthols are typically used, and, the specific examples of which were disclosed as follows: U.S. Pat. Nos. 2,306,410, 2,356,475, 2,362,598, 2,367,531, 2,369,929, 2,423,730, 2,474,293, 2,476,008, 2,498,466, 2,545,687, 2,728,660, 2,772,162, 2,895,826, 2,976,146, 3,002,836, 3,419,390 3,446,622, 3,476,563, 3,737,316, 3,758,308, 3,83,904; Specifications in U.K. Patent Nos. 478991, 945542, 1084480, 1377233, 1388024 and 1543040; Gazettes for Japanese Patent O.P.I. Publication Nos. 37425/1972, 10135/1975, 25228/1975, 112038/1975, 117422/1975, 130441/1975, 651/1976, 37647/1976, 52828/1976, 108841/1976, 109630/1978, 48237/1979, 66129/1979, 131931/1979 and 32071/1980.

Additionally, as a cyan dye forming coupler employed in the silver halide emulsion of the invention, those expressed by the following general formulas [C - 1] and [C - 2] are preferable.

General formula [C-1]

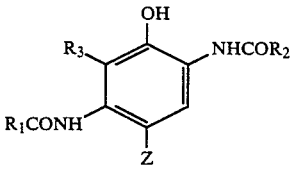

In the formula, above, $R_1$ represents either an alkyl group or aryl group. $R_2$ represents any one of an alkyl group, cycloalkyl group, aryl group or heterocyclic group. $R_3$ represents any one of a hydrogen atom, halogen atom, alkyl group or alkoxy group. Additionally, $R_3$ and $R_1$ may combine with each other to form a ring. Z represents a hydrogen atom or a group which may split off by the reaction with an oxidant derived from an aromatic primary amine color forming developing agent.

General formula [C-2]

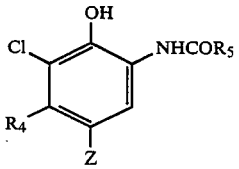

In the formula, above, $R_4$ represents a straight-chained or branched alkyl group containing 1~4, or, preferably, 2~4 carbon atoms. $R^5$ represents a ballast group. Z has the same meanings as Z in general formula [C - 2]. $R_4$ is, most favorable, a straight-chained or branched alkyl group containing 2~4 carbon atoms.

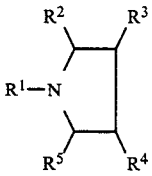

| | $R^1$ | $R^2$ | $R^3$ | $R^4$ | $R^5$ |
|---|---|---|---|---|---|
| K-1 | $C_8H_{17}$ | H | H | H | H |
| K-2 | 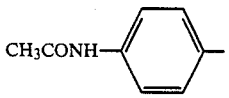 | H | H | H | H |
| K-3 | 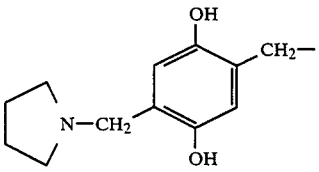 | H | H | H | H |
| K-4 | $C_{12}H_{25}$ | H | H | H | H |
| K-5 | $C_{14}H_{29}$ | H | H | H | H |
| K-6 | $C_{16}H_{33}$ | H | H | H | H |
| K-7 | $C_{14}H_{29}$ | H | 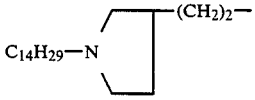 | H | H |
| K-8 | 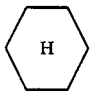 | $CH_3$ | $CH_3$ | H | H |

-continued
| | | | | |
|---|---|---|---|---|
| K-9 | $C_6H_5CH{=}CHCH_2$— | H | H | H | H |
| K-10 | 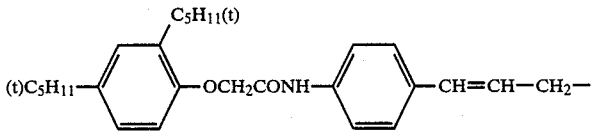 | H | H | H | H |
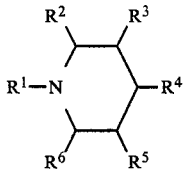
| | $R^1$ | $R^2$ | $R^3$ | $R^4$ | $R^5$ | $R^6$ |
|---|---|---|---|---|---|---|
| K-11 | (t)$C_5H_{17}$ | H | H | H | H | H |
| K-12 | 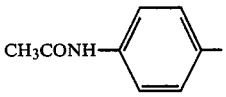 | H | H | H | H | H |
| K-13 | $C_{12}H_{25}$ | H | H | H | H | H |
| K-14 | $C_{14}H_{29}$ | H | H | H | H | H |
| K-15 | $C_{15}H_{33}$ | H | H | H | H | H |
| K-16 | $C_{14}H_{29}$ | $CH_3$ | H | H | H | H |
| K-17 | 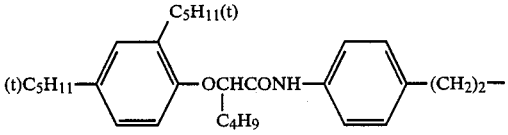 | | | H | H | H |
| K-18 | $C_8H_{17}$ | $CH_3$ | $CH_3$ | H | $CH_3$ | $CH_3$ |
| K-19 | 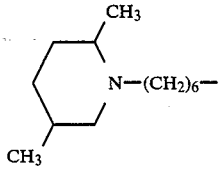 | $CH_3$ | H | H | $CH_3$ | H |
| K-20 | $CH_3$ | H | H | $C_{12}H_{25}OCOCH_2$— | H | H |
| K-21 | $CH_3$ | $CH_3$ | H | $C_{16}H_{33}OCOCH_2$— | H | $CH_3$ |
| K-22 | $CH_3$ | $C_{16}H_{33}$ | H | H | H | H |
| K-23 | $C_6H_5$ | H | H | $C_{12}H_{25}OCO$— | H | H |
| K-24 | $CH_3$ | $C_6H_5$ | H | H | H | H |
| K-25 | 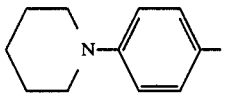 | H | H | H | H | H |
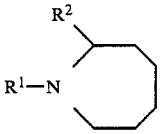
| | $R^1$ | $R^2$ |
|---|---|---|
| K-26 | $C_6H_{17}$ | H |
| K-27 | 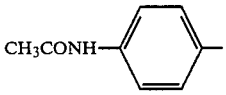 | H |

-continued
| | | |
|---|---|---|
| K-28 | 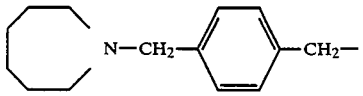 | H |
| K-29 | $C_{14}H_{29}$ | H |
| K-30 | 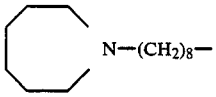 | H |
| K-31 | $C_{16}H_{33}$ | $CH_3$ |
| K-32 | 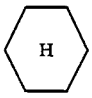 | H |
| K-33 | 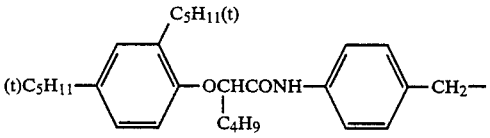 | H |
| K-34 | 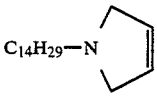 | |
| K-35 | 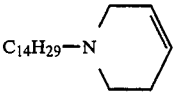 | |
| K-36 | 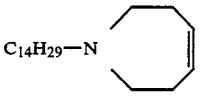 | |
| K-37 | 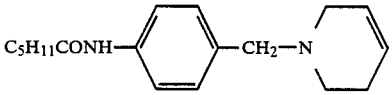 | |
| K-38 | 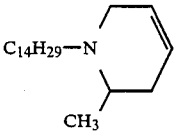 | |
| K-39 | 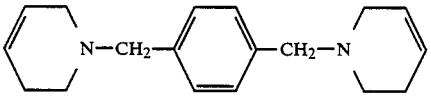 | |
| K-40 | 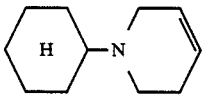 | |
| K-41 | 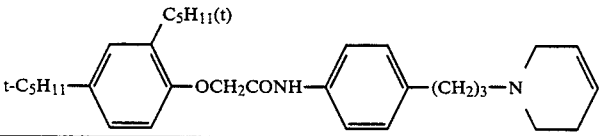 | |
Among the cyan dye forming couplers expressed by general formula [C-1], those preferred are the com-

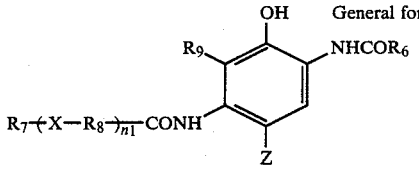

General formula [C-3]

In general formula [C-3], above, $R^6$ represents a phenyl group, which may either have a single or a plurality of substituents.

$R^5$ represents a straight-chained or branched alkylene group having 1~20, or, more preferably, 1~12 carbon atoms.

$R^9$ represents eithre a hydrogen atom or halogen atom, or, more preferably a hydrogen atom.

$n_1$ represents 0 or a positive integer, or, more preferably, either 0 or 1,

X represents one of the bivalent groups, —O—, —CO—, —COO—, —OCO—, —$SO_2$NR—, NR'$SO_2$NR"—, —S—, —SO— and —$SO_2$—. R' and R" respectively represent an alkyl group and may have a substituent. The preferable examples for X are —O—, —S—, —SO— and —$SO_2$—.

Z has the same meanings are Z in general formula [C-1].

$R_4$ is, preferably, an alkyl group having 2~4 carbon atoms.

A ballast group expressed by $R_5$ is an organic group featuring such a size and configuration as to give a coupler molecule a bulk sufficient to prevent a coupler contained within the layers supposed to hold the coupler from diffusing into the other layers.

As a typical example for such an ballast group, either an alkyl group or aryl group having total 8~32 carbona atoms should be noted.

Among the ballast groups, the favorable ones are those expressed by the following general formula [C-4].

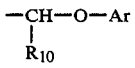

General formula [C-4]

In the formula, above, $R_{10}$ represents a hydrogen atom or an alkyl group having 1~12 carbon atoms. Ar represents an aryl group, such as a phenyl group and the like, and, such an aryl group may have a substituent.

In general formulas [C-1], [C-2] and [C-3], the examples for a group expressed by Z and is split off by the reaction with an oxidant derived from an aromatic primary amine color developing agent are well known to those experienced in the photographic art. The typical examples include halogen atoms exemplified by a chrorine atom and a fluorine atom, and, an alkoxy group, aryloxy group, arylthio group, carbamoyloxy group, acyloxy group, sulfonyloxy group, sulfonamide group, heteroylthio group and heteroyloxy group, all of which may whichever possess or do not possess a substituent. The most favorable example for Z is whichever a hydrogen atom or chorine atom.

More precisely, these groups or atoms are described in Japanese Patent O.P.I. Publication Nos. 10135/1975, 120334/1975, 130441/1975, 48237/1979, 146828/1976, 14736/1979, 37425/1972, 123341/1975 and 95346/1973, Japanese Patent Examined Publication No. 36894/1973, U.S. Pat. Nos. 3,476,563, 3,737,316 and 3,227,551.

The typical examples for a cyan coupler expressed by general formula [C-1] are illustrated as follows, however, the scope of the present invention is not limited only to these examples.

C-1

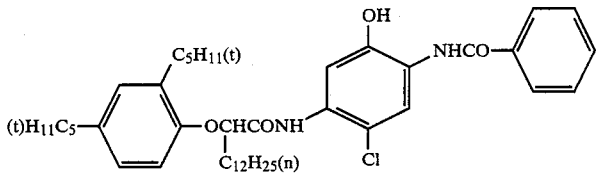

C-2

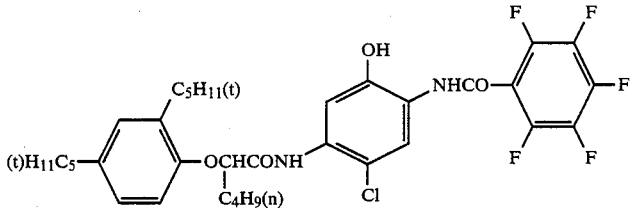

C-3

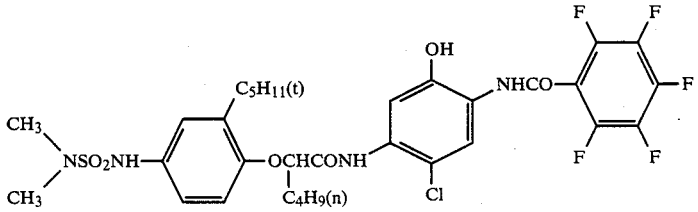

-continued
C-4
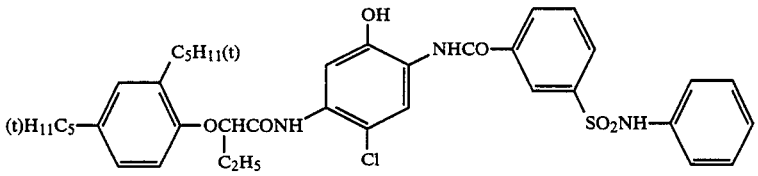
C-5
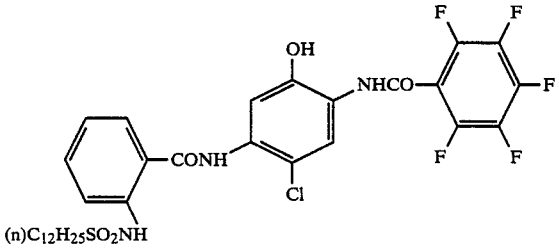
C-6
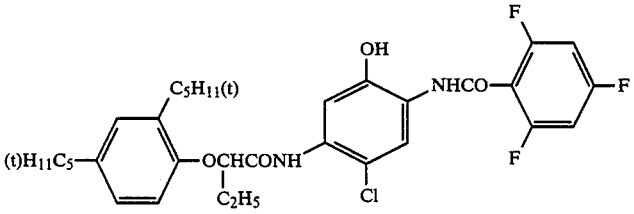
C-7
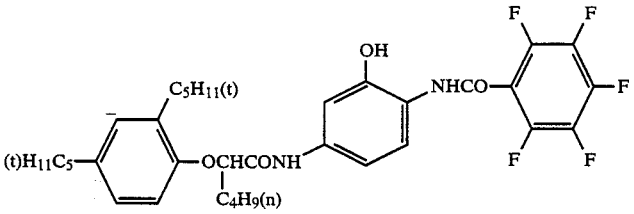
C-8
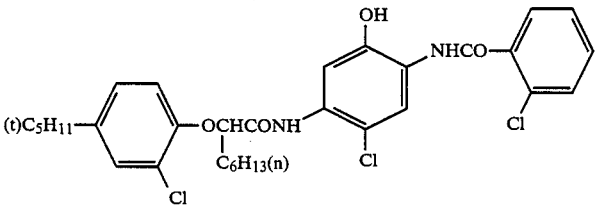
C-9
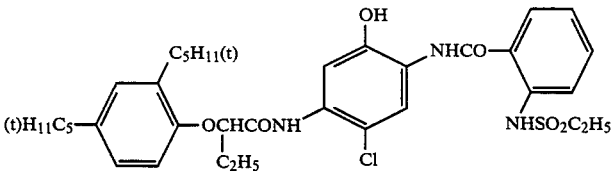
C-10
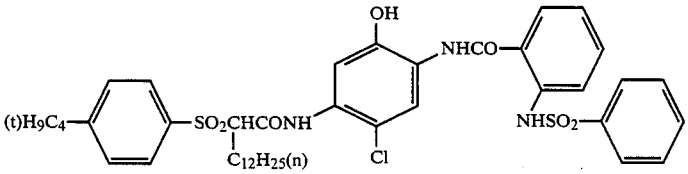

-continued
C-11
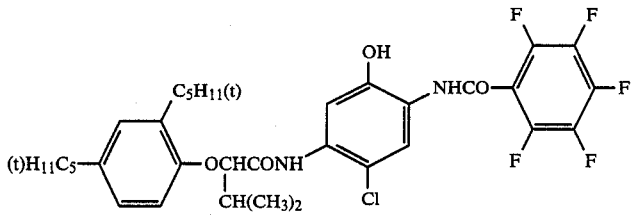
The examples for a coupler expressed by general formula [C-2] are illustrated as follows, however, the scope of the present invention is not limited only to these examples.
General formula [C-2]
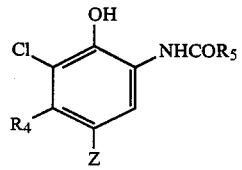
| Coupler No. | $R_4$ | Z | $R_5$ |
|---|---|---|---|
| C-11 | $-C_2H_5$ | $-Cl$ | 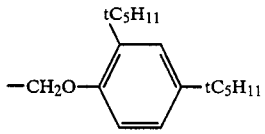 |
| C-12 | $-C_2H_5$ | 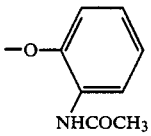 | 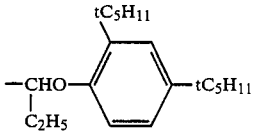 |
| C-13 | $-C_2H_5$ | $-Cl$ | 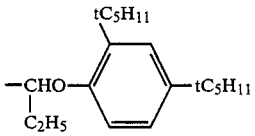 |
| C-14 | $-C_2H_5$ | $-Cl$ | 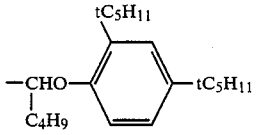 |
| C-15 | $-C_4H_9$ | $-F$ | 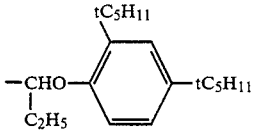 |
| C-16 | $-C_2H_5$ | $-Cl$ | 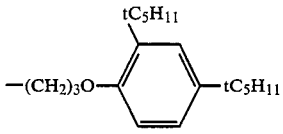 |
| C-17 | $-CH_3$ | $-Cl$ | 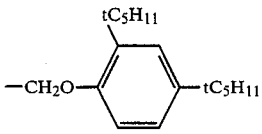 |

-continued

| Coupler No. | $R_4$ | Z | $R_5$ |
|---|---|---|---|
| C-18 | $-CH_3$ | $-Cl$ | 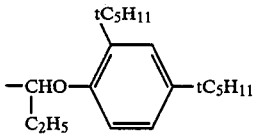 |
| C-19 | $-C_2H_5$ | $-Cl$ | 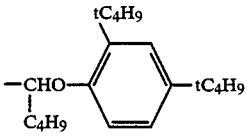 |
| C-20 | $-C_2H_5$ | $-Cl$ | 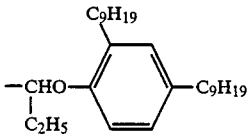 |
| C-21 | $-C_4H_9$ | 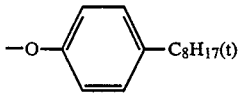 | 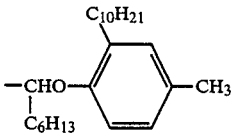 |

As a yellow dye forming coupler employed in the invention, the compounds expressed by the following general formula [Y] are preferable.

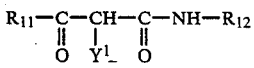

General formula [Y]

In the formula, above, $R_{11}$ represents either an alkyl group or aryl group. R12 represents an aryl group, and, $Y^1$ represents either a hydrogen atom or a group which may spilit off in the course of color development reaction.

Additionally, as a yellow dye forming coupler, the compounds expressed by the following general formula [$Y^1$] are most favored.

General formula [$Y^1$]

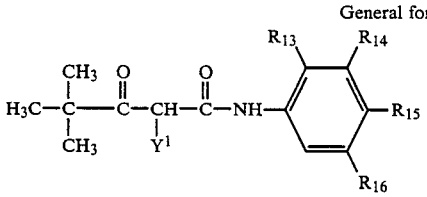

In the formula, above, $R_{13}$ represents a halogen atom, alkoxy group or aryloxy group. $R_{14}$, $R_{15}$ and $R_{16}$ respectively represents any one of a hydrogen atom, halogen, atom, alkyl group, alkenyl group, alkoxy group, aryl group, aryloxy group, carbonyl group, sulfonyl group, carboxyl group, alkoxycarbonyl group, carbamyl group, sulfon group, sulfamyl group, sulfonamide group, acylamide group, ureide group and amino group. $Y^1$ means the same as before.

These examples are described, for examples, in Specifications in U.S. Pat. Nos. 2,778,658, 2,875,057, 2,908,573, 3,227,155, 3,227,550, 3,253,924, 3,265,506, 3,277,155, 3,341,331, 3,369,895, 3,384,657, 3,408,194, 3,415,652, 3,447,928, 3,551,155, 3,582,322, 3,725,072 and 3,894,875, West German OLS Patent Nos. 1547868, 2057941, 2162899, 2163812, 2213461, 2219917, 2261361 and 2263875, Japanese Patent Examined Publication No. 13576/1974, Japanese Patent O.P.I. Publication Nos. 29432/1973, 66834/1973, 10736/1974, 122335/1974, 28834/1975 and 132926/1975.

The typical examples for a yellow dye forming coupler expressed by general formula [Y] are illustrated as follows, however, the scope of the invention is not limited only to these examples.

Y-1

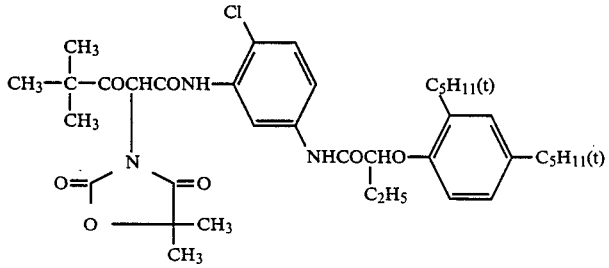

-continued
Y-2
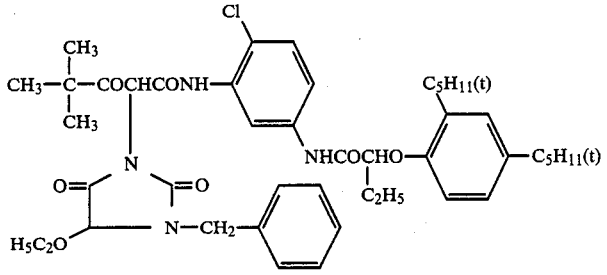
Y-3
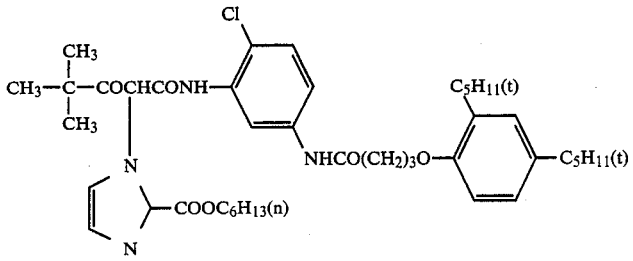
Y-4
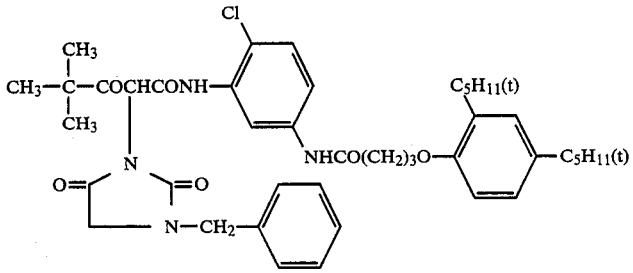
Y-5
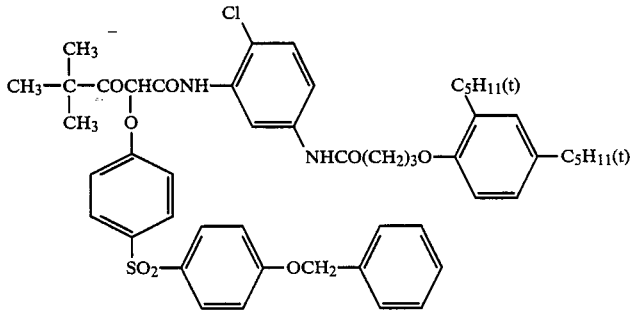
Y-6
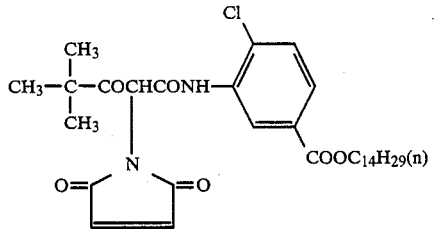
Y-7
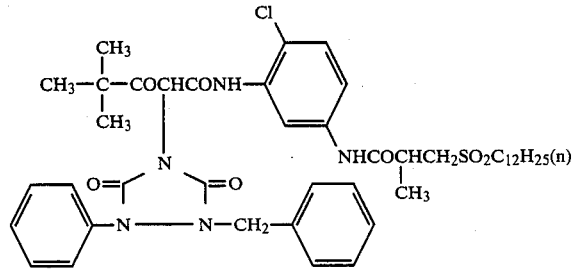

-continued

Y-8

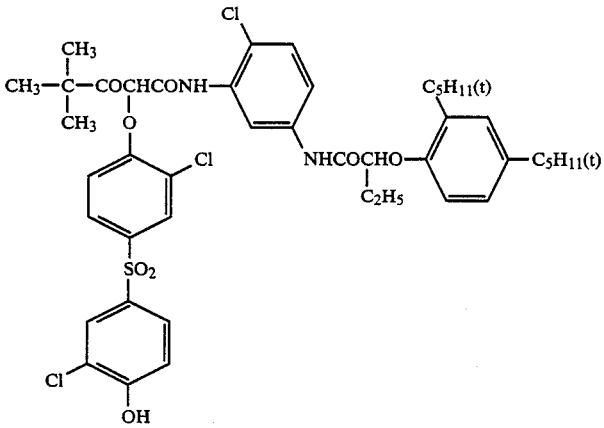

Y-9

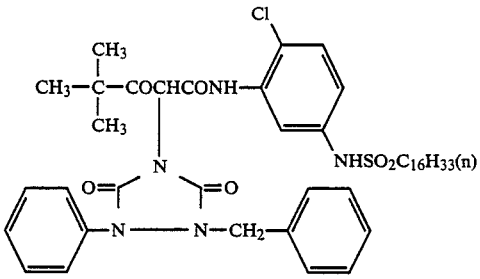

An anti-color-fogging agent is employed, in order to prevent a color stain, decrease in sharpness and outstanding graininess resulting from a transfer, from an emulsion layer to the other (from an emulsion layer to the other emulsion layer of an identical color sensitivity and/or to the layer of the different color sensitivity) within a color photographic light sensitive material of the invention, of an oxidant derived from a developing agent, or, of an electron transfer agent, an anti-color-fogging agent is employed.

The anti-color-fogging agent may be employed in emulsion layers themselves, or, intermediate layers may be provided between neighboring emulsion layers so that such intermediate layres can hold the anti-color-fogging agent.

As an anti-color-fogging agent employed in the present invention, the compounds expressed by the following general formula [HQ] are preferable.

General formula [HQ]

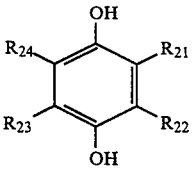

In the formula, above, $R_{21}$, $R_{22}$, $R_{23}$ and $R_{24}$ respectively represent any one of a hydrogen atom, halogen atom, alkyl group, alkenyl group, aryl group, cycloalkyl group, alkoxy group, aryloxy group, alkylthio group, arylthio group, acyl group, alkylacylamino group, arylacylamino group, alkylcarbamoyl group, arylcarbamoyl group, alkylsulfonamide group, arylsulfonamide group, alkylsulfamoyl group, arylsulfamoyl group, alkylsulfonyl group, arylsulfonyl group, nitro group, cyano group, alkyloxycarbonyl group, aryloxycarbonyl group, alkylacyloxy group and arylacyloxy group.

At least one of $R_{21}$ and $R_{22}$ is a group, mentioned above, having more than total of six carbon atoms within itself and as its substituent.

Among the compounds employed in the invention and expressed by the above general formula [HQ], the compounds expressed by the following general formula [HQ'] are more preferably used in the invention.

General formula [HQ']

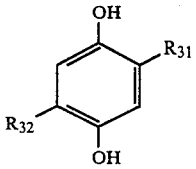

In the formula, above, either $R_{31}$ or $R_{32}$ represents a hydrogen atom, alkyl group, alkenyl group, aryl group, acyl group, cycloalkyl group or heterocyclic group. At the same time, at least one of $R_{31}$ and $R_{32}$ is a group having more than 6 carbon atoms in total.

As for such a heterocycle group, an imidazolyl group, furyl group, pyridyl group, triazolyl group and others are available.

With the above-mentioned general formula [HQ'], a compound wherein at least one group among $R_{31}$ and $R_{32}$ has more than total of 8 carbon atoms is preferred. And, more favorably, both $R_{31}$ and $R_{32}$ are groups respectively having a total of 8~18 carbon atoms, and, most favorably, both $R_{31}$ and $R_{32}$ are of an identical alkyl group having a total of 8~18 carbon atoms.

The examples for the compounds employed in the present invention and empressed by the above-mentioned general formula [HQ] are illustrated as follows, and, naturally, the scope of the invention is not limited only to these examples.
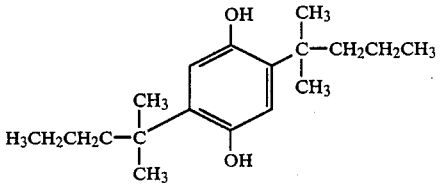
(HQ-1)
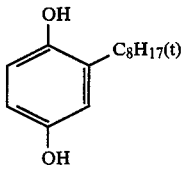
(HQ-2)
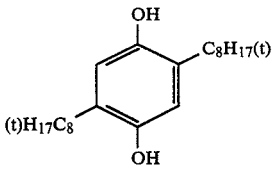
(HQ-3)
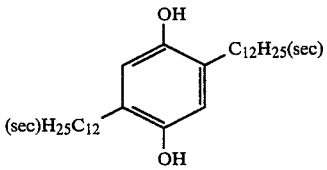
(HQ-4)
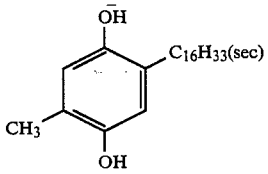
(HQ-5)
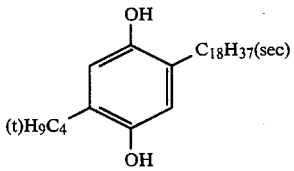
(HQ-6)
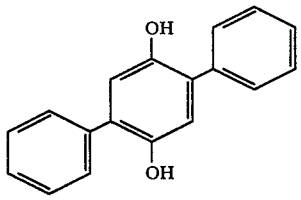
(HQ-7)
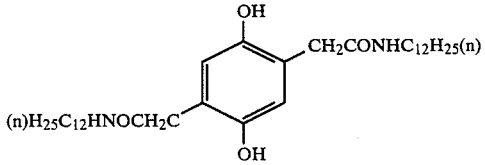
(HQ-8)

-continued

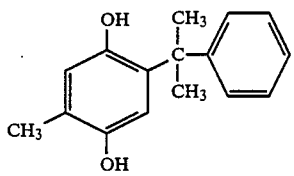

(HQ-9)

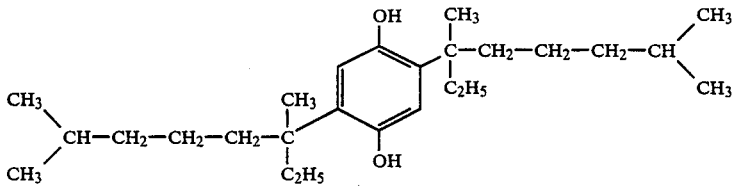

(HQ-10)

For the silver halide emulsions employed in the silver photographic light sensitive materials of the invention, any of the silver halides, contained in ordinary silver halide emulsions, such as silver bromide, silver iodobromide, silver iodo-chloride, silver chloro-bromide, silver chloride and the like may be arbitrarily employed.

With the silver halide grains employed in the silver halide emulsion layer of the invention, while the grains are formed and/or developed, the interior and/or surface of the grains are allowed to contain metallic ions, by employing a cadmium salt, zinc salt, lead salt, thallium salt, iridum salt or complex salt, rhodium salt or complex salt, iron salt or complex salt, and, the interior and/or surface of the grains may be endowed with reducing sensitization cores by placing the grains under an adequate reducing atmosphere.

Unnecessary soluble salts may be whichever removed from or remained in the silver halide emulsion of the invention after silver halide grains have satisfactorily grown. If the salts are removed, the removal can be exercised by following the method mentioned in Research Disclosure No. 17643.

The silver halide grains employed in the silver halide emulsion of the invention may be the grains having whichever regular crystals or irregular crystals such as circular or sheet-shaped.

A silver halide emulsion of the invention is chemically sensitized with a conventional method.

A silver halide emulsion of the invention can be optically sensitized to the required wavelength range by employing a dye known as a sensitizing dye in the photographic art. The sensitizing dyes may be whichever independently or combinedly employed. The emulsion may allowed to contain, in addition to a sensitizing dye, a supersensitizer which is a dye not having a light-sensitization capability or a compound not actually absorbing visible radiation and serving to enhance a sensitization function of the sensitization dye.

Into a silver halide emulsion of the invention may be added a compound, known as an anti-fogging agent or a stabilizer in the photographic art, during and/or at the completion of the chemical ripening of a light sensitive material and/or after the chemical ripening before the coating of a silver halide emulsion, in order to prevent the fogging of the light sensitive material during the preparation, storage and photographic treatment of the similar material.

In a silver halide photographic light sensitive material may be provided with auxiliary layers such as a filter layer, anti-hallation layer and/or anti-irradiation layer and others. These layers and/or emulsion layers may contain a dye, which flows out of a color sensitive material during a development process, or which is bleached during the similar process.

In order to suppress a gloss of a light sensitive material, to improve retouchability, to prevent mutual adhesion of light sensitive materials, a matting agent may be added into silver halide emulsion layers derived from a silver halide photographic light sensitive material of the invention and/or the other hydophilic colloid layers.

The photographic emulsion layers derived from the silver halide photographic light sensitive material of the invention as well as other layers may be coated upon a flexible reflex support made of a paper or synthesized paper provided with a lamination of a baryta layer or α-olefin polymer and the like, or, upon a film comprising a semisynthesized or synthesized high molecule such as a cellulose acetate, cellulose intrate, polystyrene, polyvinyl chloride, polyethylene terephthalate, polycarbonate, polyamide and others, or, upon a rigid body such as a glass, metal, cetramic and others.

The silver halide photographic light sensitive material may form an image through a color development known in the art.

The aromatic primarine amine color forming developing agent employed in the color developer of the invention contains those known in the art and widely used for various color photographic processes.

According to the invention, after the color development treatment, the material is further treated with a processing solution which has a fixing capability. If the processing solution having a fixing capability is a fixer, the bleaching process is exercised before the treatment with the processing solution.

As can be understood from the discussions, above, the silver halide photographic light sensitive material of the invention features an excellent color reproducibility as well as a decreased Y-stain, in the non-colored area, caused by light, heat or moisture, and, further, with the similar material, a light-resistance of a magenta dye image is remarkably improved and a discoloration due to light is successfully prevented.

The present invention is specifically described with the following Examples, however, the scope of this invention is not limited only to these Examples.

EXAMPLE 1

The following layers were sequentially disposed upon a paper support which has lamination of polyethylene on the both sides.

First layer: Emulsion layer

Those coated were the magenta coupler (44) according to the present invention at the rate of 6.0 mg/100 $cm^2$, a silver chloro-bromide emulsion (containing 85 mol % silver bromide) at the rate equal to 3.5 mg silver per 100 $cm^2$, dibutylphthalate at the rate of 6.0 mg/$cm^2$ and gelatin at the rate of 15.0 mg/100 $cm^2$.

Second layer: Intermediate layer (layer containing ultraviolet absorvent)

Those coated were 2-(2-hydroxy-3-sec-butyl-5-tert-butylphenyl) benzotriazole working as an ultraviolet absorber at the rate of 5.0 mg/100 $cm^2$, dibutylphthalate at the rate of 3.0 mg/$cm^2$ and gelatin at the rate of 12.0 mg/$cm^2$.

Third layer: Protective layer

Gelatin was coated at the rate of 8.0 mg/100 $cm^2$.

The sample, prepared as described above, was designated sample 1.

The samples 2, 3, 4, 5, 6, 7, 8 and 9 were prepared by respectively adding to sample 1 the example compounds of the invention, P-1, P-32, CH-35, CH-38, HI-25, HI-28 serving as magenta dye image stabilizers as well as the comparison examples a and b, below, at the rate equinomolar with the magenta coupler.

Additionally, two among the above-mentioned eight magenta dye image stabilizers were combinedly employed in the combinations shown in Table 1, in order to prepare the samples 10~29.

The two magenta dye image stabilizers combinedly employed in the samples 10~29 were employed in such a manner that two stabilizers are equinomolar with each other and that the total mol of the two stabilizers is equinomolar with the magenta coupler.

Comparison compound a
(Compound disclosed in Japanese Patent O.P.I. Publication No. 48538/1979)

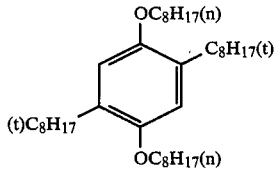

Comparison Compound b
(Compound disclosed in Japanese Patent O.P.I Publication No. 159644/1981)

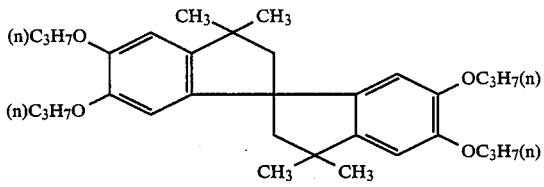

After exposing every sample, prepared above, to a light through an optical wedge, according to a conventional method, each sample was treated with the following processes.

| [Treatment] | Processing temperature | Processing time |
|---|---|---|
| Color development | 33° C. | 3 min 30 sec |
| Bleach-fixing | 33° C. | 1 min 30 sec |
| Rinsing | 33° C. | 3 min |
| Drying | 50~80° C. | 2 min |

The components of each processing agent are as follows.

| [Color developer solution] | |
|---|---|
| Benzyl alcohol | 12 ml |
| Diethylene glycol | 10 ml |
| Potassium carbonate | 25 g |
| Sodium bromide | 0.6 g |
| Sodium sulfite anhydride | 2.0 g |
| Hydroxylamine sulfate | 2.5 g |
| N—ethyl-N—β-methanesulfonamidethyl-3-methyl-4-aminaniline sulfate | 4.5 g |

Water was added to the components to make a 1 l solution, wherein NaOH was added to adjust the PH value at 10.2.

| [Bleach-fixing solution] | |
|---|---|
| Ammonium thiosulfate | 120 g |
| Sodium metabisulfite | 15 g |
| Sodium sulfite anhidride | 3 g |
| EDTA ferric ammoniate | 65 g |

Water was added to the components to make a 1 l solution, wherein the PH value was adjusted to 6.7~6.8.

The densities of the samples 1~29, treated above, were measured with a densitometer (model, KD-7R; manufactured by Konishiroku Photo Industry Co., Ltd.) under the following conditions.

The samples already treated, mentioned above, were exposed to a xenon fade-ometer for 14 days, in order to test the light-resistance of the dye images. Additionally, the judging criteria of the light-resistance of the dye images are as follows.

[Survival ratio]

This is the residue percent of dye after the light-resistance and moisture-resistance tests, when assuming the initial density is 1.0.

[Discoloration degree]

This value is determined by assuming the initial density is 1.0 and by subtracting (yellow density)/(magenta density) before the light-resistance test from (yellow density)/(magenta density) after the light-resistance test. It means that the greater the value is, the more the magenta color is prone to turn to yellower tone.

Table 1 shows the results.

TABLE 1

| Sample No. | Coupler | Dye image stabilizer | Light resistance: Survival ratio (%) | Light resistance: Discoloration degree |
|---|---|---|---|---|
| 1 (means comparison sample) | 44 | — | 15 | 0.85 |
| 2 (means comparison sample) | 44 | P-1 | 57 | 0.12 |

TABLE 1-continued

| Sample No. | Coupler | Dye image stabilizer | Light resistance Survival ratio (%) | Light resistance Discoloration degree |
|---|---|---|---|---|
| 3 (means comparison sample) | 44 | P-32 | 58 | 0.13 |
| 4 (means comparison sample) | 44 | CH-35 | 55 | 0.16 |
| 5 (means comparison sample) | 44 | CH-38 | 56 | 0.15 |
| 6 (means comparison sample) | 44 | HI-25 | 61 | 0.15 |
| 7 (means comparison sample) | 44 | HI-28 | 60 | 0.15 |
| 8 (means comparison sample) | 44 | Comparison compound a | 46 | 0.73 |
| 9 (means comparison sample) | 44 | Comparison compound b | 52 | 0.69 |
| 10 (means comparison sample) | 44 | P-1 + Comparison compound a | 62 | 0.18 |
| 11 (means comparison sample) | 44 | P-32 + Comparison compound a | 62 | 0.18 |
| 12 (means comparison sample) | 44 | CH-35 + Comparison compound a | 60 | 0.21 |
| 13 (means comparison sample) | 44 | CH-38 + Comparison compound a | 62 | 0.20 |
| 14 (means comparison sample) | 44 | HI-25 + Comparison compound a | 63 | 0.20 |
| 15 (means comparison sample) | 44 | HI-28 + Comparison compound a | 64 | 0.19 |
| 16 (means comparison sample) | 44 | P-1 + Comparison compound b | 63 | 0.18 |
| 17 (means comparison sample) | 44 | P-32 + Comparison compound b | 64 | 0.18 |
| 18 (means comparison sample) | 44 | CH-35 + Comparison compound b | 61 | 0.19 |
| 19 (means comparison sample) | 44 | CH-38 + Comparison compound b | 63 | 0.19 |
| 20 (means comparison sample) | 44 | HI-25 + Comparison compound b | 63 | 0.20 |
| 21 (means comparison sample) | 44 | HI-28 + Comparison compound b | 66 | 0.18 |
| 22 (means sample according to the present invention) | 44 | P-1 + CH-35 | 75 | 0.09 |
| 23 (means sample according to the present invention) | 44 | P-1 + CH-38 | 74 | 0.09 |
| 24 (means sample according to the present invention) | 44 | P-1 + HI-25 | 76 | 0.10 |
| 25 (means sample according to the present invention) | 44 | P-1 + HI-28 | 78 | 0.09 |
| 26 (means sample according to the present invention | 44 | P-32 + CH-35 | 74 | 0.11 |
| 27 (means sample according to the present invention) | 44 | P-32 + CH-38 | 74 | 0.10 |
| 28 (means sample according to the present invention | 44 | P-32 + HI-25 | 76 | 0.09 |
| 29 (means sample according to the present invention) | 44 | P-32 + HI-28 | 75 | 0.09 |

The results in Table 1 illustrate that the significantly improved dye image survival ratio in the light-resistance test, though accompanying a slightly greater discoloration, when compared with samples 2~9 prepared by singly adding one magenta dye image stabilizer into the magenta coupler of the invention, was attained with samples 10, 11, 16 and 17 which were prepared by combinedly adding a magenta dye image stabilizer comprising a piperazine or homopiperazine of the invention and a conventional magenta dye image stabilizer into the magenta coupler of the invention, and, with samples 12, 13, 18 and 19 which were prepared by combinedly adding a magenta dye image stabilizer comprising a chroman of the invention, and a conventional magenta dye image stabilizer into the magenta coupler of the invention, and, with samples 14, 15, 20 and 21 which were prepared by combinedly adding a magenta dye image stabilizer comprising a hydroxyindane of the invention into a magenta coupler of the invention.

At the same time, the results also indicate that samples 22~29, of the invention, prepared by combinedly adding both a magenta dye image stabilizer comprising a piperazine or homopiperazine of the invention and a magenta dye image stabilizer comprizing a chroman or hydroxyindane of the invention into a magenta coupler of the invention showed the excellent surviving ratio of dye image, in the light-resistance test, which could not be expected in view of the results for samples 2~7 which were prepared by singly adding each magenta dye image stabilizer of the invention to a magenta coupler of the invention, and that the above samples of the invention also feature effectively minimized discoloration of the dye image in the light-resistance test.

EXAMPLE 2

The coupler and the magenta dye image stabilizer were, in accordance with the combinations shown in Table 2, coated in the same manner as for Example 1 so as to prepare samples 30~58.

Samples 30~58 were treated with the same method described for Example 1. Further, the light-resistance test was exercised on these samples in the same manner as for Example 1, obtaining the results shown in Table 2.

Additionally, the total amount employed of the dye image stabilizing agent contained in each sample was, whichever such an agent was used singly or in combination, equimolar with the coupler. When two dye image stabilizers were employed in one sample, the ratios of the amounts employed of both stabilizers were made equal to each other.

TABLE 2

| Sample No. | Coupler | Dye image stabilizer | Light resistance/ survival ratio (%) |
|---|---|---|---|
| 30 (means comparison sample) | 5 | P-19 | 44 |
| 31 (means comparison sample) | 5 | CH-25 | 45 |
| 32 (means comparison sample) | 5 | HI-37 | 48 |
| 33 (means sample according to the present invention) | 5 | P-19 + CH-25 | 67 |

TABLE 2-continued

| Sample No. | Coupler | Dye image stabilizer | Light resistance/ survival ratio (%) |
|---|---|---|---|
| 34 (means sample according to the present invention) | 5 | P-19 + HI-37 | 69 |
| 35 (means sample according to the present invention) | 5 | P-19 + CH-25 + HI-37 | 72 |
| 36 (means comparison sample) | 54 | P-19 | 48 |
| 37 (means comparison sample) | 54 | CH-25 | 51 |
| 38 (means comparison sample) | 54 | HI-37 | 54 |
| 39 (means sample according to the present invention) | 54 | P-19 + CH-25 | 73 |
| 40 (means sample according to the present invention) | 54 | P-19 + HI-37 | 74 |
| 41 (means sample according to the present invention) | 54 | P-19 + CH-25 + HI-37 | 76 |
| 42 (means comparison sample) | 130 | P-19 | 55 |
| 43 (means comparison sample) | 130 | CH-25 | 55 |
| 44 (means comparison sample) | 130 | HI-37 | 57 |
| 45 (means sample according to the present invention) | 130 | P-19 + CH-25 | 76 |
| 46 (means sample according to the present invention) | 130 | P-19 + HI-37 | 77 |
| 47 (means sample according to the present invention) | 130 | P-19 + CH-25 + HI-37 | 79 |
| 48 (means sample according to the present invention) | 54 | P-2 + CH-6 | 70 |
| 49 (means sample according to the present invention) | 54 | P-2 + HI-3 | 73 |
| 50 (means sample according to the present invention) | 54 | P-3 + CH-6 | 72 |
| 51 (means sample according to the present invention) | 54 | P-3 + HI-3 | 71 |
| 52 (means sample according to the present invention) | 54 | P-7 + CH-6 | 71 |
| 53 (means sample according to the present invention) | 54 | P-7 + HI-3 | 70 |
| 54 (means sample according to the present invention) | 54 | P-27 + CH-27 | 72 |
| 55 (means sample according to the present invention) | 54 | P-26 + CH-36 | 70 |
| 56 (means sample according to the present invention) | 54 | P-31 + CH-47 | 71 |
| 57 (means sample according to the present invention) | 54 | P-33 + HI-12 | 71 |
| 58 (means sample according to the present invention) | 54 | P-34 + HI-44 | 73 |

The results in Table 2 illustrate that the samples prepared by simultaneously adding two or three types of the magenta dye image stabilizers of the present invention into the magenta coupler of the invention have a significantly improved light-resistance property, compared with the samples prepared by adding only one similar agent of the invention, into the magenta coupler of the invention.

EXAMPLE 3

The following layers were sequentially disposed upon a paper support which has lamination of polyethylene on the both sides, in order to prepare a multi-color silver halide photographic light sensitive material, thus obtaining sample 59.

First later: Blue-sensitive silver halide emulsion layer

Those coated were α-pivaloyl-α-(2,4-dioxo-1-benzylimidazoline-3-yl)-2-chloro-5-[γ-(2,4-di-t-amylphenoxy)butylamide] acetanilide as a yellow coupler at the rate of 6.8 mg/100 cm$^2$, a blue-sensitive silver chloro-bromide emulsion (containing 85 mol % silver bromide) at the rate equal to 3.2 mg silver per 100 cm$^2$, dibutylphthalate at the rate of 3.5 mg/100 cm$^2$ and gelatin at the rate of 13.5 mg/100 cm$^2$.

Second layer: Intermediate layer

Those coated were 2,5-di-t-oxtylhydroquinone at the rate of 0.5 mg/100 cm$^2$, dibutylphthalate at the rate of 0.5 mg/100 cm$^2$ and gelatin at the rate of 9.0 mg/100 cm$^2$.

Third layer: Green-sensitive silver halide emulsion layer

Those coated were the magenta coupler 28 of the present invention at the rate of 3.5 mg/100 cm$^2$, a green-sensitive silver chloro-bromide emulsion (containing 85 mol % silver bromide) at the rate equal to 2.5 mg silver per 100 cm$^2$, dibutylphthalate at the rate of 3.0 mg/100 cm$^2$ and gelatin at the ratio of 12.0 mg/cm$^2$.

Fourth layer: Intermediate layer

Those coated were 2-(2-hydroxy-3-sec-butyl-5-t-butylphenyl) benzotriazole working as an ultraviolet absorvent at the rate of 7.0 mg/100 cm$^2$, dibutylphthalate at the rate of 6.0 mg/cm$^2$, 2,5-di-t-octylhydroquinone at the rate of 0.5 mg/cm$^2$ and gelatin at the rate of 12.0 mg/100 cm$^2$.

Fifth layer: Red-sensitive silver halide emulsion layer

Those coated were 2-[α-(2,4-di-t-pentylphenoxy)-butanamide]-4,6-dichloro-5-ethylphenol working as a cyan coupler at the rate of 4.2 mg/100 $cm^2$, a red-sensitive silver chlorobromide emulsion (containing 85 mol % silver bromide) at the rate equal to 3.0 mg silver per 100 $cm^2$, tricresylphosphate at the rate of 3.5 mg/$cm^2$ and gelatin at the rate of 11.5 mg/100 $cm^2$.

Six layer: Intermediate layer

A layer comprising the same contents as in the fourth layer.

Seventh layer: Protective layer

Gelatin was coated at the rate of 8.0 mg/100 $cm^2$.

The multi-layered samples 60~77 were prepared by adding each magenta dye image stabilizer of the invention, at the proportions shown in Table 3, into the above-mentioned sample 59. After the samples were exposed to light and were treated in the same manner as in Example 1, the light-resistance test was exercised on every sample, where every sample was exposed to a xenon fade-ometer for 16 days. The results, too, are shown in Table 3.

TABLE 3

| Sample No. | Dye image stabilizer | Amount employed mol %/coupler | Magenta dye image light resistance/ survival ratio (%) |
|---|---|---|---|
| 59 (means comparison sample) | — | — | 10 |
| 60 (means comparison sample) | P-1 | 100 | 50 |
| 61 (means comparison sample) | P-1 | 150 | 58 |
| 62 (means comparison sample) | CH-35 | 100 | 49 |
| 63 (means comparison sample) | CH-35 | 150 | 57 |
| 64 (means comparison sample) | HI-28 | 100 | 51 |
| 65 (means comparison sample) | HI-28 | 150 | 58 |
| 66 (means sample according to the present invention) | P-1 + CH-35 | 75 + 25 | 66 |
| 67 (means sample according to the present invention) | P-1 + CH-35 | 50 + 50 | 72 |
| 68 (means sample according to the present invention) | P-1 + CH-35 | 25 + 75 | 68 |
| 69 (means sample according to the present invention) | P-1 + CH-35 | 100 + 50 | 69 |
| 70 (means sample according to the present invention) | P-1 + CH-35 | 75 + 75 | 77 |
| 71 (means sample according to the present invention) | P-1 + CH-35 | 50 + 100 | 70 |
| 72 (means sample according to the present invention) | P-1 + HI-39 | 75 + 25 | 68 |
| 73 (means sample according to the present invention) | P-1 + HI-28 | 50 + 50 | 74 |
| 74 (means sample according to the present invention) | P-1 + HI-28 | 25 + 75 | 70 |
| 75 (means sample according to the present invention | P-1 + HI-28 | 100 + 50 | 73 |
| 76 (means sample according to the present invention) | P-1 + HI-28 | 75 + 75 | 79 |
| 77 (means sample according to the present invention) | P-1 + HI-28 | 50 + 100 | 72 |

The rsults in Table 3 illustrate that, when the total amount employed of the magenta dye image stabilizers of the invention is kept constant, the combined employment of the magenta dye image stabilizers of the invention at a proper proportion can, rather than the single employment of the magenta dye image stabilizer of the invention, significantly improve the light-resistance of a magenta dye image.

Further, the samples, according to the invention, feature the excellent color reproducibility as well as the decreased Y-stain.

EXAMPLE 4

Upon a support comprising a polyethylene-coated paper were disposed the previously mentioned example magenta coupler (5) at the rate of 4 mg/$dm^2$, a green-sensitive silver chlorobromide at the rate equivalent to 2 mg silver per $dm^2$, dioctylphthalate at the rate of 4 mg/$dm^2$ and gelatin at the rate of 16 mg/$dm^2$.

Additionally, upon the layer, above, was disposed gelatin at the rate of 9 mg/$dm^2$.

The sample thus prepared was designated sample 101. Then, samples 102 through 117 were prepared by modifying the composition among coupler, metal complex and a dye image stabilizer, as shown in Table 1, contained in the coupler-contained layer of sample 101, and, other than this, these samples were identical with sample 101. Additionally, a metal complex and a dye image stabilizer as well as a coupler were added into a solvent.

After these samples were exposed to a green light through an optical wedge, using a photogrpahic sensitometer (model, KS-7; manufactured by Konishiroku Photo Industry Co., Ltd.), the following processes were conducted.

Standard treatment (processing temperature and processing time)

| | | | |
|---|---|---|---|
| [1] Color development | 38° C. | | 3 min 30 sec |
| [2] Bleach-fixing | 33° C. | | 1 min 30 sec |
| [3] Rinsing | 30° C. | | 3 min |
| [4] Drying | 80° C. | Approx. | 2 min |

[Color developer solution]

| | |
|---|---|
| Benzyl alcohol | 15 ml |
| Ethylene glycol | 15 ml |
| Potassium sulfite | 2.0 g |
| Sodium bromide | 0.7 g |
| Sodium chloride | 0.2 g |
| Potassium carbonate | 30.0 g |
| Hydroxylamine sulfate | 3.0 g |
| Polyphosphoric acid (TPPS) | 2.5 g |
| 3-methyl-4-amino-N—(β-methanesulfonamidethyl)-aniline sulfate | 5.5 g |
| Flourescent brightener (4,4'-diaminostilbendisulfonic acid derivative) | 1.0 g |

-continued

| | |
|---|---|
| Potassium hydroxide | 2.0 g |

Water was added to prepare 1 l solution, which was treated so as to attain the pH value of 10.20.

| [Bleach-fixing solution] | |
|---|---|
| Ethylenediaminetetraacetic ferric ammonium dihydrate | 60 g |
| Ethylenediaminetetraacetic acid | 3 g |
| Ammonium thiosulfate (70% solution) | 100 ml |
| Ammonium sulfite (40% solution) | 27.5 ml |

Potassium carbonate or glacial acetic acid was added so as to attain the pH value of 7.1, wherein water was added in order to prepare 1 l solution.

The light-resistance test was exercised on every sample in the following manner, after the above treatment. The results are shown in Table 4.

[Light-resistance test]

Each sample was exposed to the sunray for 30 days, by employing an under-glass outdoor exposure rack, in order to measure the green densities before and after the color of a sample was allowed to fade. The fading degree due to light, that is, the fading ratio was determined with the following expression.

$$\text{Fading ratio} = (Do - D)\ Do \times 100\ (\%)$$

Where;

Do = Pre-fading density

D = Post-fading density

TABLE 4

| Sample No. | Coupler | Metallic complex | Dye image stabilizer: Piperazine | Dye image stabilizer: Chroman, Indane | Light resistance % (Color fading ratio) |
|---|---|---|---|---|---|
| 101 (means comparison sample) | 5 | — | — | — | 92 |
| 102 (means comparison sample) | 5 | 16 | — | — | 43 |
| 103 (means comparison sample) | 5 | — | P-1 | — | 51 |
| 104 (means comparison sample) | 5 | — | — | CH-35 | 55 |
| 105 (means comparison sample) | 5 | — | — | HI-28 | 56 |
| 106 (means comparison sample) | 5 | 16 | — | CH-35 | 35 |
| 107 (means comparison sample) | 5 | — | P-1 | CH-35 | 43 |
| 108 (means comparison sample) | 5 | 16 | P-1 | — | 36 |
| 109 (means sample according to the present invention) | 5 | 16 | P-1 | CH-35 | 24 |
| 110 (means sample according to the present invention) | 7 | 16 | P-1 | CH-35 | 25 |
| 111 (means sample according to the present invention) | 28 | 16 | P-1 | CH-35 | 22 |
| 112 (means sample according to the present invention) | 44 | 16 | P-1 | CH-35 | 21 |
| 113 (means sample according to the present invention) | 99 | 16 | P-1 | CH-35 | 20 |
| 114 (means sample according to the present invention) | 152 | 16 | P-1 | CH-35 | 22 |
| 115 (means sample according to the present invention) | 157 | 16 | P-1 | CH-35 | 23 |
| 116 (means sample according to the present invention | 172 | 16 | P-1 | CH-35 | 21 |
| 117 (means sample according to the present invention) | 5 | 16 | P-1 | CH-35 | 18 |

The optical quenching rate constant of a singlet oxygen contianed in metal complex 16 is $2\times10^8$ $M^{-1}.sec^{-1}$.

Piperazine: a compound expressed by general formula [XII].

Chroman: a compound expressed by general formula [XIIIa].

Indane: a compound expressed by general formula [XIIIb].

0.5 mol metal complex, 1 mol piperazine, 1 mol chroman and 1 mol indane were added to 1 mol coupler.

As illustrated by Table 4, when any one of piperazine, chroman or indane was added to a metal complex of the present invention, rather than the single employment of the metal complex of the invetion, the light-resistance property is effectively improved, however, such a property is not yet satisfactory. Contrary, the samples, according to the invention, wherein three components, that is, a metal complex of the invention, piperazine, and whichever chroman or indane, were employed feature the significantly improved light-resistance property, and, additionally, such a property is deemed satisfactory.

EXAMPLE 5

The following layers were sequentially disposed upon a paper support which has lamination of polyethylene on the both sides, in order to prepare a multi-color silver halide photographic light sensitive material.

First layer: Blue-sensitive silver halide emulsion layer

Those coated were α-pivalyl-α-(1-benzyl-2,4-dioxyimidalysine-3-yl)-2-chloro-5-[γ-(2,4-di-t-amylphenoxy)butylamido]-acetanilide as a yellow coupler at the rate of 8 mg/dm$^2$, a blue-sensitive silver chloro-bromide emulsion at the rate equal to 3 mg silver per 100 dm$^2$, 2-4-di-t-butylphenol-3',5'-di-t-amyl-4'-hydroxybenzoate at the rate of 3 mg/dm$^2$, dioctylphthalate at the rate of 3 mg/dm$^2$ and gelatin at the rate of 16 mg/dm$^2$.

Second layer; Intermediate layer

Gelatin was coated at the rate of 4 mg/dm$^2$.

Third layer: Green-sensitive silver halide emulsion layer

Those coated were the example magenta coupler (5), mentioned previously, at the ratio of 4 mg/dm$^2$, a green-sensitive silver chloro-bromide emulsion at the rate equal to 2 mg silver per dm$^2$, dioctylphthalate at the rate of 4 mg/dm$^2$and gelatin at the rate of 16 mg/dm$^2$.

Fourth layer: Intermediate layer

Those coated were 2-hydroxy-3',5'-di-t-amylphenyl) benzotriazole working as an ultraviolet absorver at the rate of 3 mg/dm$^2$, 2-(2'-hydroxy-3',5'-di-t-butylphenyl)-benzotriazole at the rate of 3 mg/dm$^2$, dioctylphthalate at the rate of 4 mg/dm$^2$ and gelatin at the rate of 14 mg/dm$^2$.

Fifth layer: Red-sensitive silver halide emulsion layer

Those coated were 2,4-dichloro-3-methyl-6-[α-(2,4-di-t-amylphenoxy) butylamido]-phenol working as a cyan coupler at the rate of 1 mg/dm$^2$, 2-(2,3,4,5,6-pentafluoropenyl)acylamono-4-chloro-5-[α-(2,4-di-tert-amylphenoxy)pentylamido] at the rate of 3 mg/dm$^2$, a red-sensitive silver chloro-bromide emulsion at the rate equal to 2 mg silver per dm$^2$.

Six layer: Intermediate layer

Those coated were 2-(2'-hydroxy-3',5'-di-t-amylphenyl)benzotriazole working as an ultraviolet absorvent at the rate of 2 mg/dm$^2$, 2-(2'-hydroxy-3',5'-di-ti-butylphenyl-benzotriazole at the rate of 2 mg/dm$^2$, dioctylphthalate at the rate of 2 mg/dm$^2$ and gelatin at the rate of 6 mg/dm$^2$.

Seventh layer: Protective layer

Gelatin was coated at the rate of 9 mg/dm$^2$.

The sample so prepared was desiganted sample 101.

Then, samples 119 through 138 were prepared, by combinedly providing the third layer of the above-mentioned sample 118 with a metal complex and a dye image stabilizer in accordance with the combinations shown in Table 2, and, other than this arrangement, these samples were identical with sample 101.

The samples so prepared, above, were exposed and treated in the same manner as in Example 4. The samples so treated were measured for the light-resistance property in the same manner as in Example 4.

Additionally, as for the tone, the maximum absorption wavelength was determined in the following manner, and, each sample was examined with the naked eye whether it was bluer or not.

The results are shown in Table 5.

[Measurement of otne (maximum absorption wavelength)]

After each sample was exposed to green light through an optical wedge, by using a photogrpahic sensitometer (model, KS-7; manufactured by Konishiroku Photo Industry Co., Ltd.), then, the treatment, mentioned previously, was exercised.

Each magenta color-forming sample so prepared was measured for a magenta tone, by employing a color analyzer model 607 manufactured by Hitachi.

In this case, the maximum absorption density around 535 nm~545 nm was set at 1.0.

The maximum absorption wavelength, of each absorption spectrum measured in the above-mentioned manner, was read in order to use the wavelength as the index of a tone.

TABLE 5

| Sample No. | Coupler | Metallic complex | Optical quenching rate constant of singlet Oxygen ($M^{-1} \cdot sec^{-1}$) | Dye image stabilizer: Piperazine | Dye image stabilizer: Chroman, indane | Light resistance (color fading ratio) % | Tone: Maximum absorption wavelength (nm) | Tone: Visual judgement |
|---|---|---|---|---|---|---|---|---|
| 118 (means comparison sample) | 5 | — | — | — | — | 75 | 539 | — |
| 119 (means comparison sample) | 5 | 16 | $2 \times 10^8$ | — | — | 41 | 545 | Blue |
| 120 (means comparison sample) | 5 | — | — | — | CH-35 | 50 | 544 | Blue |
| 121 (means sample according to the present invention) | 5 | 16 | $2 \times 10^8$ | P-1 | CH-35 | 20 | 539 | — |
| 122 (means sample according to the present invention) | 5 | 20 | $2 \times 10^8$ | P-1 | CH-35 | 21 | 540 | — |
| 123 (means sample according to the present invention) | 5 | | $2 \times 10^8$ | P-1 | CH-35 | 22 | 540 | — |
| 124 (means sample according to the present invention) | 5 | 35 | $3 \times 10^9$ | P-1 | CH-35 | 20 | 539 | — |
| 125 (means sample according to the present invention) | 5 | 57 | $3 \times 10^9$ | P-1 | CH-35 | 21 | 539 | — |
| 126 (means sample according to the present invention) | 5 | 105 | $3 \times 10^9$ | P-1 | CH-35 | 21 | 540 | — |
| 127 (means sample according to the present invention) | 5 | 16 | $2 \times 10^8$ | P-7 | CH-35 | 22 | 540 | — |
| 128 (means sample according to the present invention) | 5 | 16 | $2 \times 10^8$ | P-23 | CH-35 | 23 | 539 | — |
| 129 (means sample according to the present invention) | 5 | 16 | $2 \times 10^8$ | P-26 | CH-35 | 23 | 540 | — |
| 130 (means sample according to the present invention) | 5 | 16 | $2 \times 10^8$ | P-31 | CH-35 | 20 | 539 | — |
| 131 (means sample according to the present invention) | 5 | 16 | $2 \times 10^8$ | P-1 | CH-12 | 22 | 540 | — |
| 132 (means sample according to the present invention) | 5 | 16 | $2 \times 10^8$ | P-1 | CH-25 | 21 | 540 | — |
| 133 (means sample according to the present invention) | 5 | 16 | $2 \times 10^8$ | P-1 | CH-28 | 22 | 540 | — |

TABLE 5-continued

| Sample No. | Coupler | Metallic complex | Optical quenching rate constant of singlet Oxygen ($M^{-1} \cdot sec^{-1}$) | Dye image stabilizer Piperazine | Chroman, indane | Light resistance (color fading ratio) % | Tone Maximum absorption wavelength (nm) | Visual judgement |
|---|---|---|---|---|---|---|---|---|
| 134 (means sample according to the present invention) | 5 | 16 | $2 \times 10^8$ | P-1 | CH-37 | 20 | 540 | — |
| 135 (means sample according to the present invention) | 5 | 16 | $2 \times 10^8$ | P-1 | CH-44 | 21 | 540 | — |
| 136 (means comparison sample) | 5 | Comparison metallic complex | $2 \times 10^7$ | P-1 | CH-35 | 48 | 542 | — |
| 137 (means comparison sample) | 5 | 16 | $2 \times 10^8$ | Comparison compound a | CH-35 | 30 | 545 | Blue |
| 138 (means comparison sample) | 5 | 16 | $2 \times 10^8$ | — | CH-35 | 32 | 547 | Blue |

Comparison metal complex

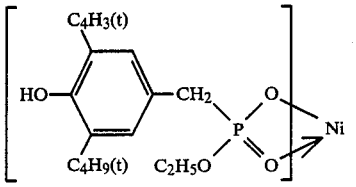

Comparison compound a

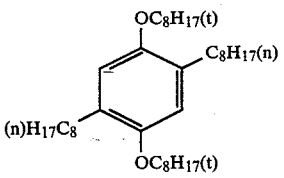

0.5 mol metal complex, 1 mol piperazine, 1 mol chroman and 1 mol indane were added to 1 mol coupler.

As illustrated by Table 5, in the case of multi-layered samples, too, the samples of the invention comprising three components, that is, a metal complex of the invention, piperazine, and, chroman or indane whichever, feature the most excellent light-resistance property.

Table 5 also indicates that the samples singly employing a metal complex of the invention, the samples singly employing chroman or indane and the samples employing both a metal complex and whichever chroman or indane, alike, have longer maximum absorption wavelengths, rendering each magenta dye image bluer.

More specifically, it is apparent that the present invention may not only significantly improve the light-resistance but effectively provide the correct tone.

EXAMPLE 6

Samples 139 through 117 were prepared by modifying the combination between an image stabilizer and an organic solvent, as shown in Table 7, contained in the magenta coupler-contained layer, and by further adding another image stabilizer into the same layer, and, other than above, these samples were identical with sample 121 in Example 5. These samples were examined for the light-resistance and the tone, in the same manner as for Example 5. The results are shown in Table 6.

TABLE 6

| Sample No. | Metallic complex | Dye image stabilizer Piperazine | Chroman, Indane | | Organic solvent % | Light resistance (color fading ratio) % | Tone Maximum absorption wavelength (nm) | Visual judgement |
|---|---|---|---|---|---|---|---|---|
| 118 (means comparison sample) | — | — | — | — | Dioctylphthalate | 75 | 539 | — |
| 119 (means comparison sample) | 16 | — | — | — | Dioctylphthalate | 41 | 545 | Blue |
| 121 (means sample according to the present invention) | 16 | P-1 | CH-35 | — | Dioctylphthalate | 20 | 539 | — |
| 139 (means sample according to the present invention) | 16 | P-1 | CH-35 | A-8 | Dioctylphthalate | 17 | 540 | — |
| 140 (means sample according to the present invention) | 16 | P-1 | CH-35 | A-13 | Dioctylphthalate | 16 | 540 | — |
| 141 (means sample according to the present invention) | 16 | P-1 | CH-35 | — | Dinonylphthalate | 21 | 539 | — |
| 142 (means sample according to the present invention) | 16 | P-1 | CH-35 | — | Trinonylphthalate | 20 | 539 | — |
| 143 (means sample according to the present invention) | 16 | P-1 | CH-35 | — | Amidediethyllauriate | 25 | 540 | — |
| 144 (means sample according to the present invention) | 16 | P-1 | CH-35 | — | Dimethylphthalate | 25 | 540 | — |
| 145 (means sample according to the present invention) | 16 | P-1 | CH-35 HI-28 | A-8 | Dioctylphthalate | 15 | 540 | — |

0.5 mol metal complex, 1 mol piperazine, 1 mol chroman and 1 mol indane were added to 1 mol coupler.

As illustrated by Table 6, it is apparent that samples 121, 139~145 employing not only a metal complex of the invention but image stabilizers have the excellent light-resistance property as well as the correct tone.

Additionally, the results for samples 122, 141~144 illustrate that the employment of an organic solvent having a low dielectric constant is especially effective in improving the light-resistance property.

What is claimed is:

1. A silver halide photographic light sensitive material which comprises at least one magenta dye image-forming coupler expressed by the formula I, at least one compound expressed by the formula XII and at least one compound selected from formulas XIIIa and XIIIb; wherein formula I is

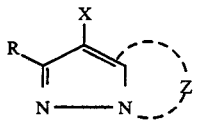

in which Z is a plurality of non-metal atoms necessary to complete a heterocylic ring containing a nitrogen atom, X is a hydrogen atom or a substituent capable of being split off upon reaction with an oxidation product of a color developing agent, and R is a hydrogen atom or a substituent; formula XII is

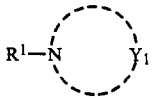

in which $R^1$ is an aliphatic group, a cycloalkyl group, an aryl group or a heterocylic group, $Y_1$ is a group of nonmetal atoms, necessary to complete a piperazine ring or a homopiperazine ring together with a nitrogen atom; formula XIIIa is

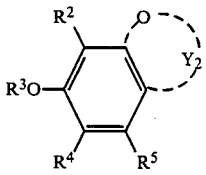

in which $R^2$ and $R^5$ independently are a hydrogen atom, a halogen atom, an alkyl group, an alkenyl group, an alkoxy group, an alkenyloxy group, a hydroxy group, an aryl group, an aryloxy group, an acyl group, an acylamino group, an acyloxy group, a sulfonamide group, a cycloalkyl group or an alkoxycarbonyl group, $R^3$ is a hydrogen atom, an alkyl group, an alkenyl group, an aryl group, an acyl group, a cycloalkyl group or a heterocyclic group, $R^4$ is a hydrogen atom, a halogen atom, an alkyl group, an alkenyl group, an aryl group, an aryloxy group, an acyl group, an acylamine group, an acyloxy group, a sulfonamide group, a cycloalkyl group or an alkoxycarbonyl group, provided that $R^3$ and $R^4$ may be combined with each other to form a 5- or 6-membered ring, and that $R^3$ and $R^4$ may form a methylenedioxy ring, $Y_2$ is a group of atom necessary to complete a chroman ring or a coumarane ring; and formula XIIIb is

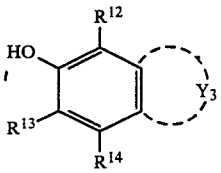

wherein $R^{12}$ and $R^{14}$ independently are a hydrogen atom, a halogen atom, an alkyl group, an alkenyl group, an alkoxy group, a hydroxy group, an aryl group, an aryloxy group, an acyl group, an acylamino group, an acyloxy group, a sulfonamide group, a cycloalkyl group or an alkoxycarbonyl group, $R^{13}$ is a hydrogen atom, a halogen atom, an alkyl group, an alkenyl group, a hydroxy group, an aryl group, an acyl group, an acylamino group, an acyloxy group, a sulfonamide group, a cycloalkyl group or an alkoxycarbonyl group provided that $R^{13}$ and $R^{14}$ may be combined with each other to form a 5- or a 6-membered hydrocarbon ring, and $Y_3$ is a group of atoms necessary to complete an indane ring.

2. The silver halide photographic light sensitive material of claim 1, characterized in that said magenta dye image forming coupler is a compound expressed by the formula VIII as follows:

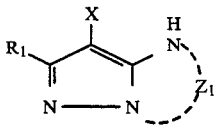

wherein $R_1$ and X and $Z_1$ respectively have the same meanings as R, X and Z in formula I.

3. The silver halide photographic light sensitive material of claim 1, wherein said magenta dye image forming coupler is a compound expressed by any of the following formulas II–VII:

formula II

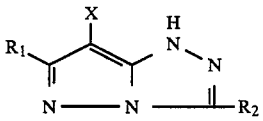

formula III

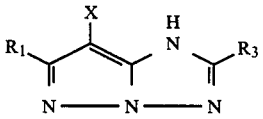

formula IV

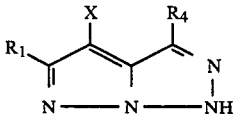

formula V

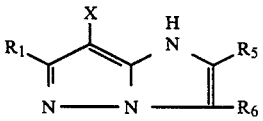

formula VI

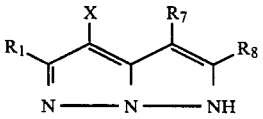

-continued formula VII

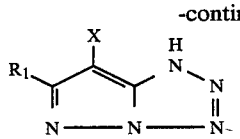

in each of the above formulas, $R_1$ and $R_8$ and X have the same meanings as R and X in formula I of claim 1.

4. The silver halide photographic light sensitive material of claim 1, wherein said magenta dye image forming coupler is a compound expressed by the formula XI as follows:

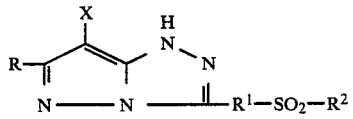

wherein R and X respectively have the same meanings as R and X in formula I of claim 1, $R^1$ is an alkylene group, and $R^2$ is an alkyl group, a cycloalkyl group or an aryl group.

5. The silver halide light sensitive photographic material according to claim 3 wherein R or $R_1$ in formulas I–VII is a group expressed by formula IX as follows:

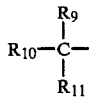

wherein $R_9$, $R_{10}$ and $R_{11}$ independently are a hydrogen atom, halogen atom, or any one of the following groups which can be substituted or unsubstituted: an alkyl group, a cycloalkyl group, an alkenyl group, a cycloalkenyl group, an alkinyl group, an aryl group, a heterocyclic group, an acyl group, a sulfonyl group, a sulfinyl group, a phosphonyl group, a carbamoyl group, a sulfamoyl group, a cyano group, residue of spiro compound, residue of bridged hydrocarbon compound, alcoxy group, aryloxy group, heterocyclic oxy group, siloxy group, acyloxy group, cambamoyloxy group, amino group, acylamino group, sulfonamide group, imide group, ureide group, sulfamoylamino group, alkoxycarbonylamino group, aryloxycarbonylamino group, alkoxycarbonyl group, aryloxycarbonyl group, alklythio group, arythio group, heterocyclic thio group, provided that at least two of $R_9$, $R_{10}$ and $R_{11}$ are atoms or groups other than a hydrogen atom and that at least two of $R_9$, $R_{10}$ and $R_{11}$ may combine with each other to form a ring, and can be saturated or unsaturated such as a cycloalkane, cycloalkene and heterocycle, wherein $R_{11}$ may further combine with the ring to form a residue of a bridged-hydrocarbon compound.

6. The silver halide photographic light sensitive material of claim 1, wherein said compound of formula XII is a piperazine compound expressed by formula XII' or a homopiperazine compound expressed by the formula XII''; where formula XII' is as follows:

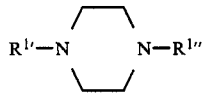

in which $R^1$ is an alkyl group, a cycloalkyl group or an aryl group, $R^{1''}$ is a hydrogen atom, an alkyl group, a cycloalkyl group or an aryl group and where formula XII'' is

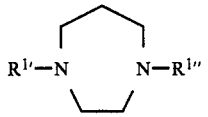

in which $R^{1'}$ and $R^{1''}$ respectively are the same atom or group as $R^{1'}$ and $R^{1''}$ in formula XII'.

7. The silver halide photographic light sensitive material of claim 1, wherein the compound of formula XIIIa is selected from compounds of the formulas XIVa, XVa, XVIa, XVIIa and XVIIIa:

formula XIVa

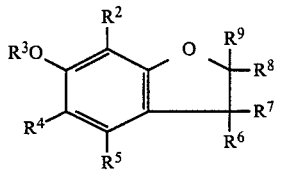

formula XVa

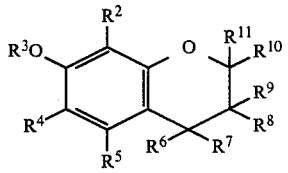

formula XVIa

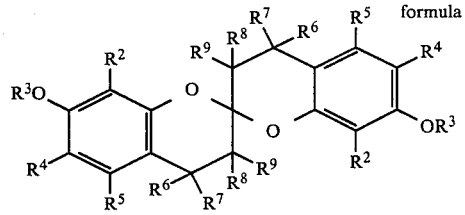

formula XVIIa

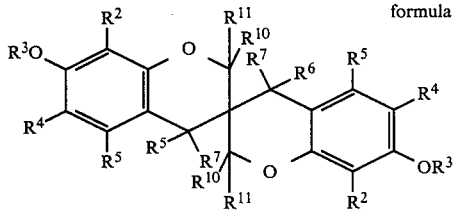

formula XVIIIa

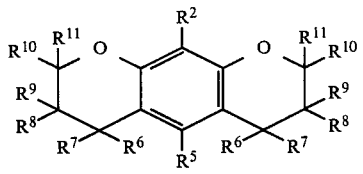

wherein $R^2$, $R^3$, $R^4$ and $R^5$ in general formulas XIVa, XVa, XVIa, XVIIa and XVIIIa respectively have the same meaning as those in formula XIIIa, $R^6$, $R^7$, $R^8$, $R^9$, $R^{10}$ and $R^{11}$ independently are a hydrogen atom, a halogen atom, an alkyl group, a cycloalkyl group, an alkoxy group, a hydroxy group, an alkenyl group, an alkenyloxy group, an aryl group, an aryloxy group or a heterocylic group, provided that $R^6$ and $R^7$, or $R^7$ and $R^8$, or $R^8$ and $R^9$, or $R^9$ and $R^{10}$ or $R^{10}$ and $R^{11}$, in the formulas above, may mutually cyclize to form a hydrocarbon ring which may have an alkyl group as a substituent.

8. The silver halide photographic light sensitive material of claim 1, wherein the compound of formula XIIIb is selected from compounds expressed by formulas XIVb–XVIb:

formula XIVb

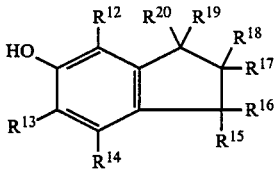

formula XVb

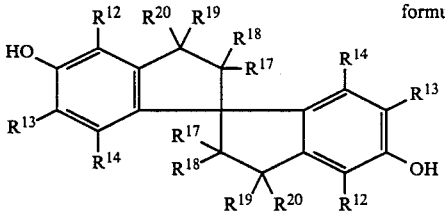

formula XVIb

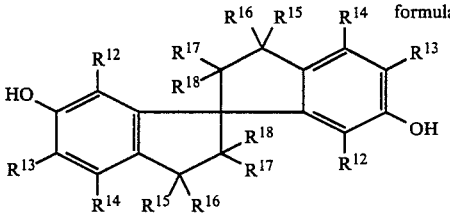

wherein $R^{12}$, $R^{13}$ and $R^{14}$ in formulas XIVb–XvIb have the same meanings as in formula XIIIb, $R^{15}$, $R^{16}$, $R^{17}$, $R^{18}$, $R^{19}$ and $R^{20}$ independently are of a hydrogen atom, a halogen atom, an alkyl group, an alkoxy group, an alkenyl group, a hydroxy group, an aryl group, an aryloxy group or a heterocyclic group provided that $R^{15}$ and $R^{16}$, or $R^{16}$ and $R^{17}$, or $R^{17}$ and $R^{18}$, or $R^{18}$ and $R^{19}$, or $R^{19}$ and $R^{20}$, may mutually cyclize to form a hydrocarbon ring which may have an alkyl group as a substituent.

9. The silver halide photographic light sensitive material of claim 1, further comprising at least one metallic complex wherein an optical quenching rate of a singlet oxygen is more than $3\times10^7\ M^{-1}.sec^{-1}$.

10. The silver halide photographic light sensitive material of claim 5, further comprising at least one metallic complex wherein an optical quenching rate of a singlet oxygen is more than $1\times10^8\ M^{-1}.sec^{-1}$.

11. The silver halide photographic light sensitive material according to claim 9, wherein the metallic complex is selected from compounds expressed by the formulas L-I to L-IV:

formula L-I

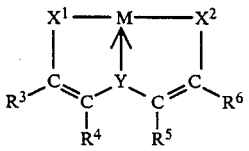

-continued formula L-II

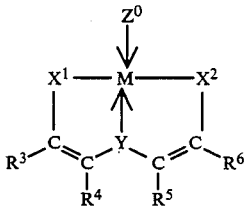

formula L-III

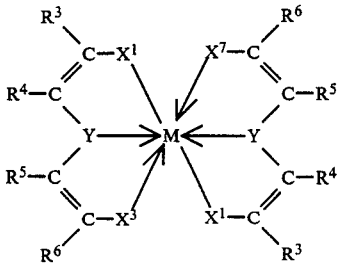

wherein in L-I, L-II and L-III, is a metallic atom, $X^1$ and $X^2$ independently are an oxygen atom, a sulfur atom or a —$NR^7$— in which $R^7$ is a hydrogen atom, an alkyl group, an aryl group or a hydroxy group, $X^3$ is a hydroxy group or a mercapto group, Y is an oxygen atom or a sulfur atom, $R^3$, $R^4$, $R^5$ and $R^6$ independently are any one of a hydrogen atom, a halogen atom, a cyano group, an alkyl group, an aryl group, a cycloalkyl group or a heterocyclic group which directly or via a bivalent bonding group connects with a carbon atom, provided that at least one combination of $R^3$ and $R^4$ or $R^5$ and $R^6$, may form a 5- or 6-membered ring by mutually combining with each other together with a carbon atom, $Z^0$ is a compound which may be coordinated at the position M or a residue derived from such a compound;

formula L-IV is

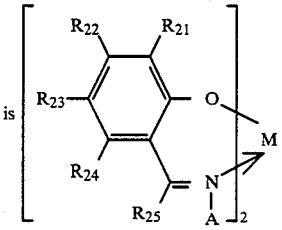

in which $R_{21}$ and $R_{22}$, $R_{23}$ and $R_{24}$ independently are any one of a hydrogen atom, a halogen atom, a hydroxy group, a cyano group, an alkyl group, an aryl group, a cycloalkyl group or a heterocyclic group which may directly or indirectly via a divalent group combine with a carbon atom on a benzene ring, provided that $R_{21}$ and $R_{22}$, $R_{22}$ and $R_{23}$ or $R_{23}$ and $R_{24}$ may mutually combine to form a 6-membered ring, $R_{25}$ is a hydrogen atom, an alkyl group, or an aryl group, A is a hydrogen atom, an alkyl group, an aryl group or a hydroxy group, and M is a metallic atom.

12. The silver halide photographic light sensitive material of claim 11, wherein M is a transitional metal.

13. The silver halide photographic light sensitive material of claim 12, wherein M is selected from a group of metallic atoms consisting of Fe, Co, Ni, Pd, Al and Pt.

14. The silver halide photographic light sensitive material of claim 13, wherein M is Ni.

* * * * *

UNITED STATES PATENT AND TRADEMARK OFFICE

CERTIFICATE OF CORRECTION

PATENT NO. : 4,863,842

DATED : Sept. 5, 1989

INVENTOR(S) : Yutaka Kaneko, et al.

It is certified that error appears in the above-identified patent and that said Letters Patent is hereby corrected as shown below:

Claim 8, column 175, line 37, delete "XvIb" and substitute therefor --XVIb--; and Claim 11, column 176, line 22, delete "L-III, is" and substitute therefor --L-III, M is--.

Signed and Sealed this

Tenth Day of March, 1992

*Attest:*

*Attesting Officer*

HARRY F. MANBECK, JR.

*Commissioner of Patents and Trademarks*